US007325510B2

(12) United States Patent
Giewercer

(10) Patent No.: US 7,325,510 B2
(45) Date of Patent: Feb. 5, 2008

(54) SECURABLE MEDICATION REMINDER DEVICE

(76) Inventor: Harry Giewercer, 29 Hyde Park Drive, Richmond Hill, Ontario (CA) L4B 1V2

( * ) Notice: Subject to any disclaimer, the term of this patent is extended or adjusted under 35 U.S.C. 154(b) by 0 days.

(21) Appl. No.: 10/899,121

(22) Filed: Jul. 27, 2004

(65) Prior Publication Data

US 2005/0056203 A1 Mar. 17, 2005

Related U.S. Application Data

(60) Provisional application No. 60/500,247, filed on Sep. 5, 2003.

(51) Int. Cl.
*G09F 3/20* (2006.01)
*G09F 9/40* (2006.01)

(52) U.S. Cl. ..... 116/324; 116/308; 116/322

(58) Field of Classification Search ..... 116/308, 116/309, 311–316, 317–324, 234–240; 206/459.1, 206/534; 40/495.1, 484, 495, 5, 491; 283/103–106
See application file for complete search history.

(56) References Cited

U.S. PATENT DOCUMENTS

| | | | | | |
|---|---|---|---|---|---|
| 168,395 | A | * | 10/1875 | Harris | 116/323 |
| 276,167 | A | * | 4/1883 | Edwards | 40/5 |
| 464,006 | A | * | 12/1891 | Brunell | 40/5 |
| 557,616 | A | * | 4/1896 | Scott | 116/308 |
| 579,474 | A | * | 3/1897 | De Barry | 116/308 |
| 711,240 | A | * | 10/1902 | Zaring | 40/306 |
| 1,170,298 | A | * | 2/1916 | Lundy | 116/324 |
| 1,317,660 | A | * | 9/1919 | Carlson | 116/308 |
| 1,715,737 | A | * | 6/1929 | Philip | 40/113 |
| 1,751,495 | A | * | 3/1930 | Robinson | 40/360 |
| 1,797,004 | A | * | 3/1931 | Leveen | 116/308 |
| 2,320,472 | A | * | 6/1943 | Rolnick | 40/306 |
| 2,394,372 | A | * | 2/1946 | Evans | 281/42 |
| 2,450,949 | A | * | 10/1948 | Gattuccio et al. | 116/308 |
| 2,493,211 | A | * | 1/1950 | Wolters | 40/360 |
| 2,528,259 | A | * | 10/1950 | Annunziata | 116/308 |
| 2,537,508 | A | * | 1/1951 | Brokaw et al. | 40/391 |
| 2,630,777 | A | * | 3/1953 | Johnson | 116/235 |
| 3,199,231 | A | * | 8/1965 | Ruderian | 434/404 |
| 3,321,858 | A | * | 5/1967 | Bailey | 40/495 |
| 3,583,358 | A | * | 6/1971 | Hanson, Jr. | 116/235 |
| 3,766,882 | A | * | 10/1973 | Babbitt, III | 116/308 |
| 3,769,727 | A | * | 11/1973 | Kent, Jr. | 40/488 |
| 3,994,085 | A | * | 11/1976 | Groselak et al. | 40/665 |
| 4,143,477 | A | * | 3/1979 | Reynolds | 40/359 |
| 4,217,713 | A | * | 8/1980 | Greenberger | 40/488 |
| 4,233,768 | A | * | 11/1980 | Bromberg | 40/489 |

(Continued)

FOREIGN PATENT DOCUMENTS

CH 667623 A5 * 10/1988

*Primary Examiner*—R. Alexander Smith

(57) ABSTRACT

A medication dosage reminder device (1300) operating on the exterior of a medication container (C6) includes a selector member (1304) retentively engaged with an attached cooperating support member (1306). The selector is engageably movable to each of a plurality of selectable positions referencing dosage time indicia (1308). The indicia may be inscribed to establish a highly customized schedule. A selection may be secured against inadvertent displacement of the selector. The selector and the scheduled dosage time period form a reminder indicating when a next dose is due or when the last dose was taken. A standardized device is suitable for use with a large variety of curved wall and flat wall containers.

42 Claims, 54 Drawing Sheets

U.S. PATENT DOCUMENTS 4,323,609 A * 4/1982 Bromberg ..... 428/66.6
4,345,541 A * 8/1982 Villa-Real ..... 116/308
4,688,510 A * 8/1987 McNeely ..... 116/237
4,790,563 A * 12/1988 Instance ..... 283/81
4,825,803 A * 5/1989 Ammann et al. ..... 116/324
5,048,452 A * 9/1991 Haddock et al. ..... 116/225
5,101,756 A * 4/1992 Strumbos ..... 116/234
5,305,706 A * 4/1994 Arjomand ..... 116/234
5,353,439 A * 10/1994 Kurtz et al. ..... 2/160
5,374,461 A * 12/1994 Bromberg ..... 428/43
5,380,043 A * 1/1995 Schwartz ..... 281/15.1
5,447,769 A * 9/1995 Bromberg ..... 428/66.6
5,515,809 A * 5/1996 Weinberg ..... 116/235
5,577,459 A * 11/1996 Alden ..... 116/234
5,704,648 A * 1/1998 Brown et al. ..... 283/81
5,711,425 A * 1/1998 Trimble-Gomez ..... 206/570
5,911,442 A * 6/1999 Olson ..... 283/36
6,095,565 A * 8/2000 Kramer ..... 281/42
6,129,388 A * 10/2000 Bromberg ..... 283/65
6,152,067 A * 11/2000 Mathison ..... 116/308
6,213,518 B1 * 4/2001 Raming ..... 283/67
6,257,623 B1 * 7/2001 Fero ..... 281/42
6,581,773 B2 * 6/2003 Kaplan ..... 206/534
6,649,007 B1 * 11/2003 Key ..... 156/249
2001/0050242 A1 * 12/2001 Kaplan ..... 206/534

* cited by examiner

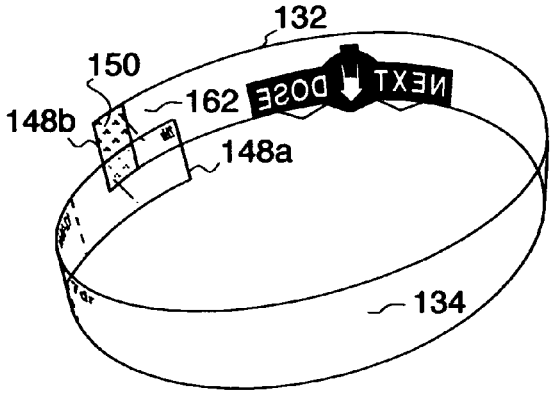
FIG. 8
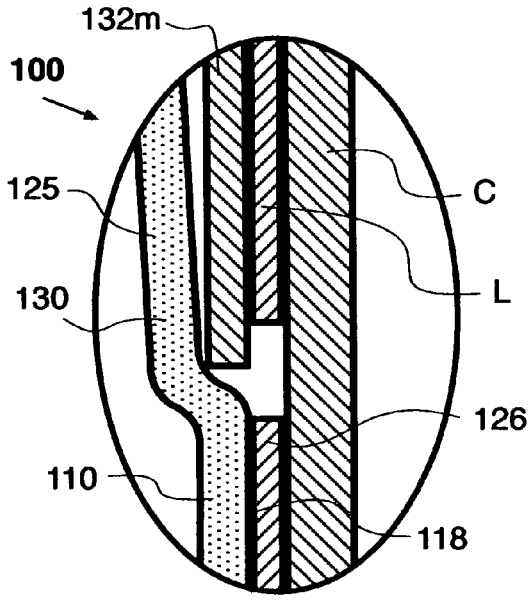
FIG. 9
FIG. 10
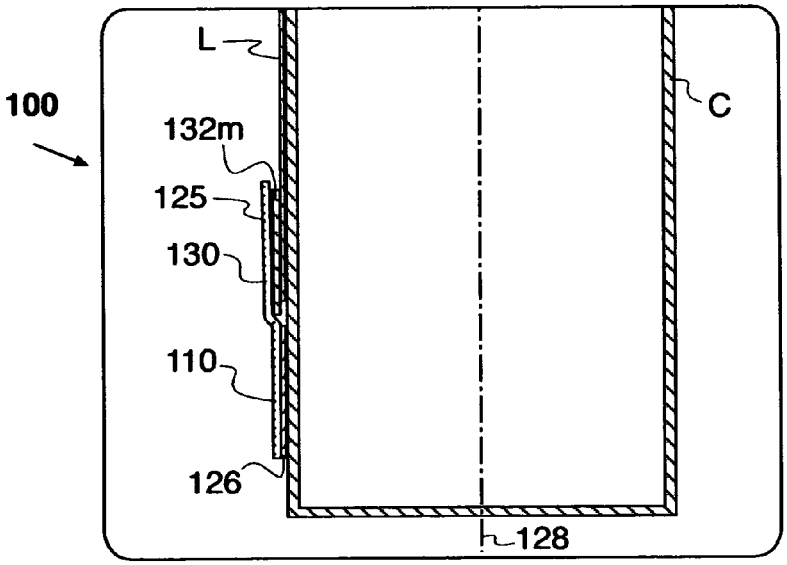

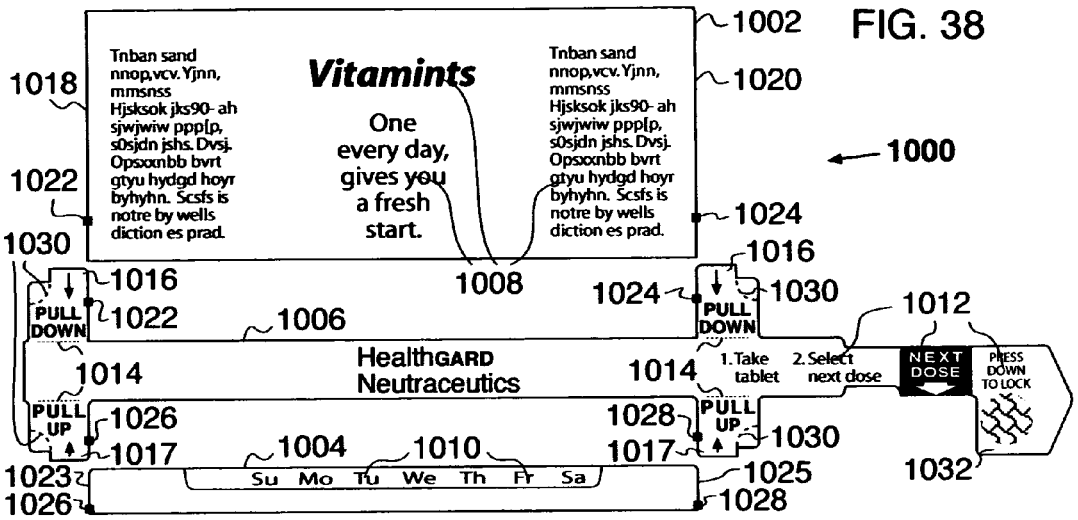
FIG. 38
1002
1020
1000
1018
1022
1024
1030
1016
1008
1012
1006
1014
1026
1017
1004
1010
1028
1025
1032
1023
Tnban sand nnop,vcv. Yjnn, mmsnss Hjsksok jks90- ah sjwjwiw ppp[p, s0sjdn jshs. Dvsj. Opsxxnbb bvrt gtyu hydgd hoyr byhyhn. Scsfs is notre by wells diction es prad.
Vitamints
One every day, gives you a fresh start.
PULL DOWN
PULL UP
HealthGARD Neutraceutics
1. Take tablet
2. Select next dose
NEXT DOSE
PRESS DOWN TO LOCK
Su Mo Tu We Th Fr Sa

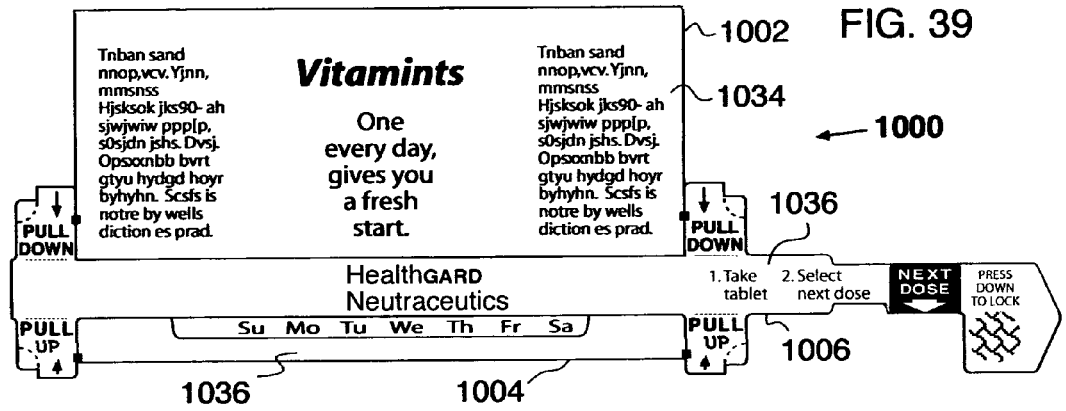
FIG. 39
1002
1034
1000
1036
1006
1004
Tnban sand nnop,vcv. Yjnn, mmsnss Hjsksok jks90- ah sjwjwiw ppp[p, s0sjdn jshs. Dvsj. Opsxxnbb bvrt gtyu hydgd hoyr byhyhn. Scsfs is notre by wells diction es prad.
Vitamints
One every day, gives you a fresh start.
PULL DOWN
PULL UP
HealthGARD Neutraceutics
1. Take tablet
2. Select next dose
NEXT DOSE
PRESS DOWN TO LOCK
Su Mo Tu We Th Fr Sa

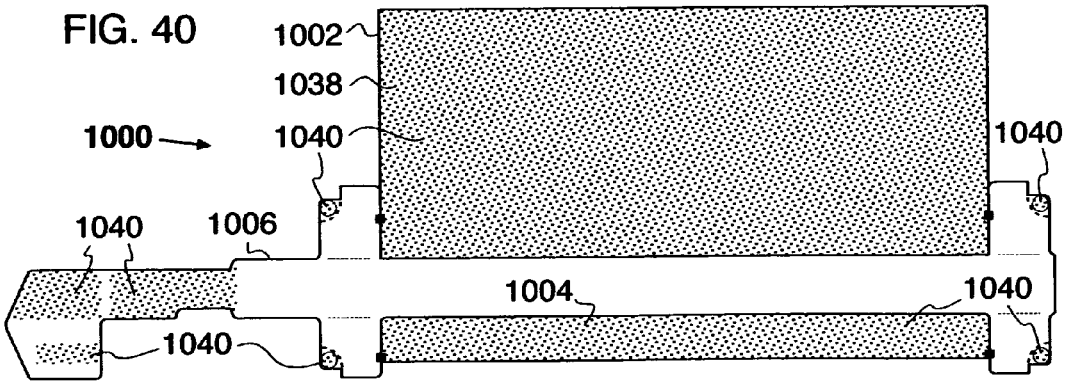
FIG. 40
1002
1038
1000
1040
1006
1004

FIG. 91
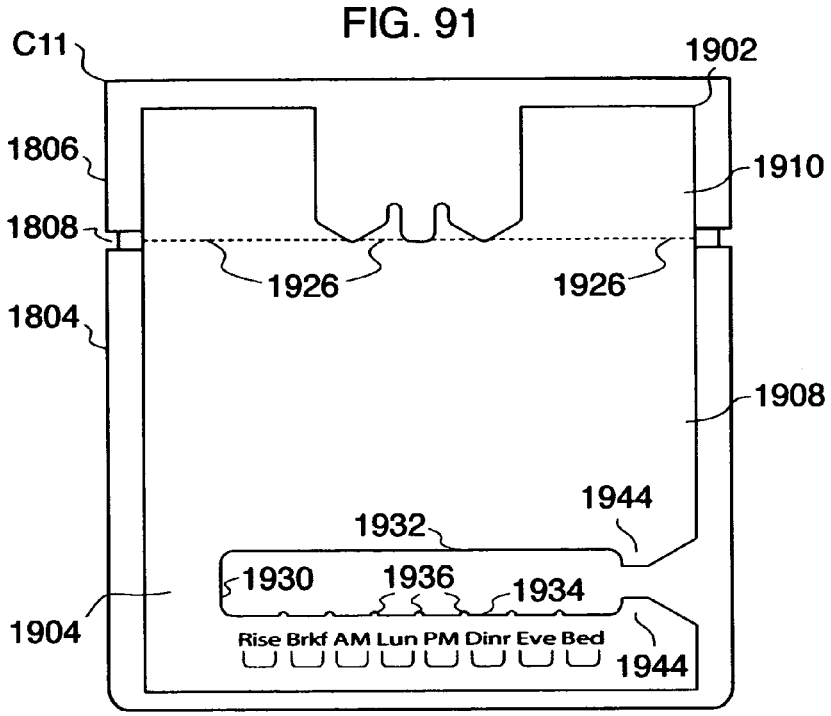
FIG. 92
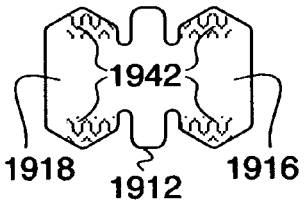
FIG. 93
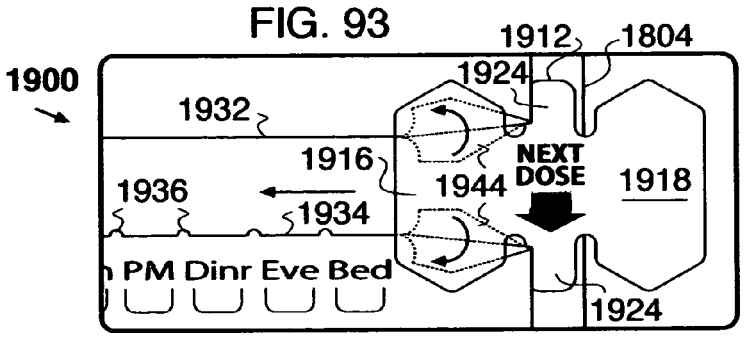
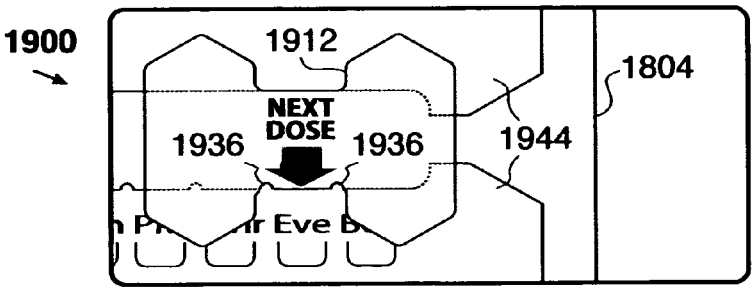
FIG. 94

FIG. 95
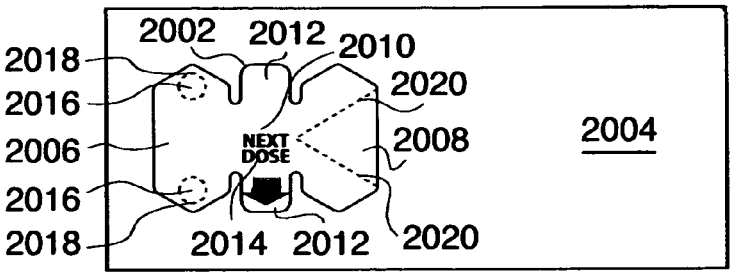
FIG. 96
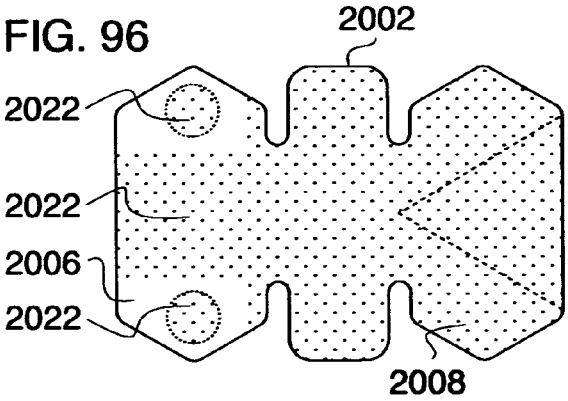
FIG. 97
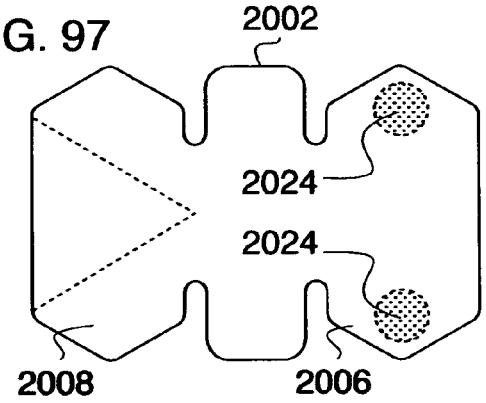
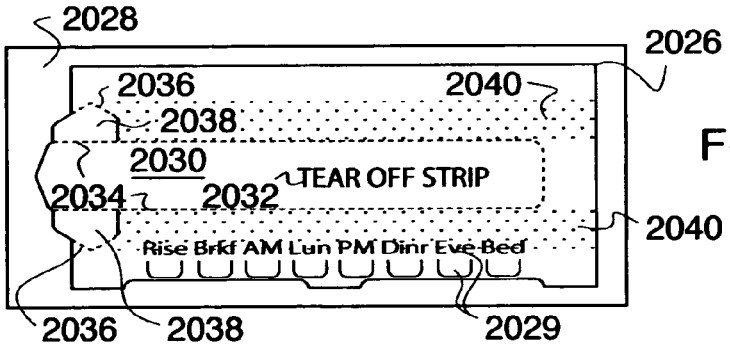
FIG. 98
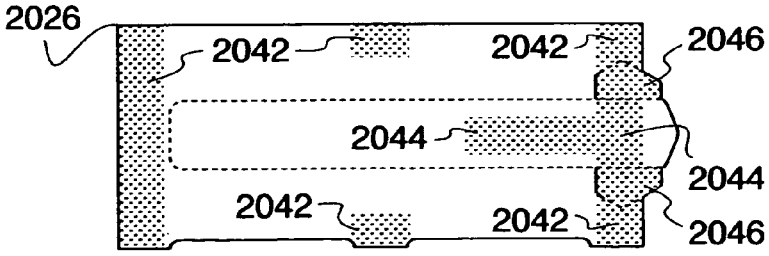
FIG. 99

FIG. 103
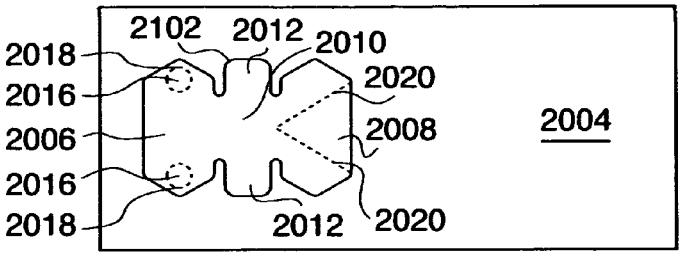
FIG. 104
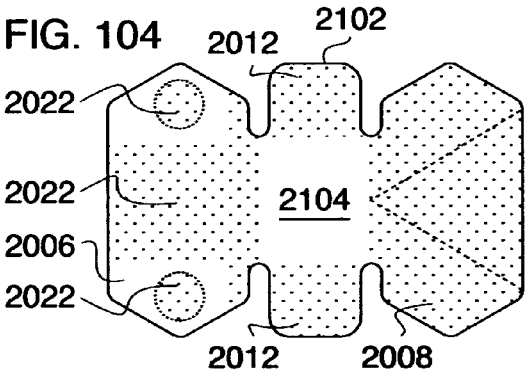
FIG. 105
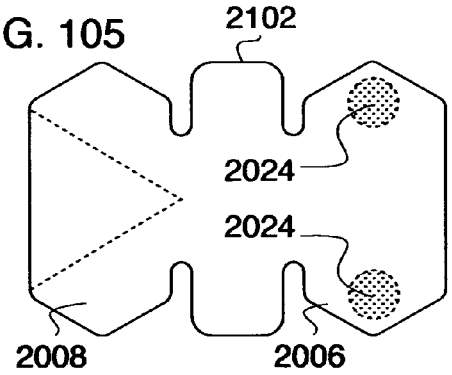
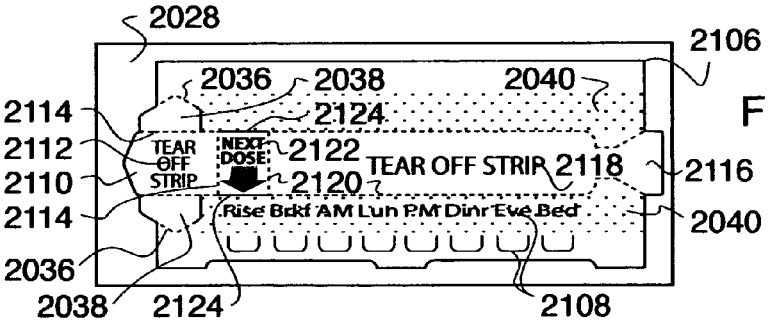
FIG. 106
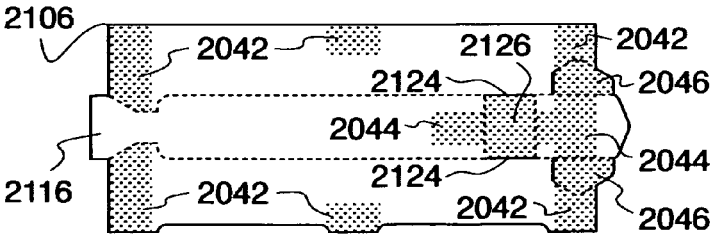
FIG. 107

SECURABLE MEDICATION REMINDER DEVICE

CROSS-REFERENCE TO RELATED APPLICATIONS

This application is based upon provisional application No. 60/500,247 filed on Sep. 5, 2003, titled Medication Dosage Reminder Device.

BACKGROUND OF THE INVENTION

1. Field of the Invention

The present invention can act as a task reminder. In particular, the invention relates to a device for reminding a patient to take his next dose of medication. More specifically, the invention provides a simple visual representation of the patient's dosage schedule for a particular medication, and when the next dose is due or when the last dose was taken.

2. Description of the Background Art

Numerous devices and methods to help patients follow a medication regimen have been developed. Devices that fulfill the needs of large numbers of users and readily adapt to conventional dispensing methods have been the subject of particular interest Cylindrical vials and bottles are the predominant dispensing containers in some parts of the world. Folding cartons that include blister-packaged medications or other immediate drug packaging also appear in common use. Additionally, some medications may be provided in flexible pouches or bags or in specialized containers. Producing a cost-effective reliable reminder device for the great variety of containers in use has presented a considerable challenge.

An extremely adaptive and inexpensive interactive reminder device for use with vial and bottle containers, is disclosed in U.S. patent application Ser. No. 10/050,520 (hereinafter 520), the contents of which are incorporated herein by reference. The device, which may be manufactured from paper or film, includes a rotatable band and a cooperating band support mounted on the side of a standard prescription vial or bottle. A small pressure-sensitive label or a modified prescription label, routinely used by the pharmacy, may serve as the band support. Cooperating indicia on the rotatable band and on the side of the container act to produce a reminder device.

In one embodiment of the above invention, the rotatable band is manufactured by die cutting sheet or roll stock to produce a substantially rectilinear strip of desired size and shape. The strip includes an adhesive portion at one end. The strip is closely wrapped around the cylindrical side of the container such that the ends of the strip overlap each other, forming a band or loop around the container. The overlap portions are adhered together by the pressure-sensitive adhesive, effectively forming an endless or continuous loop of fixed circumference, which is frictionally held on the container and is rotatable about the container. The band support limits downward displacement of the band along the longitudinal axis of the container. Additionally, teeth and notches in the band support and teeth and notches in the rotatable band allow for selective anti-displacement stops to hinder inadvertent rotational displacement of the band. To change a selection, the mounted band is raised along the longitudinal axis of the container to disengage the band support, rotated and lowered to reengage the band support. The selection procedure is similar for embodiments of the invention in which the band support is integral to the container. While the device seems to work well in a great number of applications, there are some shortcomings. Correct mounting and operation of the device is highly container dependent. The band is only retentively engaged with the container so long as friction between the container and band is sufficient The band support merely acts as a stop or anti-displacement member and can only be effective so long as the band is properly retentively engaged with the container. Because the rotatable band is not retentively engaged by the band support at any time, the band also relies greatly on band friction with the container wall to prevent inadvertent dislocation from a selected position, making it is necessary to mount the band sufficiently close around the container wall. Adequate contact with the band support is also required in order to keep the band from sliding downward off the container. The band must also be sufficiently loose on the container to allow for easy rotation. Obtaining this proper balance can take several attempts by some individuals or increase requests for help from the Pharmacist. Some current dispensing vials are produced with pronounced tapered walls, raising the difficulty for achieving good friction while permitting sufficient longitudinal movement of the band. Continually forcing the band upward during operation on such containers can overcome the adhesive used to form a fixed circumference loop. The loosened band is more prone to inadvertent and unwanted dislocation from a chosen referenced position and in some cases will slide over the front surface of the band support to come off the container. Also, because the rotatable band must be longitudinally raised from the band support (i.e. not engageably moveable) to change a selection, the band support cannot act as a rail guide to aid rotation of the band and some shorter containers cannot be used with the above device. While they may provide sufficient space for mounting of band and band support, their height is insufficient to allow the longitudinal displacement required to change selections. It has been found that the relatively thin nature of standard label materials leaves little room for apparent variances in application and operation of the rotatable band. Thin band supports with overall adhesive do not work as a stop mechanism in all instances because they tend to act as a guideway by which a less properly mounted rotatable band can slip off the container. This can be the case, even when the distance (generally radial) of the front of the band support from the container wall is equal to the distance of the front of the band from the container wall. The problem appears most evident on tapered wall cylindrical containers. Additional issues encountered include difficulty by some individuals to move the rotatable band along the longitudinal axis of the container, particularly as the size of the container is increased. Accommodating these individuals can be time consuming and can result in a less than desirable resistance to inadvertent displacement of the band at a selected position. In general, a reminder device that cannot be consistently attached to a container adversely influences widespread use. The ability to reliably secure a selected position, which is of great concern for pharmaceutical applications, can also be an issue with the above rotatable band.

Another reminder device which is cost-effective and is reliably securable is disclosed in U.S. patent application Ser. No. 10/212,761 (hereinafter 761), the contents of which are incorporated herein by reference. The 761 device however, is more aptly suited for attachment to a flat walled article such as a carton container. Additionally, a lock mechanism in the device demands a degree of dexterity lacking in some patients. The shortcomings of these reminder devices (520 and 761) are substantially overcome by the current invention.

SUMMARY OF INVENTION

The invention is a medication reminder device including cooperating members which may operate on the exterior of a medication container. A first sheet member is linked to the container either by attachment of the member to the container or by integral production of the member in a wall of the container. A second cooperating selector member is retentively engaged and is engageably movable to each of a plurality of selectable positions, at which it may be reversibly secured against inadvertent displacement. Application of the device to the container may be automated using known equipment. Time period indicia referencing the selectable positions may be inscribed by a pharmacist or user in order to establish a customized dosage schedule in accordance with prescribed instructions. Alternatively, customization may be accomplished by way of a computer printer. The selector and the scheduled dosage time period indicia form a reminder indicating when a next dose is due or when the last dose was taken. Activation of the device may serve as evidence of package tampering.

Objects and Advantages

Accordingly, besides the objects and advantages of the medication reminder device described in my above patent, several objects and advantages of the present invention are;

a) to provide a device that can operate consistently with most containers;

b) to provide a device that can be reliably secured at each of a plurality of selectable positions;

c) to provide a device that encourages implementation through ease of application and ease of use.

Further objects and advantages of my invention will become apparent from consideration of the drawings and ensuing description.

BRIEF DESCRIPTION OF THE DRAWINGS

FIG. 8 is a perspective view of a transparent band like the band of FIG. 2, showing how it is formed into a continuous band. A medication container around which the band is normally mounted is omitted for clarity.

FIG. 9 is a greatly enlarged, fragmentary, side cross-sectional view showing a device assembled on a medication container as in FIG. 1.

FIG. 10 is an enlarged side cross-sectional partial view of a device assembled as in FIG. 1.

FIG. 38 is a planar view of the front of embodiment 1000 of my invention. In this example, the reminder includes a product content label.

FIG. 39 is a planar view of the front of the device of FIG. 38 as it appears on a release liner for automated application to a container. Shown are the release-coated areas on the front surface of the device. The liner is not shown.

FIG. 40 is a planar view of the back of the device of FIG. 39 showing the adhesive-coated areas or zones.

FIG. 91 is a planar view of the front of the reminder label and container of FIG. 89 after the selector and the tear strip have been removed.

FIG. 92 is a rear view of the selector label of FIG. 89 showing an adhesive pattern on the surface.

FIG. 93 is an enlarged partial planar view of the front of the reminder label and container of FIG. 91 showing the start of selector assembly with the rails.

FIG. 94 is an enlarged partial planar view of the front of the reminder label and container of FIG. 91 after completion of selector assembly with the rails.

FIG. 95 is a front view of a selector label adhered to a release coated liner.

FIG. 96 s an enlarged front view of a front surface of the selector label of FIG. 95 showing a pattern coating of release material.

FIG. 97 is an enlarged rear view of a rear surface of the selector label of FIG. 95 showing an adhesive pattern.

FIG. 98 is a front view of a front surface of a rail label adhered to a release coated liner. The rail label displays a pattern coating of release material on its surface.

FIG. 99 is a rear view of a rear surface of the rail label of FIG. 98 showing an adhesive pattern.

FIG. 103 is a front view of a selector label adhered to the release coated liner of FIG. 95.

FIG. 104 is an enlarged front view of a front surface of the selector label of FIG. 103 showing a pattern coating of release material.

FIG. 105 is an enlarged rear view of a rear surface of the selector label of FIG. 103 showing the adhesive pattern of the selector label of FIG. 95.

FIG. 106 is a front view of a front surface of a rail label adhered to the release coated liner of FIG. 98. The rail label displays the same pattern coating of release material on its surface as that of FIG. 98.

FIG. 107 is a rear view of a rear surface of the rail label of FIG. 106 showing an adhesive pattern.

FIG. 120 is a front view of the selector included in the container of FIG. 118. The illustration depicts an aperture for highlighting a selection and a lock tab for securing the selection.

FIG. 121 is an enlarged side cross-sectional view of the selector of FIG. 120.

FIG. 122 is a partial perspective view of embodiment 2300 of the invention showing the selector of FIG. 120 assembled on the front of the container of FIG. 119. The selected schedule position is not secured in the illustration.

FIG. 123 is a partial perspective view of embodiment 2300 of the invention showing the selector of FIG. 120 assembled on the front of the container of FIG. 119. The selected schedule position is secured in the illustration.

FIG. 124 is an enlarged partial side cross-sectional view of embodiment 2300 of the invention showing the lock tab in the selector of FIG. 120 engaging with a lock area in the container of FIG. 119 to secure the selected position of FIG. 123.

FIG. 125 is an enlarged partial side cross-sectional view of embodiment 2300 of the invention showing the lock tab in the selector of FIG. 120 fully engaged with the lock area in the container of FIG. 119 and the selected position of FIG. 123 secured.

Figure 126:
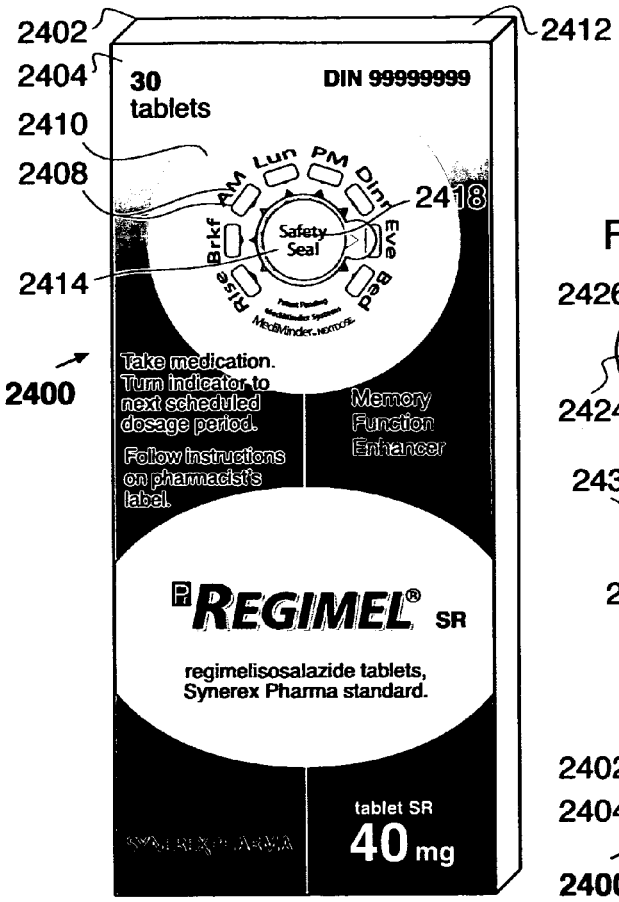

FIG. 126 is a perspective view of embodiment 2400 of the invention. The illustration depicts a reminder device package including a carton container. The front of the container provides an integral pivotably engageable aperture, which in the illustration is covered by a tamper-evident removable label. A selector for assembly with the container is included inside the container and is not visible.

Figure 127:
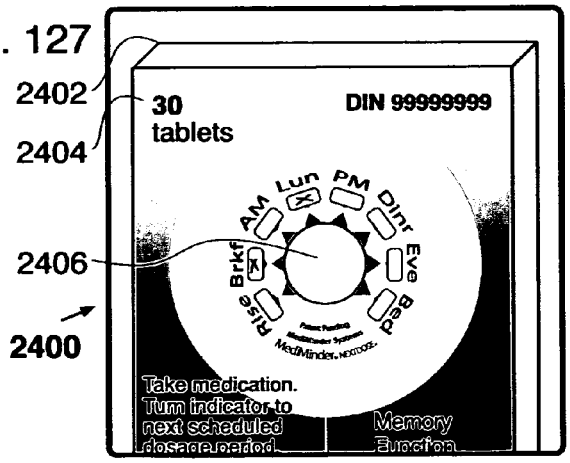

FIG. 127 is a partial perspective view of the package of FIG. 126. The tamper-evident label on the carton has been removed disclosing the aperture.

Figure 128:
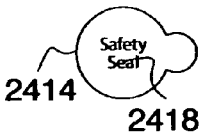

FIG. 128 is a front view of the front surface of the tamper-evident label of FIG. 126.

Figure 129:
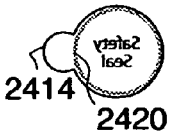

FIG. 129 is a rear view of the rear surface of the tamper-evident label of FIG. 126 showing an adhesive pattern.

Figure 130:
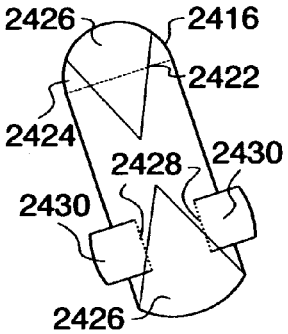

FIG. 130 is a front view of the front surface of the selector included in the container of FIG. 126.

Figure 131:
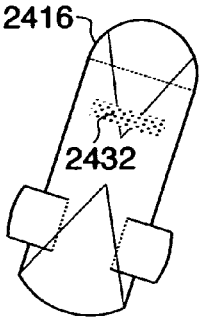

FIG. 131 is a rear view of the rear surface of the selector of FIG. 130 showing an adhesive pattern.

Figure 132:
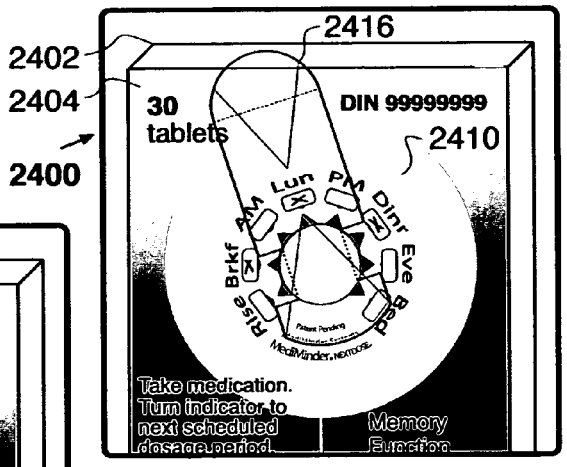

FIG. 132 is a partial perspective view of the package of FIG. 127 showing the selector of FIG. 130 assembled on the front of the container.

Figure 133:
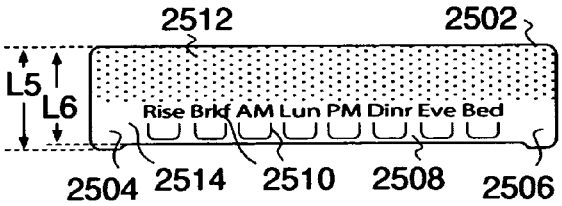

FIG. 133 is a front view of a translucent support rail in an additional embodiment 2500 of the invention.

Figure 134:
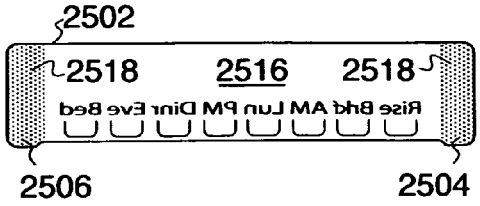

FIG. 134 is a rear view of the support rail of FIG. 133. Indicia produced on the front surface are visible through the material.

Figure 135:
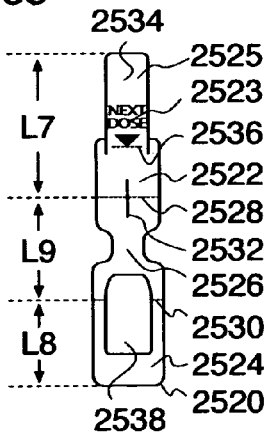

FIG. 135 is a front view of a translucent selector in embodiment 2500.

Figure 136:
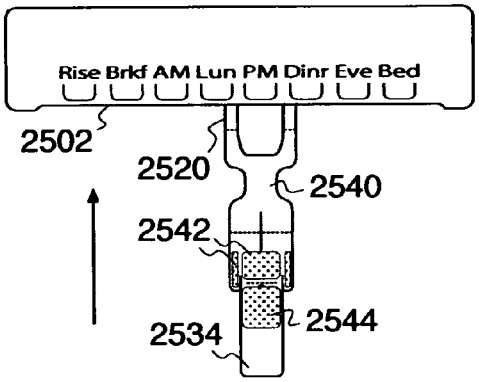

FIG. 136 is a rear view of the selector of FIG. 135 and a front view of the support rail of FIG. 133 being assembled together.

Figure 137:
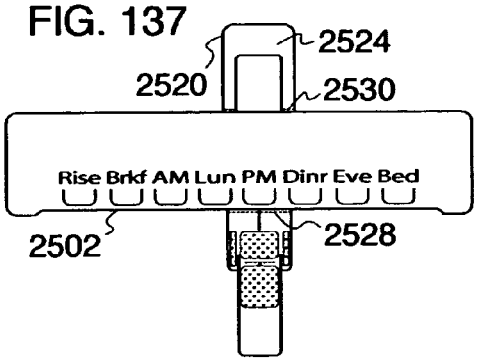

FIG. 137 is a view like that of FIG. 136 showing continued assembly of the members of FIG. 136.

Figure 138:
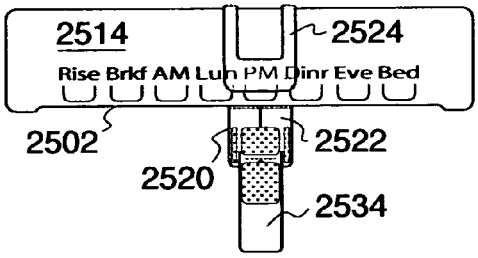

FIG. 138 is a planar view showing further continued assembly of the members of FIG. 137.

Figure 139:
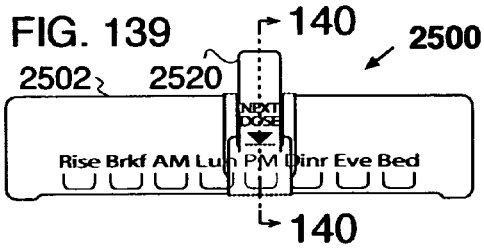

FIG. 139 is a front view of the assembled members in the device 2500.

Figure 140:
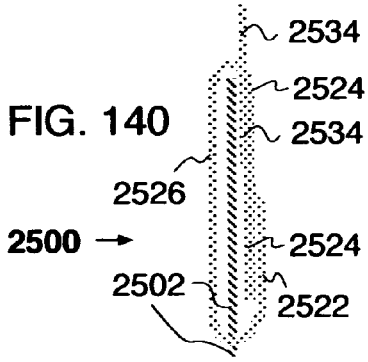

FIG. 140 is an enlarged side cross-sectional view of the device as assembled in FIG. 139.

Figure 141:
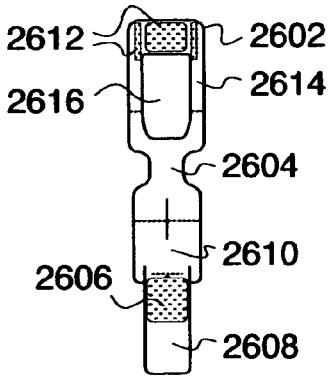

FIG. 141 is a rear view of a translucent selector in an additional embodiment 2600 of the invention.

Figure 142:
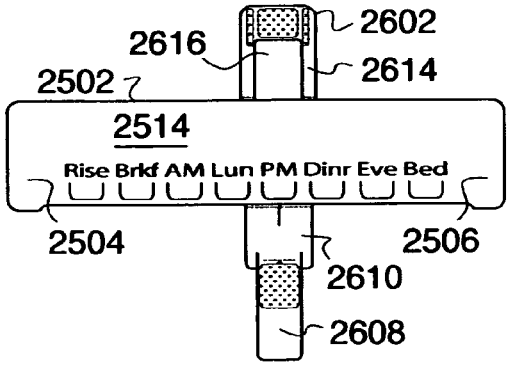

FIG. 142 is a planar view of the selector of FIG. 141 being assembled with the support rail of FIG. 133.

Figure 143:
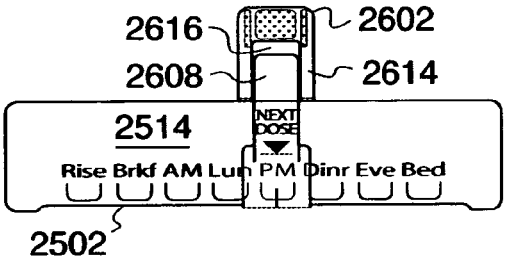

FIG. 143 is a planar view showing further continued assembly of the members of FIG. 142.

Figure 144:
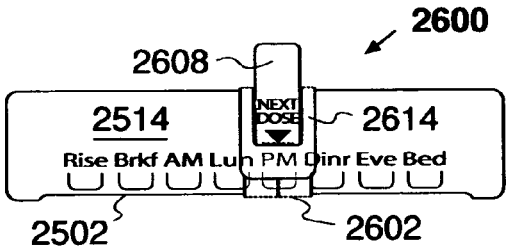

FIG. 144 is a front view of the assembled members in the device 2600.

Figure 145:
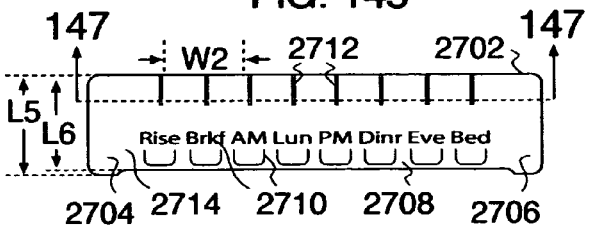

FIG. 145 is a front view of a translucent support rail in an additional embodiment 2700 of the invention.

Figure 146:
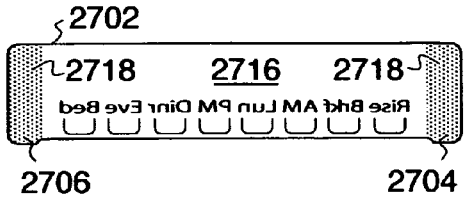

FIG. 146 is a rear view of the of the support rail of FIG. 145. Indicia produced on the front surface are visible through the material.

Figure 147:
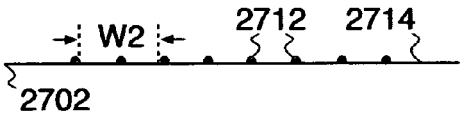

FIG. 147 is a cross-sectional view of the support rail of FIG. 145 showing raised bars.

Figure 148:
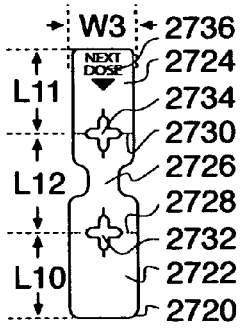

FIG. 148 is a front view of a translucent selector in embodiment 2700.

Figure 149:
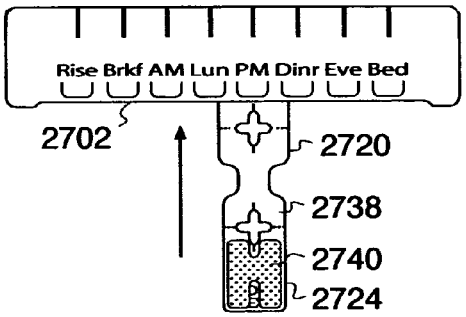

FIG. 149 is a planar view of the selector of FIG. 148 being assembled with the support rail of FIG. 145.

Figure 150:
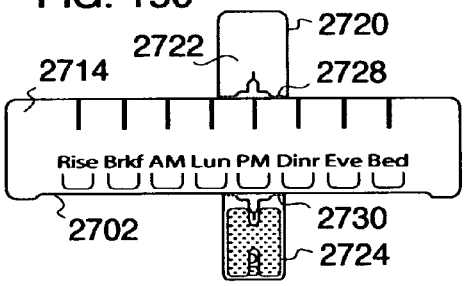
Figure 151:
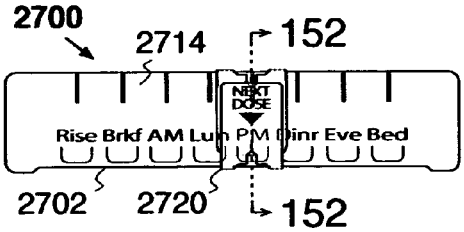

FIG. 150 is a planar view showing further continued assembly of the members of FIG. 149. FIG. 151 is a front view of the assembled members in the device 2700.

Figure 152:
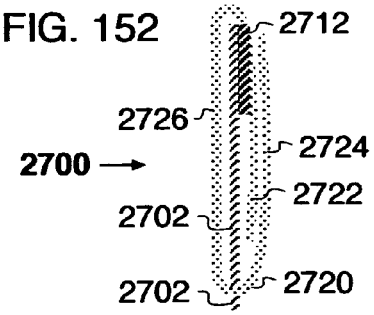

FIG. 152 is an enlarged side cross-sectional view of the device as assembled in FIG. 151.

Figure 153:
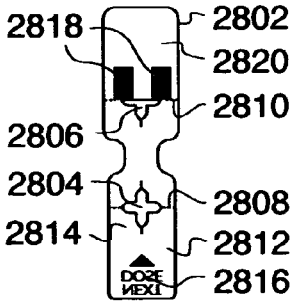

FIG. 153 is a front view of a translucent selector in an additional embodiment 2800 of the invention.

Figure 154:
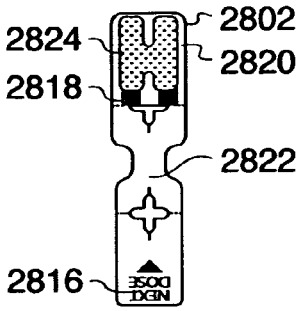

FIG. 154 is a rear view of the selector of FIG. 153.

Figure 155:
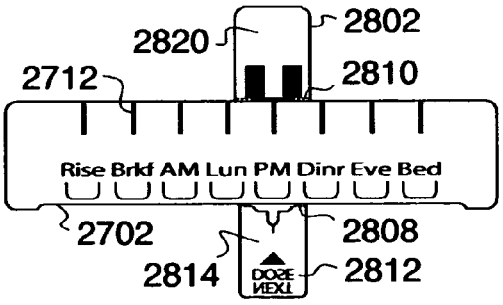

FIG. 155 is a planar view of the selector of FIG. 153 being assembled with the support rail of FIG. 145.

Figure 156:
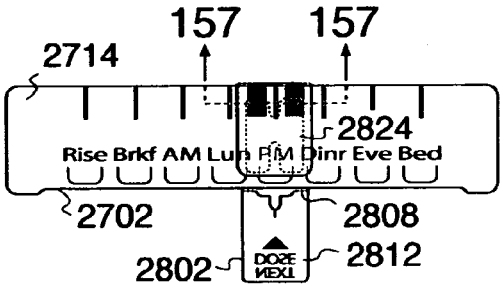

FIG. 156 is a planar view showing further continued assembly of the members of FIG. 155.

Figure 157:
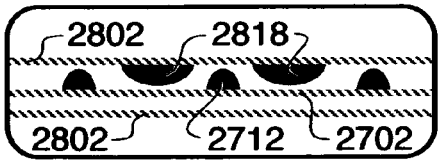

FIG. 157 is an enlarged partial side cross-sectional view of the members as assembled in FIG. 156.

Figure 158:
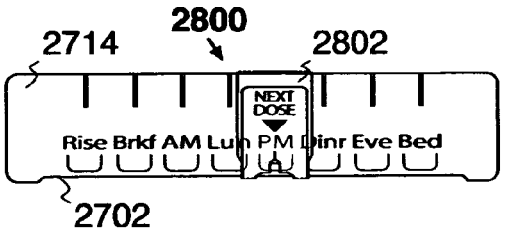

FIG. 158 is a front view of the assembled members in the device 2800.

Figure 159:
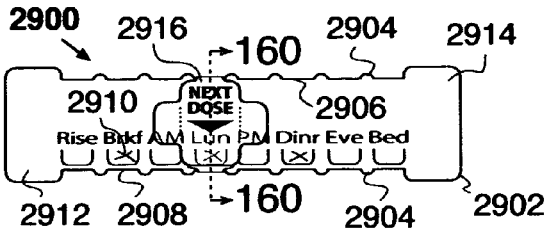

FIG. 159 is a front view of an additional embodiment of the invention 2900.

Figure 160:
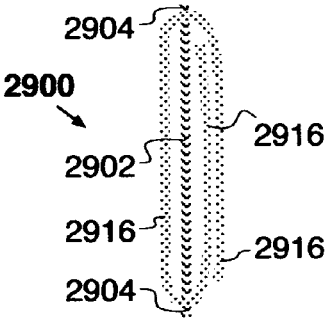

FIG. 160 is an enlarged side cross-sectional view of the translucent members as assembled in FIG. 159.

Figure 161:
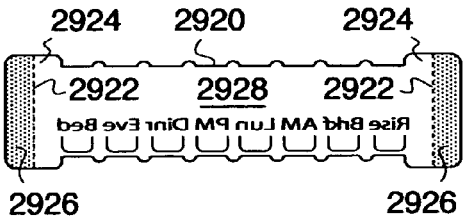

FIG. 161 is a rear view of the support rail of FIG. 159.

Figure 162:
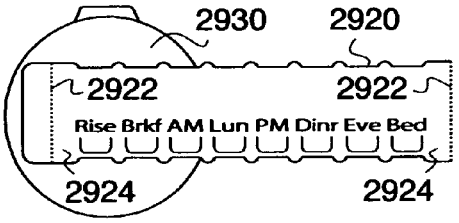

FIG. 162 is a planar view of the support rail of FIG. 159 adhered to a cap of a container.

Figure 163:
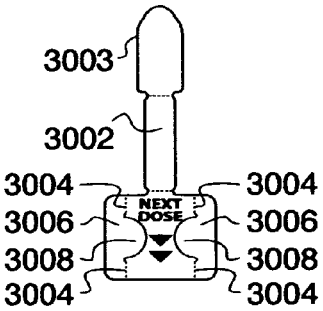
Figure 164:
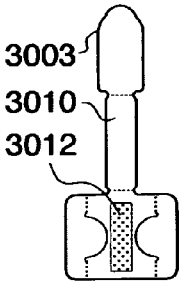

FIG. 163 is a front view of a selector in an additional embodiment 3000 of the invention. FIG. 164 is a rear view of the selector of FIG. 163.

Figure 165:
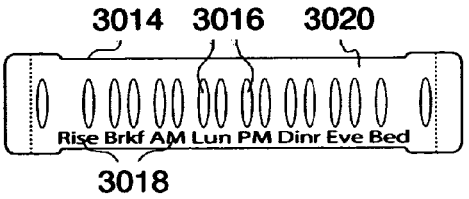

FIG. 165 is a front view of a support rail in embodiment 3000 of the invention.

Figure 166:
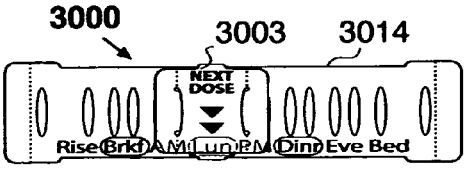

FIG. 166 is a front view of the selector in FIG. 163 assembled with the support rail in FIG. 165 to produce the device 3000.

Figure 167:
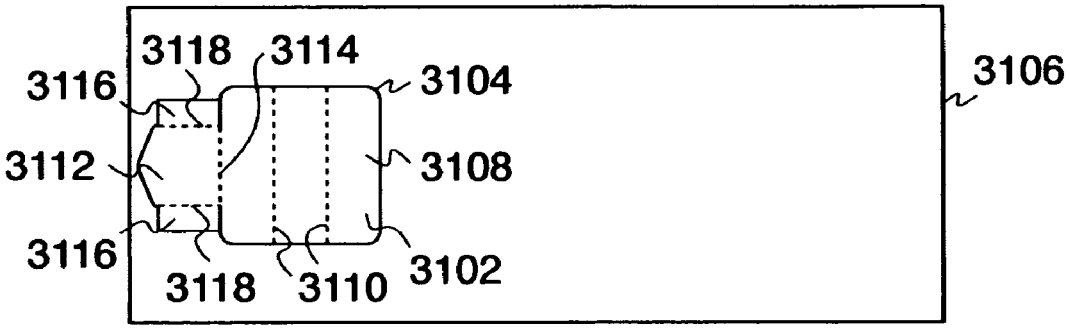

FIG. 167 is a front view of a first member of an additional embodiment 3100 of the invention. The member is shown held on a release liner.

Figure 168:
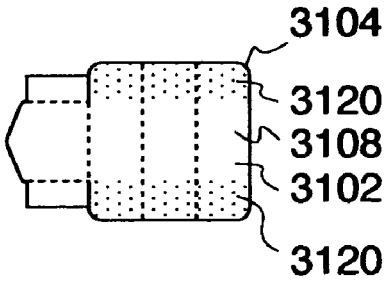

FIG. 168 is an additional front view of the first member of FIG. 167. Shown is a pattern of release material on the front surface.

Figure 169:
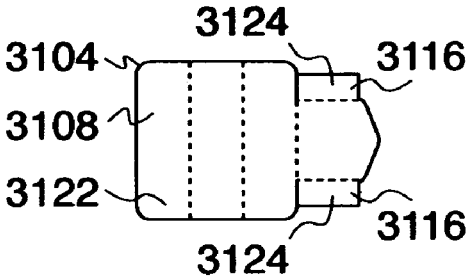

FIG. 169 is a rear view of the first member of FIG. 168, showing a pattern of adhesive coating.

Figure 170:
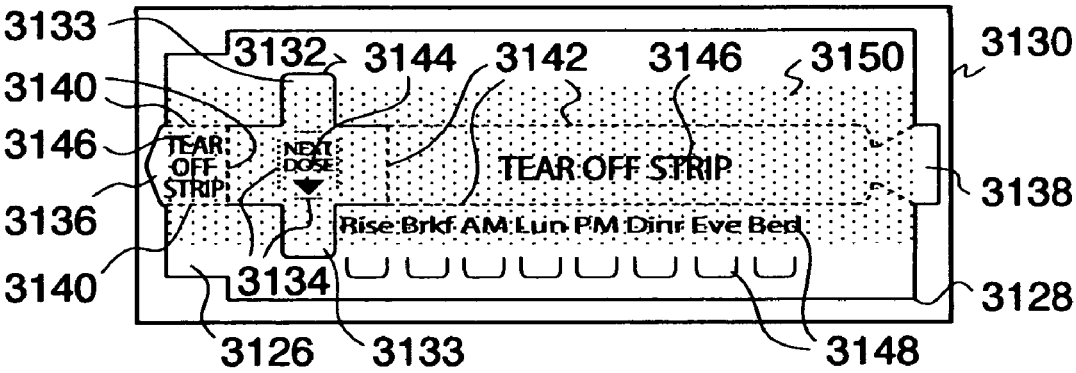

FIG. 170 is a front view of a second member in the embodiment 3100. The member includes a pattern of release material and is shown held on a release liner.

Figure 171:
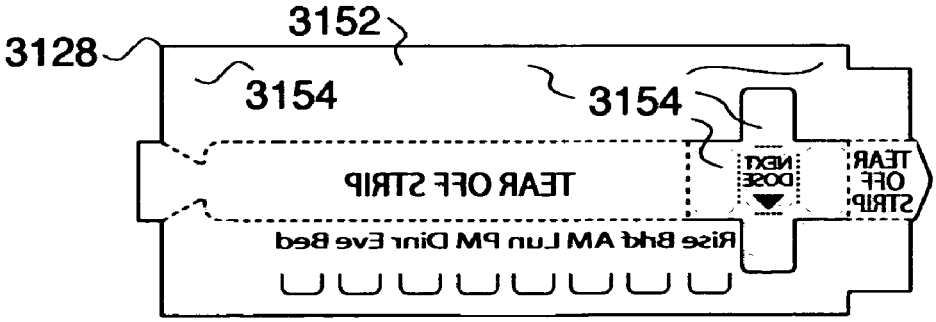

FIG. 171 is a rear view of the second member of FIG. 170, showing a pattern of adhesive coating.

Figure 172:
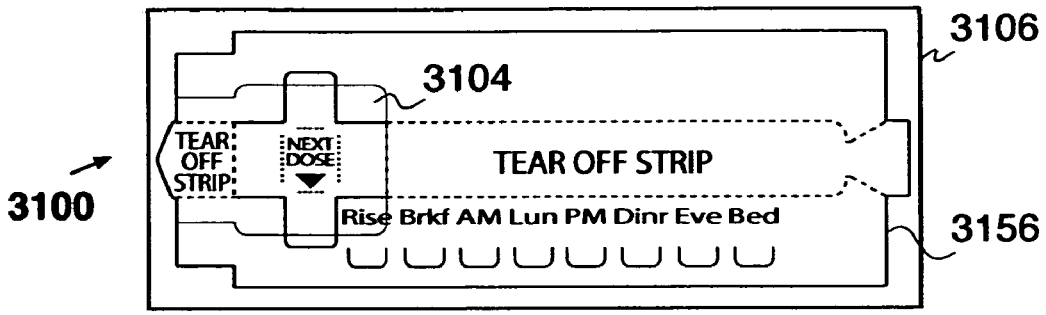

FIG. 172 is a planar view showing the second member of FIG. 170 superimposed in register onto the first member of FIG. 167 to produce the combined member device 3100 on the liner of FIG. 167.

Figure 173:
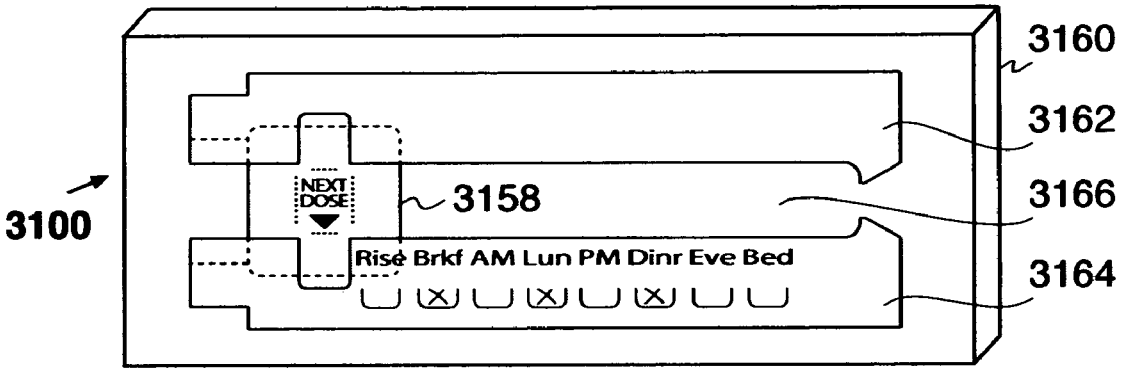

FIG. 173 is a perspective view of the device of FIG. 172 removed from the liner of FIG. 167 and mounted on a carton container. Tear strips in the device are shown removed.

Figure 174:
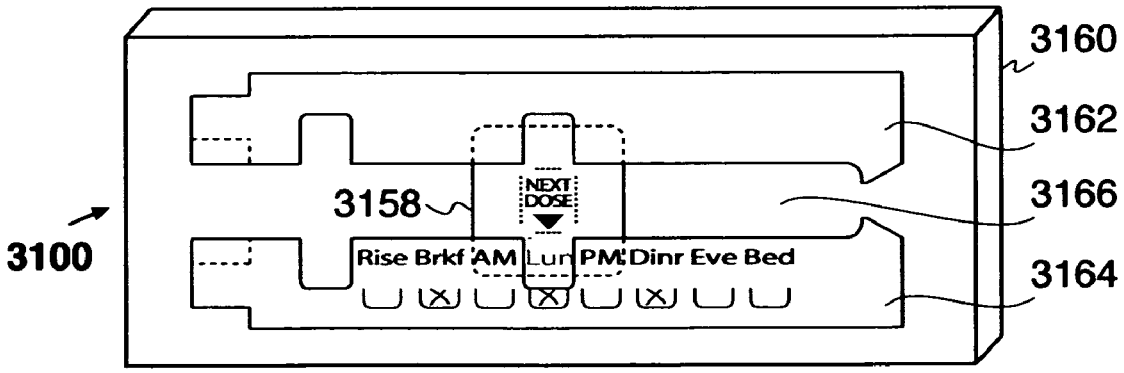

FIG. 174 is the perspective view of the device and carton of FIG. 173, showing a combined selector in the device moved to a selection.

Figure 175:
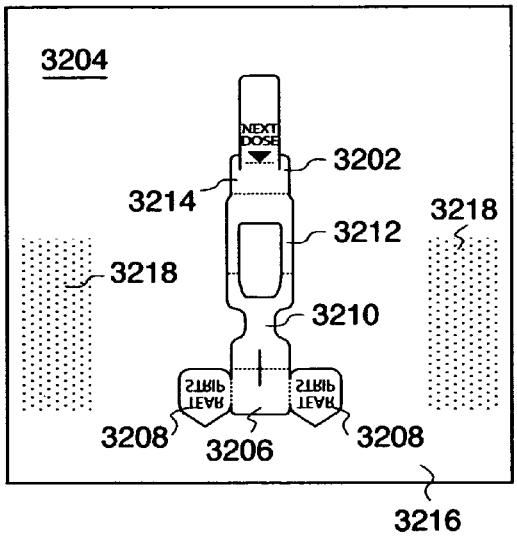

FIG. 175 is a front view of the front surface of a label sheet according to an additional embodiment 3200 of the invention. A selector member is shown die cut in the label sheet.

Figure 176:
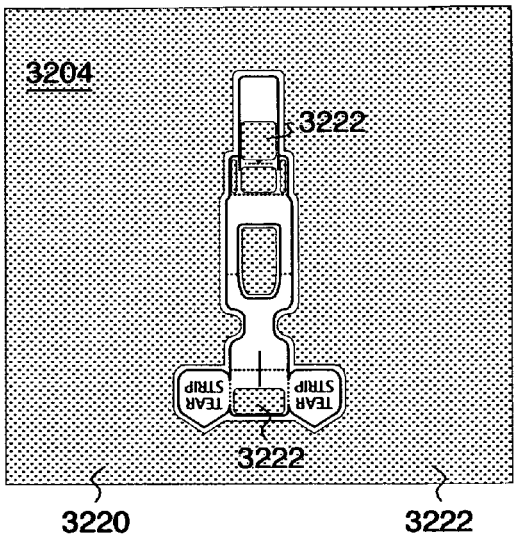

FIG. 176 is a rear view of the rear surface of the label sheet of FIG. 175 depicting an adhesive pattern.

Figure 177:
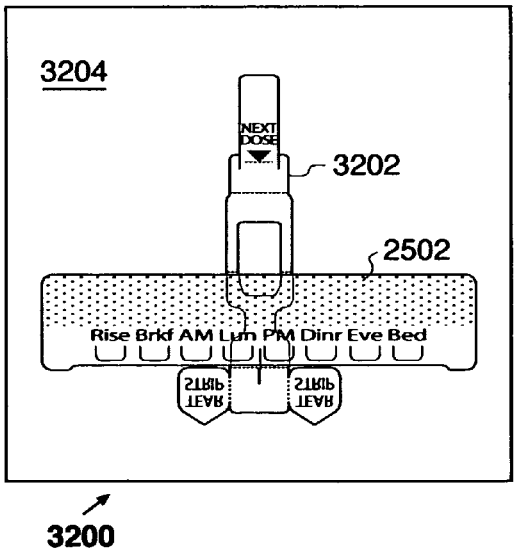

FIG. 177 is a front view of the label sheet of FIG. 175 showing the rail of FIG. 133 superimposed on the surface of the label sheet in assembly.

Figure 178:
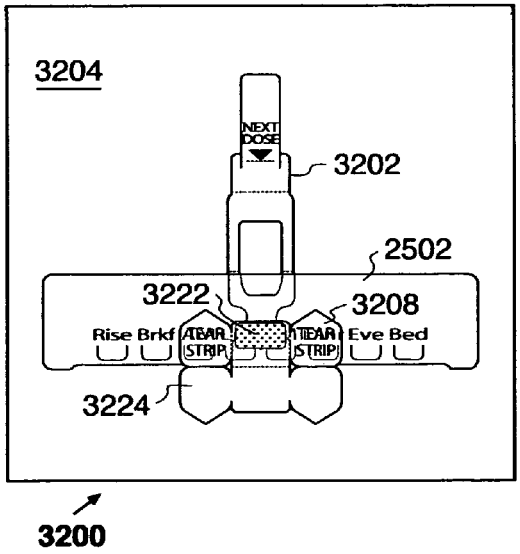

FIG. 178 is a front view of the members in progressive assembly from the condition shown in FIG. 177.

Figure 179:
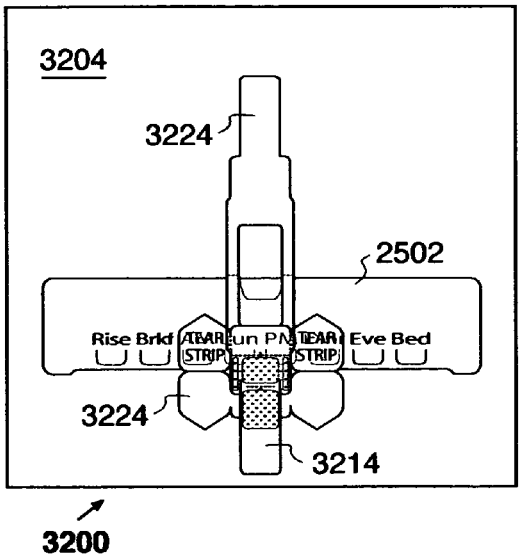

FIG. 179 is a front view of the members in further progressive assembly from the condition shown in FIG. 178.

Figure 180:
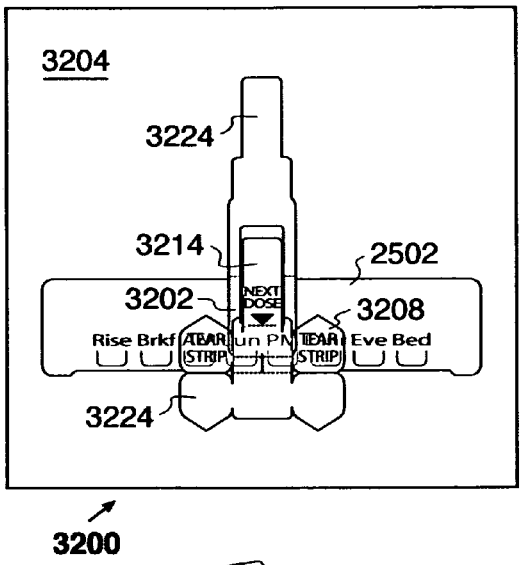

FIG. 180 is a front view of the members in completed assembly from the condition shown in FIG. 179.

Figure 181:
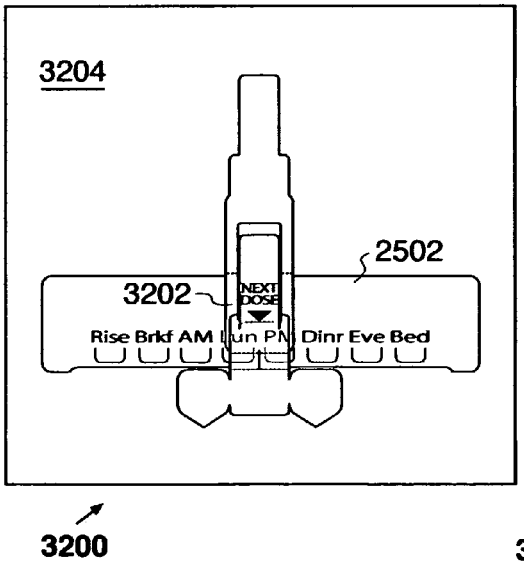

FIG. 181 is a front view like that of FIG. 180 showing tear strips in the device removed.

Figure 182:
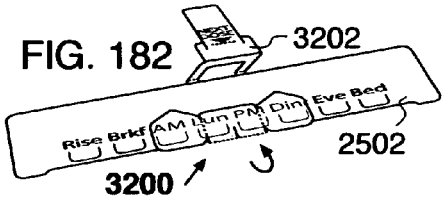

FIG. 182 is a perspective view of the selector and the rail members in the device 3200 showing how the selector is formed into a continuous loop around the rail.

Figure 183:
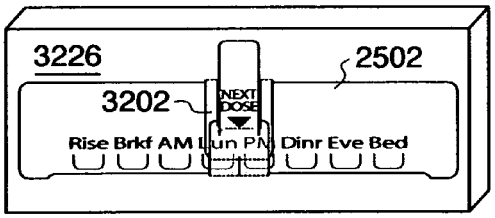

FIG. 183 is a perspective view of the device 3200 attached to the side of a container.

Figure 184:
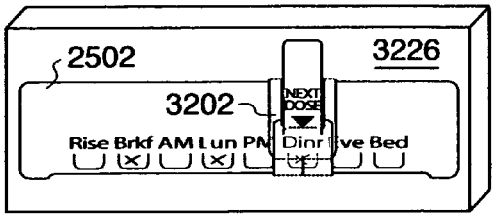

FIG. 184 is a perspective view of the device of FIG. 183 showing a selected time for the next dose.

Figure 185:
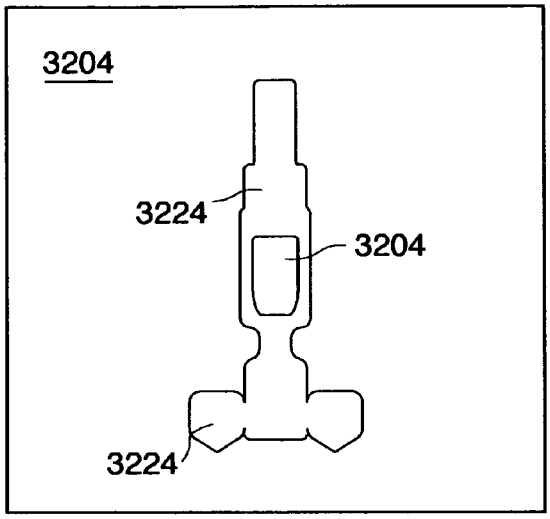
Figure 186:
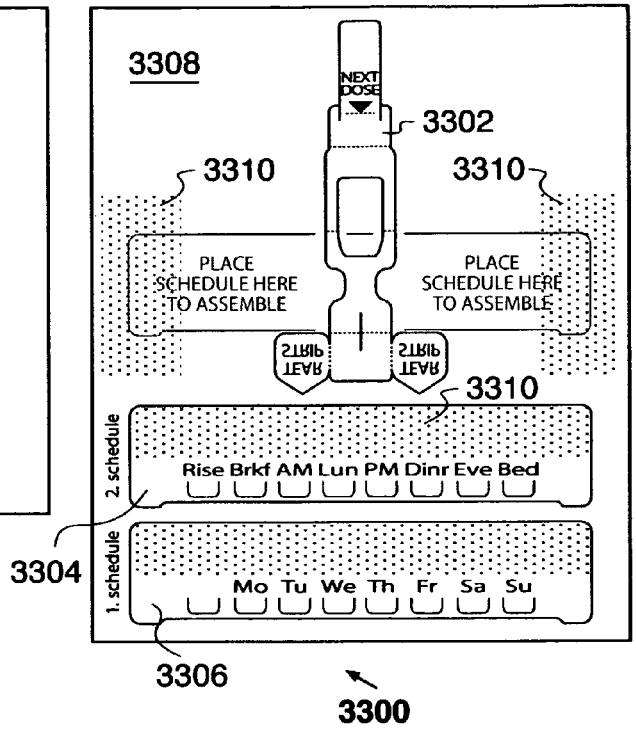

FIG. 185 is a front view of the label sheet of FIG. 181 after the assembled device has been removed from the sheet FIG. 186 is a front view of the front surface of a label sheet according to an additional embodiment 3300 of the invention. A selector member and rail members are shown die cut in the label sheet The front surface is shown including a pattern of release material.

Figure 187:
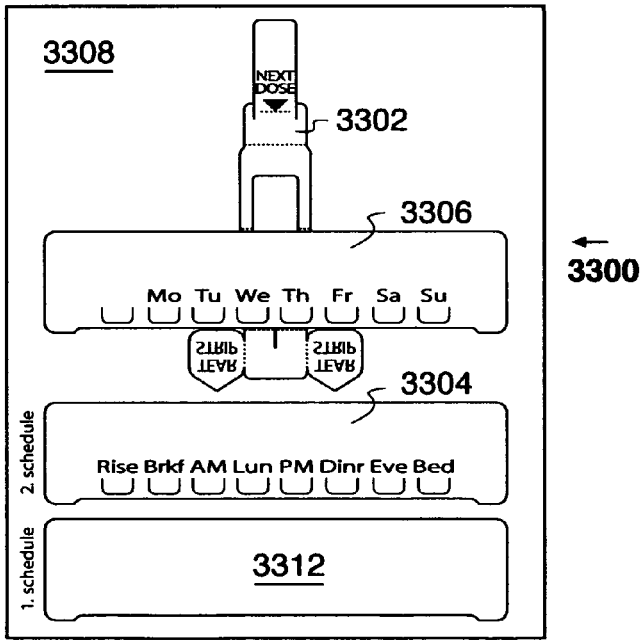

FIG. 187 is a front view like that of FIG. 186 depicting one of the rail members superimposed on the selector member in assembly.

REFERENCE NUMERALS IN DRAWINGS

Figure 1:
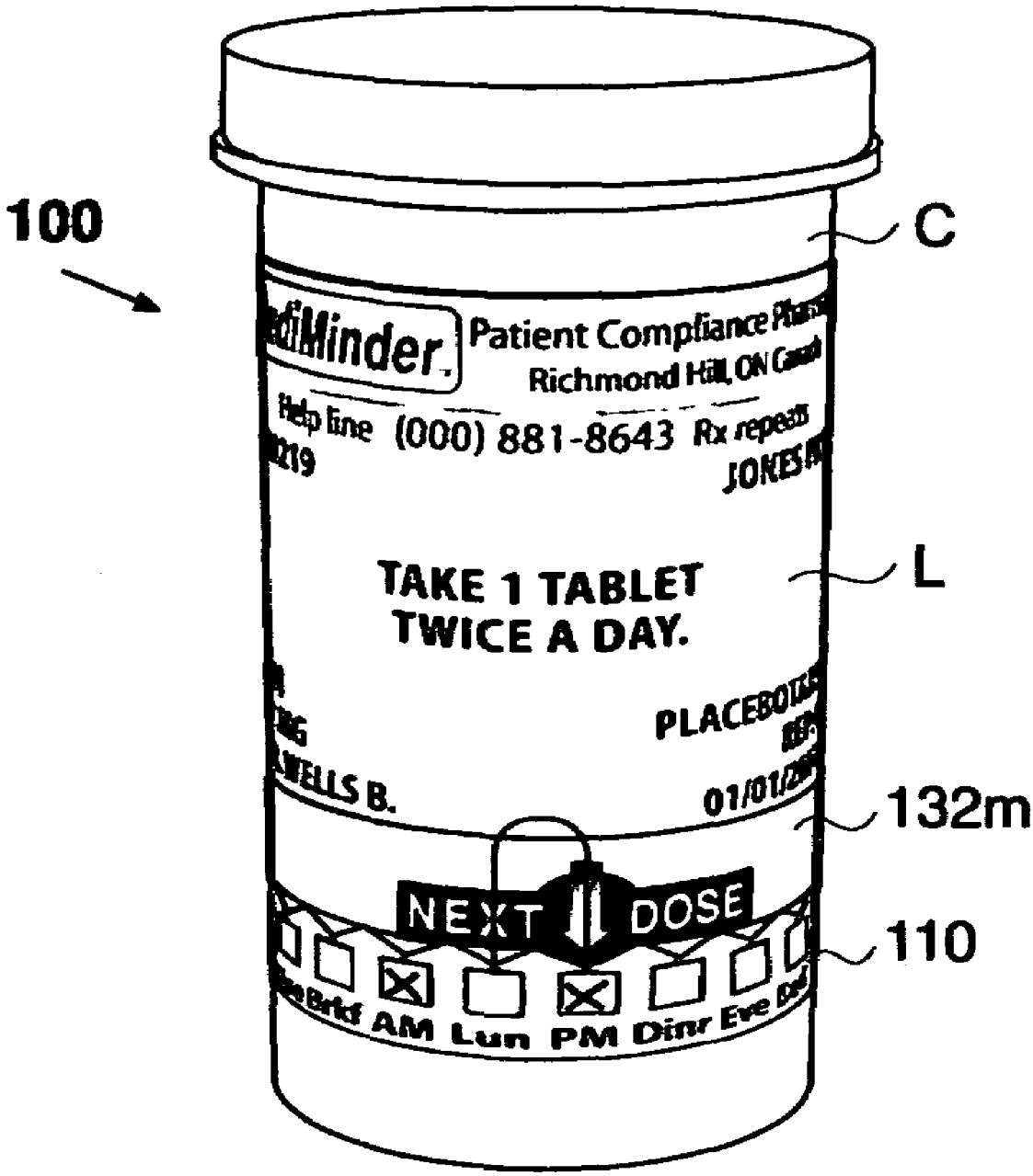
FIG. 1 is a perspective view of a first preferred embodiment 100 of my invention. In this example, the dosage reminder device is assembled on a typical medication container (vial) bearing a traditional pharmacy prescription label. The medication container as depicted is not part of the invention.
Figure 42:
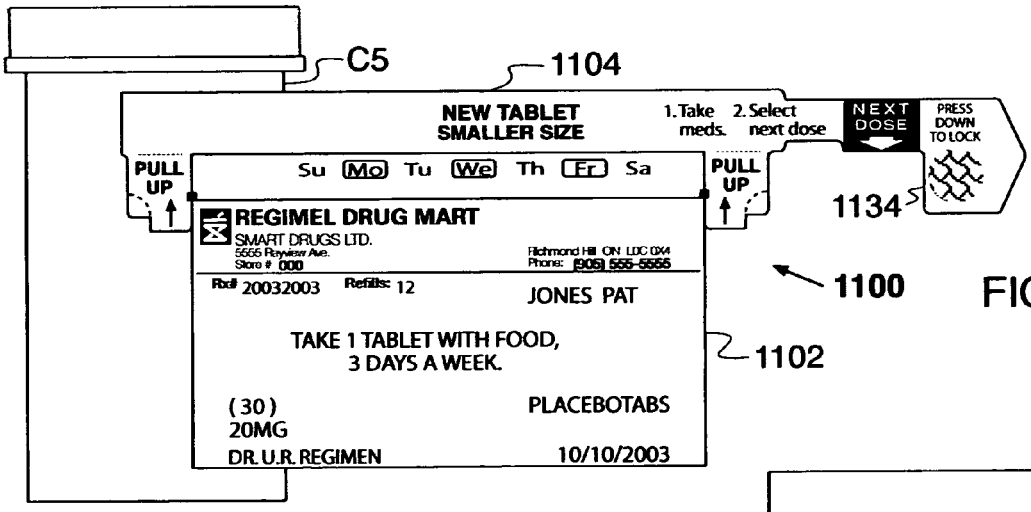
FIG. 42 is a planar view of the front of the device of FIG. 41 as it usually appears prior to mounting. The illustration also depicts a pharmaceutical container showing the starting position for the device being mounted on the container.
Figure 43:
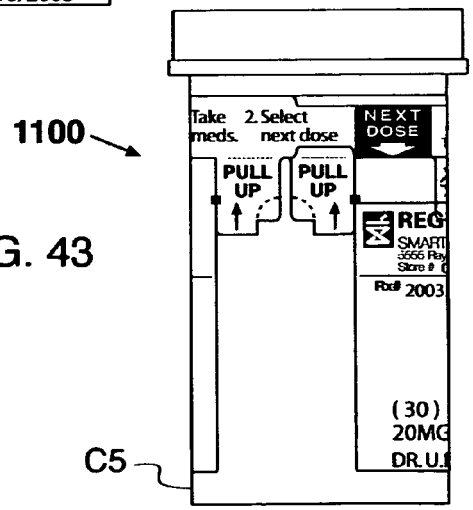
FIG. 43 is a planar view of the front of the device and the container of FIG. 42 showing the device after being completely mounted on the container.

| | | |
|---|---|---|
| C | Container (vial) | (FIGS. 1, 9, 10) |
| C1 | Container (vial) | (FIGS. 16, 19) |
| C2 | Container (vial) | (FIG. 21) |
| C3 | Container (vial) | (FIGS. 24, 25) |
| C4 | Container | (FIGS. 34, 35, 36, 37) |
| C5 | Container | (FIGS. 42, 43) |
| C6 | Container | (FIGS. 49, 53) |
| C7 | Container | (FIG. 50) |
| C8 | Container | (FIG. 51) |
| C9 | Container | (FIGS. 66, 67) |
| C10 | Container | (FIG. 68) |
| C11 | Container | (FIGS. 85, 87, 88. 89, 91) |
| L | Prescription Label | (FIGS. 1, 9, 10) |
| L1 | Length | (FIG. 54) |
| L2 | Length | (FIG. 56) |
| L3 | Length | (FIG. 56) |
| L4 | Length | (FIG. 56) |
| L5 | Length | (FIGS. 133, 145) |
| L6 | Length | (FIGS. 133, 145) |
| L7 | Length | (FIG. 135) |
| L8 | Length | (FIG. 135) |
| L9 | Length | (FIG. 135) |
| L10 | Length | (FIG. 148) |
| L11 | Length | (FIG. 148) |

-continued

Figure 2:
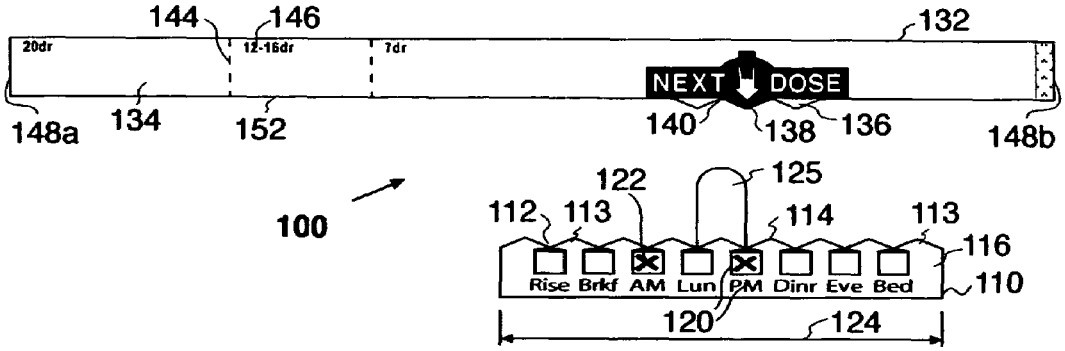
FIG. 2 is a planar view of the front of the device of FIG. 1 as it appears prior to preparation for mounting, fitting and assembly on a medication container.
Figure 3:
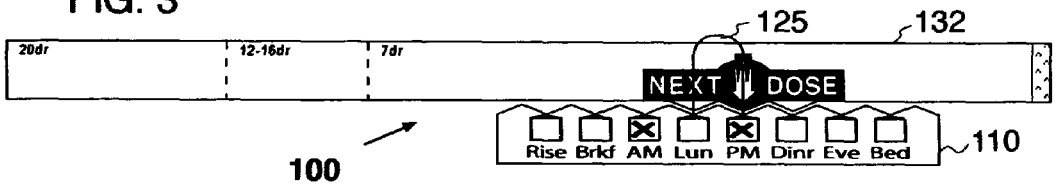
FIG. 3 is another planar view of the front of the device of FIG. 1 as it appears prior to preparation for mounting, fitting and assembly on a medication container. A band and a band support in the device are shown in close proximity to each other.
Figure 4:
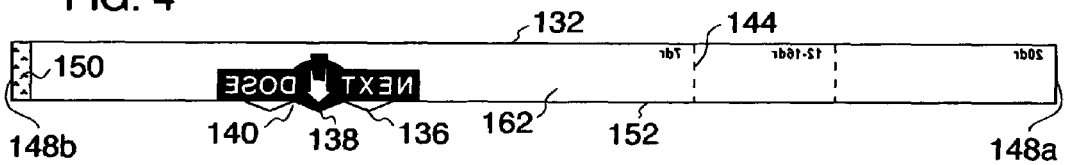
FIG. 4 is a planar view of the back of the band of FIG. 1.
Figure 5:
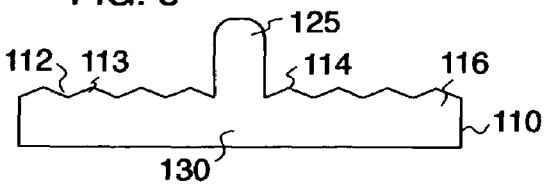
FIG. 5 is a planar view of the front of the band support of FIG. 1 without indicia.
Figure 6:
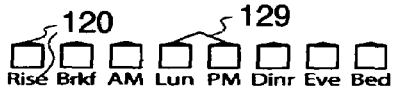
FIG. 6 shows the indicia to be printed on the front of the band support of FIG. 5.

| | | |
|---|---|---|
| L12 | Length | (FIG. 148) |
| W | Length | (FIGS. 52, 53) |
| W1 | Length | (FIG. 56) |
| W2 | Length | (FIG. 145) |
| W3 | Length | (FIG. 148) |
| 100 | Reminder Device | (FIGS. 1, 2, 3, 9, 10) |
| 110 | Band Support | (FIGS. 1, 2, 3, 5, 7, 9, 10) |
| 112 | Band Support Notches | (FIGS. 2, 5) |
| 113 | Band Support Teeth | (FIGS. 2, 5) |
| 114 | Band Support Upper Perimeter | (FIGS. 2, 5) |
| 116 | Band Support Front Surface | (FIGS. 2, 5) |
| 118 | Band Support Back Surface | (FIGS. 7, 9) |
| 120 | Scheduling Indicia | (FIGS. 2, 6) |
| 122 | Schedule Mark | (FIG. 2) |
| 124 | Band Support Length | (FIG. 2) |
| 125 | Extension Member | (FIGS. 2, 3, 5, 7, 9, 10) |
| 126 | Pressure-sensitive Adhesive | (FIGS. 7, 9, 10) |
| 128 | Longitudinal Axis | (FIG. 10) |
| 129 | Graphic Teeth (and Notches) | (FIG. 6) |
| 130 | Middle portion | (FIGS. 5, 7, 9, 10) |
| 132 | Band | (FIGS. 2, 3, 4, 8) |
| 132m | Mounted Continuous Band (132) | (FIGS. 1, 9, 10) |
| 134 | Band Front Surface | (FIGS. 2, 8) |
| 136 | Teeth | (FIGS. 2, 4) |
| 138 | Next-Dose Pointer | (FIGS. 2, 4) |
| 140 | Band Notches | (FIGS. 2, 4) |
| 144 | Structural Perforation | (FIGS. 2, 4) |
| 146 | Container Size Mark | (FIG. 2) |
| 148a | Band End a | (FIGS. 2, 4, 8) |
| 148b | Band End b | (FIGS. 2, 4, 8) |
| 150 | Repositionable Adhesive | (FIGS. 4, 8) |
| 152 | Band Lower Perimeter | (FIGS. 2, 4) |
| 162 | Band Back Surface | (FIGS. 4, 8) |
| 200 | Reminder Device | (FIGS. 11, 12) |
| 210 | Band Support | (FIGS. 11, 12, 13, 15) |
| 216 | Front Surface | (FIGS. 11, 13) |
| 218 | Back Surface | (FIG. 15) |
| 220 | Scheduling Indicia | (FIG. 14) |
| 225 | Band Support Extension | (FIGS. 11, 12, 13, 15) |
| 226 | Pressure-sensitive Adhesive | (FIG. 15) |
| 228 | Hinge | (FIGS. 13, 15) |
| 230 | Middle Portion | (FIGS. 13, 15) |
| 232 | Band | (FIGS. 11, 12) |
| 234 | Repositionable Adhesive | (FIG. 15) |
| 300 | Reminder Device | (FIG. 16) |
| 302 | Container Wall | (FIG. 19) |
| 310 | Band Support | (FIGS. 16, 17, 19, 21, 24) |
| 310a | Band Support | (FIG. 20) |
| 312 | Scheduling Indicia | (FIGS. 16, 21) |
| 316 | Back Surface | (FIGS. 17, 19) |
| 316a | Back Surface | (FIG. 20) |
| 325 | Extension | (FIGS. 16, 18) |
| 326 | Pressure-sensitive Adhesive | (FIGS. 17, 19) |
| 326a | Pressure-sensitive Adhesive | (FIG. 20) |
| 328 | Crease Hinge | (FIG. 18) |
| 330 | Non-Adhesive Portion | (FIGS. 17, 19) |
| 330a | Non-Adhesive Portion | (FIG. 20) |
| 332 | Band | (FIG. 18) |
| 332m | Mounted Band (332) | (FIG. 16) |
| 350 | Repositionable Adhesive | (FIG. 18) |
| 354 | Repositionable Adhesive | (FIG. 18) |
| 362 | Back Surface | (FIG. 18) |
| 400 | Reminder Device | (FIG. 21) |
| 425 | Extension | (FIGS. 21, 22) |
| 428 | Structural Perforation | (FIG. 22) |
| 432 | Band | (FIG. 22) |
| 432m | Mounted Continuous Band (432) | (FIG. 21) |
| 450 | Repositionable Adhesive | (FIG. 22) |
| 454 | Repositionable Adhesive | (FIG. 21) |
| 462 | Back Surface | (FIG. 22) |
| 500 | Reminder Device | (FIG. 24) |
| 502 | Raised Rim Member | (FIGS. 24, 25) |
| 504 | Teeth | (FIG. 23) |
| 506 | Notches | (FIG. 23) |
| 525 | Extension | (FIGS. 23, 24, 25) |
| 532 | Band | (FIG. 23) |

-continued

Figure 41:
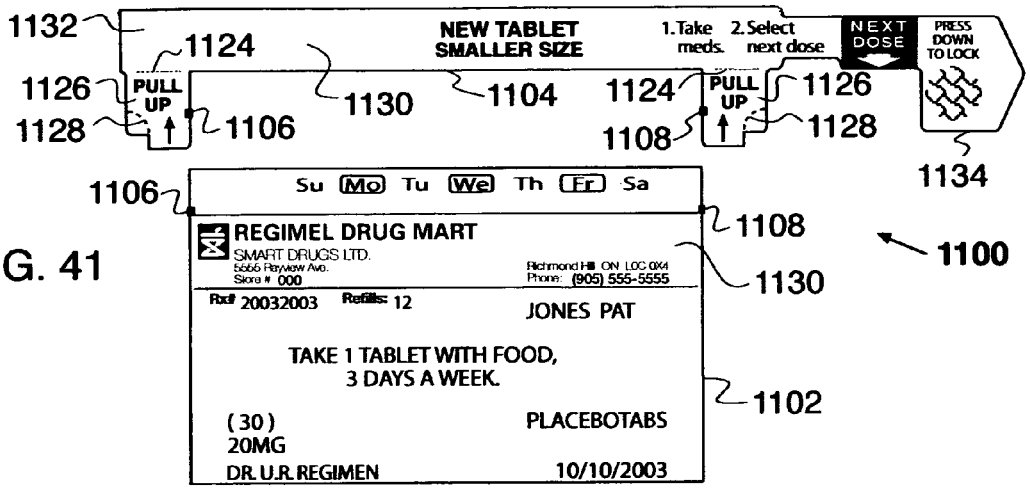
FIG. 41 is a planar view of the front of embodiment 1100 of my invention. In this example, a selectable support member is a pharmacy prescription label and a selector member is a movable label. The pharmacy may employ a printer to custom print one or both of the labels in the device. The labels have been separated in the illustration for clarity.

| | | |
|---|---|---|
| 532m | Mounted Continuous Band (532) | (FIG. 24, 25) |
| 550 | Repositionable Adhesive | (FIG. 23) |
| 562 | Back Surface | (FIG. 23) |
| 602 | Elastic Band | (FIG. 26) |
| 604 | Non-expandable Member | (FIG. 26) |
| 606 | Expandable Member | (FIG. 26) |
| 608 | Front | (FIG. 26) |
| 610 | Indicia | (FIG. 26) |
| 612 | Back | (FIG. 26) |
| 614 | Permanent Adhesive | (FIG. 26) |
| 616 | Front | (FIG. 26) |
| 618 | Repositionable Adhesive | (FIG. 26) |
| 702 | Elastic Band | (FIG. 27) |
| 704 | Non-expandable Member | (FIG. 27) |
| 706 | Expandable Member | (FIG. 27) |
| 708 | Adhesive Tape | (FIG. 27) |
| 710 | Repositionable Adhesive | (FIG. 27) |
| 802 | Elastic Band | (FIG. 28) |
| 804 | Back | (FIG. 28) |
| 806 | Adhesive | (FIG. 28) |
| 900 | Reminder Device | (FIGS. 29, 30, 31, 32, 33, 34, 35, 36, 37) |
| 902 | Band | (FIGS. 29, 30, 31, 32, 33) |
| 904 | Band Support | (FIGS. 29, 30, 31, 32, 33) |
| 905 | First End | (FIGS. 29, 32, 33, 34, 35) |
| 906 | Release Liner | (FIG. 30) |
| 907 | Second End | (FIGS. 29, 32, 33, 34, 35) |
| 908 | Hinge | (FIGS. 29, 31) |
| 910 | Indicator Tab | (FIGS. 29, 31) |
| 912 | Pull Tab | (FIGS. 29, 31) |
| 914 | Raised Dot | (FIG. 29) |
| 916 | Band Support Schedule | (FIG. 29) |
| 917 | Indicia | (FIG. 29) |
| 918 | Band Front | (FIGS. 29, 32) |
| 920 | Band Support Front | (FIGS. 29, 32) |
| 921 | Legs | (FIG. 31) |
| 922 | Release Coating | (FIG. 32) |
| 924 | Pressure-Sensitive Adhesive | (FIG. 33) |
| 925 | Band Support Back | (FIG. 33) |
| 926 | Pressure-Sensitive Adhesive | (FIGS. 33, 35) |
| 927 | Band Back | (FIG. 33) |
| 930 | Colored Indicator Tab | (FIG. 29) |
| 1000 | Reminder Device | (FIGS. 38, 39, 40) |
| 1002 | Content Label | (FIGS. 38, 39, 40) |
| 1004 | Selectable Member | (FIGS. 38, 39, 40) |
| 1006 | Selector Member | (FIGS. 38, 39, 40) |
| 1008 | Indicia | (FIG. 38) |
| 1010 | Indicia | (FIG. 38) |
| 1012 | Indicia | (FIG. 38) |
| 1014 | Hinge | (FIG. 38) |
| 1016 | Tab | (FIG. 38) |
| 1017 | Tab | (FIG. 38) |
| 1018 | Side End | (FIG. 38) |
| 1020 | Side End | (FIG. 38) |
| 1022 | Juncture Point | (FIG. 38) |
| 1023 | Side End | (FIG. 38) |
| 1024 | Juncture Point | (FIG. 38) |
| 1025 | Side End | (FIG. 38) |
| 1026 | Juncture Point | (FIG. 38) |
| 1028 | Juncture Point | (FIG. 38) |
| 1030 | Structural Perforation | (FIG. 38) |
| 1032 | Security Tabs | (FIG. 38) |
| 1034 | Front Surface | (FIG. 39) |
| 1036 | Release Coating | (FIG. 39) |
| 1038 | Back | (FIG. 40) |
| 1040 | Pressure-Sensitive Adhesive | (FIG. 40) |
| 1100 | Label Reminder Device | (FIGS. 41, 42, 43, 44, 45, 47) |
| 1102 | Selectable Label Member | (FIGS. 41, 42, 44, 45, 47) |
| 1104 | Selector Label Member | (FIGS. 41, 42, 44, 45, 47) |
| 1106 | Attachment Point | (FIG. 41) |
| 1108 | Attachment Point | (FIG. 41) |
| 1110 | Label Sheet | (FIGS. 44, 45, 46) |

-continued

Figure 58:
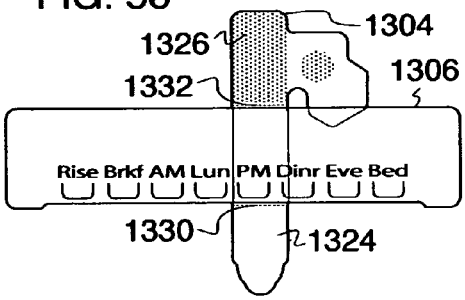
FIG. 58 is a planar view of the rear of the selector member and the front of the selectable member of the device of FIG. 49 showing continued assembly from that of FIG. 57.
Figure 59:
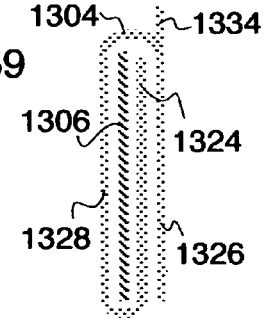
FIG. 59 is an enlarged cross-sectional side view of the assembled device of FIG. 60.
Figure 60:
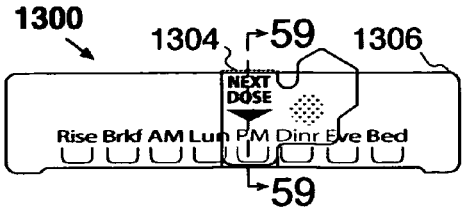
FIG. 60 is a planar view of the front of the assembled device members of FIG. 57.

| | | |
|---|---|---|
| 1112 | Indicia | (FIG. 44) |
| 1114 | Indicia | (FIG. 45) |
| 1116 | Indicia | (FIG. 45) |
| 1118 | Indicia | (FIG. 45) |
| 1120 | Release Liner | (FIG. 46) |
| 1122 | Adhesive | (FIG. 47) |
| 1124 | Hinge | (FIGS. 41, 47) |
| 1126 | Pull Tab | (FIGS. 41, 47) |
| 1128 | Perforations | (FIG. 41) |
| 1130 | Release Coated | (FIG. 41) |
| 1132 | Non-Release Portion | (FIG. 41) |
| 1134 | Security Tab Extension | (FIGS. 41, 42) |
| 1200 | Reminder Devices | (FIG. 48) |
| 1202 | Continuous Strip | (FIG. 48) |
| 1300 | Reminder Device | (FIGS. 49, 50, 51, 60) |
| 1302 | Pharmacy Label | (FIG. 49) |
| 1303 | Pharmacy Label | (FIG. 50) |
| 1304 | Movable Selector | (FIGS. 49, 50, 51, 56, 57, 58, 59, 60) |
| 1306 | Selectable Member | (FIGS. 49, 30, 50, 51, 52, 53, 54, 55, 57, 58, 59, 60) |
| 1308 | Schedule | (FIG. 49) |
| 1310 | End Portion (L) | (FIGS. 49, 52, 55) |
| 1312 | End Portion (R) | (FIGS. 49, 52, 55) |
| 1314 | Middle Portion | (FIGS. 52, 55) |
| 1316 | Release Material | (FIG. 52) |
| 1318 | Standoff Bumps | (FIGS. 53, 54) |
| 1320 | Scores | (FIGS. 52, 53) |
| 1322 | Adhesive | (FIG. 55) |
| 1324 | Fist End Portion | (FIGS. 56, 57, 58, 59) |
| 1326 | Second End Portion | (FIGS. 56, 57, 58, 59) |
| 1328 | Middle Portion | (FIGS. 56, 59) |
| 1330 | First Demarcation | (FIGS. 56, 57, 58) |
| 1332 | Second Demarcation | (FIGS. 56, 57, 58) |
| 1334 | Security Tab Extension | (FIGS. 56, 57, 59) |
| 1336 | Indicia | (FIG. 56) |
| 1338 | Indicia | (FIG. 56) |
| 1340 | Adhesive | (FIG. 57) |
| 1400 | Reminder Device | (FIGS. 61, 62) |
| 1402 | Selectable Member | (FIG. 61) |
| 1404 | Selectable Member | (FIG. 61) |
| 1406 | Selector Member | (FIG. 61) |
| 1408 | Surrounding Sheet | (FIG. 61) |
| 1410 | Liner | (FIG. 62) |
| 1412 | Indicia | (FIG. 61) |
| 1414 | Indicia | (FIG. 62) |
| 1500 | Reminder Device | (FIGS. 63, 64, 65, 67) |
| 1502 | Selector Member | (FIGS. 63, 67) |
| 1504 | Selectable Member | (FIGS. 63, 67) |
| 1506 | Structural Perforation | (FIGS. 63, 67) |
| 1508 | Label | (FIGS. 66, 67) |
| 1510 | Release Coating | (FIG. 66) |
| 1512 | Non-Release Area | (FIG. 66) |
| 1600 | Reminder Devices | (FIGS. 64, 65) |
| 1602 | Strip | (FIGS. 64, 65) |
| 1604 | Label Sheet | (FIG. 64) |
| 1606 | Liner Sheet | (FIG. 65) |
| 1700 | Reminder Devices | (FIGS. 68, 75) |
| 1702 | Selectable Label Member | (FIGS. 68, 69, 70, 73, 75, 76, 77, 79) |
| 1704 | Selector Label Member | (FIGS. 68, 74, 75, 81, 82, 84) |
| 1706 | Support Rail Label Member | (FIGS. 68, 71, 72, 73, 75, 81, 82, 84) |
| 1708 | Release Coating | (FIG. 72) |
| 1710 | Indicia | (FIGS. 69, 76) |
| 1712 | Indicia | (FIGS. 70, 77) |
| 1714 | Indicia | (FIGS. 74, 81) |
| 1716 | Label Sheet | (FIGS. 76, 77, 78) |
| 1718 | Release Liner | (FIG. 78) |
| 1720 | Adhesive | (FIG. 79) |
| 1750 | Reminders | (FIG. 80) |
| 1752 | Strip | (FIG. 80) |
| 1760 | Label Sheet | (FIGS. 81, 82, 83) |
| 1762 | Release Liner | (FIG. 83) |
| 1764 | Adhesive | (FIG. 84) |
| 1800 | Reminder Device | (FIGS. 85, 86, 88) |
| 1802 | Label Sheet | (FIGS. 85, 86, 87, 88) |

-continued

| | | |
|---|---|---|
| 1804 | Side Wall | (FIGS. 85, 87, 88, 89, 91, 93, 94) |
| 1806 | Cap | (FIGS. 85, 87, 88, 89, 91) |
| 1808 | Recess | (FIGS. 85, 87, 88, 89, 91) |
| 1810 | Lower Portion | (FIGS. 85, 87, 88) |
| 1811 | Rail Member | (FIGS. 87, 88) |
| 1812 | Release Material | (FIG. 85) |
| 1814 | Middle Portion | (FIGS. 85, 87, 88) |
| 1816 | Schedule | (FIG. 85) |
| 1818 | Upper Portion | (FIGS. 85, 87, 88) |
| 1820 | Selector | (FIGS. 85, 86, 88) |
| 1822 | Structural Perforation | (FIG. 85) |
| 1824 | Structural Horizontal Perforation | (FIGS. 85, 87) |
| 1826 | Tear Strip | (FIGS. 85, 86) |
| 1828 | Perforation | (FIGS. 85, 86) |
| 1830 | Release Liner | (FIGS. 85, 86) |
| 1832 | Indicia | (FIG. 85) |
| 1834 | Permanent Adhesive | (FIG. 86) |
| 1900 | Reminder Device | (FIGS. 89, 90, 93, 94) |
| 1902 | Label Sheet | (FIGS. 89, 90, 91) |
| 1904 | Lower Rail Portion | (FIGS. 89, 91) |
| 1906 | Release Material | (FIG. 89) |
| 1908 | Middle Portion | (FIGS. 89, 91) |
| 1910 | Upper Portion | (FIGS. 89, 91) |
| 1912 | Selector | (FIGS. 89, 90, 92, 93, 94) |
| 1914 | Structural Perforation | (FIG. 89) |
| 1916 | Left Flap | (FIGS. 89, 92, 93) |
| 1918 | Right Flap | (FIGS. 89, 92, 93) |
| 1920 | Middle Indicator Portion | (FIG. 89) |
| 1922 | Indicia | (FIG. 89) |
| 1924 | Indicator Tab | (FIGS. 89, 93) |
| 1926 | Structural Perforation | (FIGS. 89, 91) |
| 1928 | Tear Strip | (FIGS. 89, 90) |
| 1930 | Perforated Perimeter | (FIGS. 89, 90, 91) |
| 1932 | Upper Rail | (FIGS. 89, 90, 91, 93) |
| 1934 | Lower Rail | (FIGS. 89, 90, 91, 93) |
| 1936 | Projection | (FIGS. 89, 90, 91, 93, 94) |
| 1938 | Schedule Indicia | (FIG. 89) |
| 1940 | Release Liner | (FIGS. 89, 90) |
| 1942 | Adhesive | (FIGS. 90, 92) |
| 1944 | Unadhered Rail Portion | (FIGS. 91, 93, 94) |
| 2000 | Reminder Device | (FIGS. 100, 101, 102) |
| 2002 | Selector Label | (FIGS. 95, 96, 97) |
| 2004 | Liner | (FIGS. 95, 100) |
| 2006 | Left Side Flap | (FIGS. 95, 96, 97, 103, 104, 105) |
| 2008 | Right Side Flap | (FIGS. 95, 96, 97, 103, 104, 105) |
| 2010 | Middle Portion | (FIGS. 95, 103) |
| 2012 | Tab | (FIGS. 95, 103, 104) |
| 2014 | Indicia | (FIG. 95) |
| 2016 | Adherable Portion | (FIGS. 95, 102, 103, 110) |
| 2018 | Structural Perforations | (FIGS. 95, 103) |
| 2020 | Score Line | (FIGS. 95, 103) |
| 2022 | Release Material | (FIGS. 96, 104) |
| 2024 | Adhesive | (FIGS. 97, 105) |
| 2026 | Rail Label Member | (FIGS. 98, 99) |
| 2028 | Liner | (FIGS. 98, 106) |
| 2029 | Indicia | (FIG. 98) |
| 2030 | Tear Strip | (FIG. 98) |
| 2032 | Indicia | (FIG. 98) |
| 2034 | Structural Perforation | (FIG. 98) |
| 2036 | Structural Perforation | (FIGS. 98, 101, 106, 109) |
| 2038 | Releasable Portion | (FIGS. 98, 106) |
| 2040 | Release Material | (FIGS. 98, 106) |
| 2042 | Adhesive | (FIGS. 99, 107) |
| 2044 | Adhesive | (FIGS. 99, 107) |
| 2046 | Adhesive | (FIGS. 99, 107) |
| 2048 | Laminated Label | (FIGS. 100, 101) |
| 2050 | Carton | (FIGS. 101, 102, 109, 110) |
| 2052 | Rail Portion | (FIGS. 101, 102) |

-continued

| | | |
|---|---|---|
| 2054 | Laminated Selector | (FIG. 101) |
| 2056 | Right Side Flap | (FIGS. 101, 102) |
| 2058 | Left Side Flap | (FIGS. 101, 102) |
| 2100 | Reminder Device | (FIGS. 108, 109, 110) |
| 2102 | Selector Member | (FIGS. 103, 104, 105) |
| 2104 | Middle Portion | (FIGS. 104, 108) |
| 2106 | Rail Member | (FIGS. 106, 107) |
| 2108 | Schedule Indicia | (FIG. 106) |
| 2110 | Tear Strip | (FIG. 106) |
| 2112 | Indicia | (FIG. 106) |
| 2114 | Structural Perforations | (FIG. 106) |
| 2116 | Tear Strip | (FIGS. 103, 106, 107) |
| 2118 | Indicia | (FIGS. 103, 106) |
| 2120 | Structural Perforations | (FIG. 106) |
| 2122 | Adherable Portion With Indicia | (FIG. 106) |
| 2124 | Structural Perforation | (FIGS. 106, 107) |
| 2126 | Adhesive Material | (FIG. 107) |
| 2128 | Laminated Label Member | (FIGS. 108, 109) |
| 2130 | Rail Portion | (FIGS. 109, 110) |
| 2132 | Laminated Selector | (FIG. 109) |
| 2134 | Right Side Flap | (FIGS. 109, 110) |
| 2136 | Left Side Flap | (FIGS. 109, 110) |
| 2200 | Reminder Device | (FIG. 116) |
| 2202 | Selector Pivot Member | (FIGS. 111, 112, 113, 116) |
| 2204 | Left Vertical Portion | (FIGS. 111, 113) |
| 2206 | Right Vertical Portion | (FIGS. 111, 113) |
| 2208 | Vertical Base Portion | (FIG. 111) |
| 2210 | Horizontal Pointer Portion | (FIGS. 111, 116) |
| 2212 | Score Line | (FIGS. 111, 112) |
| 2214 | Score Line | (FIGS. 111, 112) |
| 2216 | Score Line | (FIGS. 111, 112) |
| 2218 | Score Line | (FIGS. 111, 112) |
| 2230 | Forward Portion | (FIGS. 111, 113) |
| 2232 | Middle Portion | (FIGS. 111, 113) |
| 2234 | Tail Portion | (FIGS. 111, 113) |
| 2236 | Score Line | (FIGS. 111, 112) |
| 2238 | Die Cut | (FIG. 111) |
| 2239 | Die Cut | (FIG. 111) |
| 2240 | Embossed Portion | (FIG. 111) |
| 2242 | Embossed Portion | (FIG. 111) |
| 2244 | Indicia | (FIG. 111) |
| 2246 | Indicia | (FIG. 111) |
| 2248 | Film Lamination | (FIG. 111) |
| 2250 | Adhesive | (FIG. 112) |
| 2252 | Selectable Member | (FIGS. 114, 115, 116) |
| 2254 | Aperture | (FIGS. 114, 115) |
| 2255 | Aperture Perimeter | (FIG. 114) |
| 2256 | Tab | (FIGS. 114, 115) |
| 2258 | Score Line | (FIGS. 114, 115) |
| 2260 | Schedule Indicia | (FIG. 114) |
| 2262 | Indicia | (FIG. 114) |
| 2264 | Film Lamination | (FIG. 114) |
| 2268 | Adhesive | (FIG. 115) |
| 2270 | Carton Container | (FIG. 117) |
| 2280 | Selectable Member | (FIG. 116A) |
| 2282 | Aperture | (FIG. 116A) |
| 2284 | Aperture Perimeter | (FIG. 116A) |
| 2286 | Path End | (FIG. 116A) |
| 2300 | Reminder Device Package | (FIGS. 118, 119, 122, 123, 124, 125) |
| 2302 | Carton Container | (FIGS. 118, 119, 122, 123) |
| 2304 | Front Wall | (FIGS. 118, 119, 122, 123, 124, 125) |
| 2306 | Structural Perforations | (FIG. 118) |
| 2308 | Pivot Area | (FIG. 118) |
| 2310 | Indicia | (FIG. 118) |
| 2312 | Indicia | (FIGS. 118, 122) |
| 2314 | Structural Perforations | (FIG. 118) |
| 2316 | Lock Area | (FIGS. 118, 119, 124, 125) |
| 2318 | Hinge | (FIGS. 118, 119, 124, 125) |
| 2319 | End Flap | (FIG. 118) |
| 2320 | Aperture Pivot Area | (FIGS. 119, 125) |

-continued

| | | |
|---|---|---|
| 2322 | Selector | (FIGS. 120, 121, 122, 123, 124, 125) |
| 2324 | Aperture | (FIGS. 120, 121) |
| 2326 | Indicia | (FIG. 120) |
| 2328 | Side Flap | (FIGS. 120, 121, 125) |
| 2330 | Score Hinge | (FIG. 120) |
| 2332 | Forward Portion | (FIGS. 120, 121, 124, 125) |
| 2334 | Score Hinge | (FIGS. 120, 121, 124, 125) |
| 2336 | Tab Extension | (FIGS. 120, 121, 122, 124, 125) |
| 2400 | Reminder Device Package | (FIGS. 126, 127, 132) |
| 2402 | Carton Container | (FIGS. 126, 127, 132) |
| 2404 | Front Wall | (FIGS. 126, 127, 132) |
| 2406 | Aperture | (FIG. 127) |
| 2408 | Indicia | (FIG. 126) |
| 2410 | Release Material | (FIGS. 126, 132) |
| 2412 | End Flap | (FIG. 126) |
| 2414 | Tamper Label | (FIGS. 126, 128, 129) |
| 2416 | Selector | (FIGS. 130, 131, 132) |
| 2418 | Indicia | (FIGS. 126, 128) |
| 2420 | Adhesive | (FIG. 129) |
| 2422 | Hinge | (FIG. 130) |
| 2424 | Forward Portion | (FIG. 130) |
| 2426 | Indicia | (FIG. 130) |
| 2428 | Score Hinge | (FIG. 130) |
| 2430 | Side Flap | (FIG. 130) |
| 2432 | Adhesive | (FIG. 131) |
| 2500 | Reminder Device | (FIGS. 139, 140) |
| 2502 | Support Rail | (FIGS. 133, 134, 136, 137, 138, 139, 140, 142, 143, 144, 177, 178, 179, 180, 181, 182, 183, 184) |
| 2504 | Left End Portion | (FIGS. 133, 134, 142) |
| 2506 | Right End Portion | (FIGS. 133, 134, 142) |
| 2508 | Middle Portion | (FIG. 133) |
| 2510 | Schedule Indicia | (FIG. 133) |
| 2512 | Release Material Portion | (FIG. 133) |
| 2514 | Front Surface | (FIGS. 133, 142, 143, 144) |
| 2516 | Rear Surface | (FIG. 134) |
| 2518 | Adhesive Material | (FIG. 134) |
| 2520 | Movable Selector | (FIGS. 135, 136, 137, 138, 139) |
| 2522 | First End Portion | (FIGS. 135, 138, 140) |
| 2523 | Indicia | (FIG. 135) |
| 2524 | Second End Portion | (FIGS. 135, 137, 138, 140) |
| 2525 | Front Surface | (FIG. 135) |
| 2526 | Middle Portion | (FIGS. 135, 140) |
| 2528 | Demarcation Line | (FIGS. 135, 137) |
| 2530 | Demarcation Line | (FIGS. 135, 137) |
| 2532 | Die Cut Line | (FIG. 135) |
| 2534 | Tab Extension | (FIGS. 135, 136, 138, 140) |
| 2536 | Perforation | (FIG. 135) |
| 2538 | Aperture | (FIG. 135) |
| 2540 | Rear Surface | (FIG. 136) |
| 2542 | Adhesive Pattern | (FIG. 136) |
| 2544 | Adhesive Pattern | (FIG. 136) |
| 2600 | Reminder Device | (FIG. 144) |
| 2602 | Movable Selector | (FIGS. 141, 142, 143, 144) |
| 2604 | Rear Surface | (FIG. 141) |
| 2606 | Adhesive Pattern | (FIG. 141) |
| 2608 | Tab | (FIGS. 141, 142, 143, 144) |
| 2610 | First End Portion | (FIGS. 141, 142) |
| 2612 | Adhesive Pattern | (FIG. 141) |
| 2614 | Second End Portion | (FIGS. 141, 142, 143, 144) |
| 2616 | Aperture | (FIGS. 141, 142, 143) |
| 2700 | Reminder Device | (FIGS. 151, 152) |
| 2702 | Rail Member | (FIGS. 145, 146, 147, 149, 150, 151, 152, 155, 156, 157, 158) |
| 2704 | Left End Portion | (FIGS. 145, 146) |

-continued

| | | |
|---|---|---|
| 2706 | Right End Portion | (FIGS. 145, 146) |
| 2708 | Middle Portion | (FIG. 145) |
| 2710 | Indicia | (FIG. 145) |
| 2712 | Raised Member Détente | (FIGS. 145, 147, 152, 155, 157) |
| 2714 | Front Surface | (FIGS. 145, 147, 150, 151, 156, 158) |
| 2716 | Rear Surface | (FIG. 146) |
| 2718 | Adhesive Material | (FIG. 146) |
| 2720 | Movable Member | (FIGS. 148, 149, 150, 151, 152) |
| 2722 | First End Portion | (FIGS. 148, 150, 152) |
| 2724 | Second End Portion | (FIGS. 148, 149, 150, 152) |
| 2726 | Middle Portion | (FIGS. 148, 152) |
| 2728 | Horizontal Line | (FIGS. 148, 150) |
| 2730 | Horizontal Line | (FIGS. 148, 150) |
| 2732 | Aperture | (FIG. 148) |
| 2734 | Aperture | (FIG. 148) |
| 2736 | Indicia | (FIG. 148) |
| 2738 | Rear Surface | (FIG. 149) |
| 2740 | Adhesive Pattern | (FIG. 149) |
| 2800 | Reminder Device | (FIG. 158) |
| 2802 | Movable Member | (FIGS. 153, 154, 155, 156, 157. 158) |
| 2804 | Aperture | (FIG. 153) |
| 2806 | Aperture | (FIG. 153) |
| 2808 | Folding Line | (FIGS. 153, 155, 156) |
| 2810 | Folding Line | (FIGS. 153, 155) |
| 2812 | First End Portion | (FIGS. 153, 155, 156) |
| 2814 | Front Surface | (FIGS. 153, 155) |
| 2816 | Indicia | (FIGS. 153, 154) |
| 2818 | Raised Bar Deténte | (FIGS. 153, 154, 157) |
| 2820 | Second End Portion | (FIGS. 153, 154, 155) |
| 2822 | Rear Surface | (FIG. 154) |
| 2824 | Adhesive | (FIGS. 154, 156) |
| 2900 | Reminder Device | (FIGS. 159, 160) |
| 2902 | Adherable Rail | (FIGS. 159, 160) |
| 2904 | Protrusion | (FIGS. 159, 160) |
| 2906 | Upper Perimeter | (FIG. 159) |
| 2908 | Lower Perimeter | (FIG. 159) |
| 2910 | Schedule Position | (FIG. 159) |
| 2912 | Adherable End | (FIG. 159) |
| 2914 | Adherable End | (FIG. 159) |
| 2916 | Selector | (FIGS. 159, 160) |
| 2920 | Rail | (FIGS. 161, 162) |
| 2922 | Structural Perforation | (FIGS. 161, 162) |
| 2924 | End | (FIGS. 161, 162) |
| 2926 | Adhesive Material | (FIG. 161) |
| 2928 | Rear Surface | (FIG. 161) |
| 2930 | Container Cap | (FIG. 162) |
| 3000 | Reminder Device | (FIG. 166) |
| 3002 | Front Surface | (FIG. 163) |
| 3003 | Movable Member | (FIGS. 163, 164, 166) |
| 3004 | Hinge | (FIG. 163) |
| 3006 | Side Flap | (FIG. 163) |
| 3008 | Tab | (FIG. 163) |
| 3010 | Rear Surface | (FIG. 164) |
| 3012 | Adhesive Material | (FIG. 164) |
| 3014 | Rail Member | (FIGS. 165, 166) |
| 3016 | Aperture | (FIG. 165) |
| 3018 | Indicia | (FIG. 165) |
| 3020 | Front Surface | (FIG. 165) |
| 3100 | Reminder Device | (FIGS. 172, 173, 174) |
| 3102 | Front Surface | (FIGS. 167, 168) |
| 3104 | First Member | (FIGS. 167, 168, 169, 172) |
| 3106 | Liner | (FIGS. 167, 172) |
| 3108 | Releasable Portion | (FIGS. 167, 168, 169) |
| 3110 | Perforations | (FIG. 167) |
| 3112 | Tear Strip | (FIG. 167) |
| 3114 | Perforations | (FIG. 167) |
| 3116 | Adherable Portion | (FIGS. 167, 169) |
| 3118 | Perforations | (FIG. 167) |
| 3120 | Release Material | (FIG. 168) |
| 3122 | Rear Surface | (FIG. 169) |
| 3124 | Adhesive | (FIG. 169) |
| 3126 | Front Surface | (FIG. 170) |
| 3128 | Second Member | (FIGS. 170, 171) |

-continued

| | | |
|---|---|---|
| 3130 | Liner | (FIG. 170) |
| 3132 | Releasable Portion | (FIG. 170) |
| 3133 | Security Tab | (FIG. 170) |
| 3134 | Perforations | (FIG. 170) |
| 3136 | Tear Strip | (FIG. 170) |
| 3138 | Tear Strip | (FIG. 170) |
| 3140 | Perforations | (FIG. 170) |
| 3142 | Perforations | (FIG. 170) |
| 3144 | Indicia | (FIG. 170) |
| 3146 | Indicia | (FIG. 170) |
| 3148 | Indicia | (FIG. 170) |
| 3150 | Release Material | (FIG. 170) |
| 3152 | Rear Surface | (FIG. 171) |
| 3154 | Adhesive | (FIG. 171) |
| 3156 | Combined Member | (FIG. 172) |
| 3158 | Combined Releasable Member | (FIGS. 173, 174) |
| 3160 | Carton | (FIGS. 173, 174) |
| 3162 | Upper Rail Portion | (FIGS. 173, 174) |
| 3164 | Lower Rail Portion | (FIGS. 173, 174) |
| 3166 | Travel Channel | (FIGS. 173, 174) |
| 3200 | Reminder Device | (FIGS. 177, 178, 179, 180, 181, 182, 183, 184) |
| 3202 | Movable Selector | (FIGS. 175, 177, 178, 180, 181, 182, 183, 184) |
| 3204 | Label Sheet | (FIGS. 175, 176, 177, 178, 179, 180, 181, 185) |
| 3206 | First Foldable End Portion | (FIG. 175) |
| 3208 | Side Tear Strip | (FIGS. 175, 178, 180) |
| 3210 | Base Portion | (FIG. 175) |
| 3212 | Second Foldable Portion | (FIG. 175) |
| 3214 | Securable End Portion | (FIGS. 175, 179, 180) |
| 3216 | Front Surface | (FIG. 175) |
| 3218 | Release Material Portion | (FIG. 175) |
| 3220 | Rear Surface | (FIG. 176) |
| 3222 | Adhesive | (FIGS. 176, 178) |
| 3224 | Release Liner | (FIGS. 178, 179, 180, 185) |
| 3226 | Container | (FIGS. 183, 184) |
| 3300 | Reminder Device | (FIGS. 186, 187) |
| 3302 | Movable Selector | (FIGS. 186, 187) |
| 3304 | Selectable Rail | (FIGS. 186, 187) |
| 3306 | Selectable Rail | (FIGS. 186, 187) |
| 3308 | Label Sheet | (FIGS. 186, 187) |
| 3310 | Release Material | (FIG. 186) |
| 3312 | Release Liner | (FIG. 187) |

DETAILED DESCRIPTION OF THE INVENTION

With reference now to FIGS. 1 through 10, a first preferred embodiment of the medication dosage reminder device is generally illustrated at 100.

Figure 7:
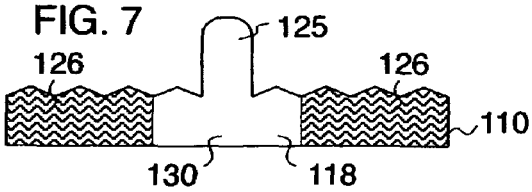
FIG. 7 is a planar view of the back of the band support of FIG. 1.

The reminder device is formed from two parts or members: a substantially rectilinear band 132 (FIG. 2) and a substantially rectilinear cooperating band support (110). The band and the band support are preferably manufactured from flexible sheet stock or roll stock such as paper, cardboard or plastic and may be punched, cut, or similarly manufactured. Material otherwise manufactured would also work in many applications. Preferably the material is of substantially uniform thickness. Material may be transparent, translucent, or opaque. More or less transparent, translucent or opaque material would also work in many applications. Device members could also be manufactured from more rigid material for many applications. Indicia may be produced by any suitable method. Any sheet or roll fed method may be used. While slower methods such as screen-printing may be suitable, the preferred method of printing is flexography because high processing speeds are attainable. As illustrated, the band support is a transparent prescription label having a plurality of abutted triangle-shaped notches (apertures) 112 (FIGS. 2, 5) having the band support upper perimeter 114 as their base. The band support notches are arranged in sets across length 124 (FIG. 2) of the band support producing teeth (extensions) 113. The notches are shaped to mate with or engage teeth (extensions) 136 on the band as described below. The sets of notches and teeth are separated by a middle portion 130 (FIGS. 5, 7) which includes a substantially rectilinear extension 125, the extension projecting vertically beyond the upper perimeter of the teeth 113. Printed on the front surface 116 of the band support are indicating scheduling indicia 120 consisting of times or time periods of the day and corresponding boxes that may be inscribed by a pharmacist or user. The notches 112 permanently reference the indicia so that a single notch is associated with a single time period of the day. A patient establishes his customized dosage schedule in accordance with customary traditional prescription label L (FIG. 1) instructions by marking or inscribing 122 the scheduling indicia by pen or marker or other suitable means. When the scheduling indicia are printed on the band support, a graphic representation 129 (FIG. 6) of any missing teeth (and notches) may be included at the appropriate position on the middle portion. As seen in FIG. 7, portions of the back surface 118 of the band support retain a coating of pressure-sensitive adhesive 126, the pressure-sensitive adhesive being preferably transparent or translucent. The pressure-sensitive adhesive serves to attach the band support to a suitable medication container C. That is, the band support may be adhered to the container or stated otherwise, the container may be adhered to the band support. The middle portion of the back of the band support including the extension member is not coated with adhesive and is therefore non-adhesive. Such pattern or zone coating of a surface with adhesive is well established in the art.

The band as illustrated, is transparent, and includes a plurality of extensions shown as abutted triangle-shaped teeth 136 (FIGS. 2, 4) having the band lower perimeter 12 as their base, the arrangement of teeth producing notches 140 between the teeth. One of the teeth serves as a next-dose pointer 138 and is so indicated. Indicia on the band characterized by a structural perforation 144 indicate where to trim (ex. cut with scissors) or snap off the length of the band in order to fit a particular size 146 of container. The band includes a suitable repositionable adhesive 150 which is preferably retained at one end 148*b* of the back surface 162. The repositionable adhesive is also preferably transparent or translucent. Repositionable adhesive is well known in the art and may be engineered specifically for task at hand, allowing for reversible adherence (i.e. adherence, unadherence and readherence) of elements. It should be noted that references to repositionable adhesive in the present disclosure is intended to include the equivalent of any suitable means known in the art to produce adhesive repositionability. Adhesive repositionability is dependent upon the substrate to which the adhesive is applied. For example, a particular pressure-sensitive adhesive may be permanently attached when coated onto a substrate and then cured. The same adhesive after curing may be repositionable when pressed onto the same or a different substrate. A prevalent example of a repositionable adhesive can be seen in some current flexible packaging applications that include an adhesively reclosable portion. The package (i.e. container) may be opened and adhesively reclosed multiple times during the course of content consumption.

The device is assembled on the surface of the medication container by attaching the band support and mounting the band around the medication container in separate steps, but linking the band to the band support by suitable means known in the art may combine some steps. The band support is attached to the wall surface of the container in a straight manner so that the entire lower perimeter of the band support rests at more or less the same height on the container. In general practice the band support is placed near the bottom of the container but it may be positioned elsewhere. It may be attached anywhere, either directly on the surface of the container or on top of an attached prescription label L, so long as sufficient space is left above the band support to permit both mounting and operational displacement of the band. In preparation for its mounting, the band length may be shortened, if necessary, as previously described, by the pharmacist or user at an indicated perforation 144 in order to properly fit the size of container being employed and to facilitate mounting and rotation. Preferably the band is first positioned between the band support extension and the mounting surface just above the band support. The band is then closely fitted around the container such that the adhesive end of the band 148*b* overlaps the non-adhesive end 148*a* Back surface 162 (FIG. 8) of overlapping end 148*b* of the band 132 is pressed onto front surface 134 of the other overlapped end 148*a* of the band. The ends are joined by repositionable adhesive 150 between the two surfaces, forming an endless or continuous loop or band 132*m* (132 mounted, FIG. 1) on the container. The use of repositionable adhesive permits multiple attempts to achieve an acceptable balance between closeness on the container wall and ease of rotation. It also allows for readjustment of fit after some time of use. Positioning of the band between the band support extension and the mounting surface may be accomplished by slightly deforming the band support extension away from the container with a fingernail or other suitable means while inserting the band behind the extension and then returning the extension to more or less its original position on the container. Alternatively, the band may be closely fitted around the container as previously described before attaching the band support. The band support may then be attached to the container as previously described such that the adhesive portions are located below the mounted band and the extension member covers at least a portion of the front of the band. Referring to the assembled device in FIG. 1 and the illustrations in FIGS. 9 and 10. The mounted continuous band 132*m* is axially displaceable above the band support, along longitudinal axis 128 (FIG. 10) of the medication container, over the outer surface of the container. It is also free to rotate about the container when teeth 136 extending from its lower perimeter 152 are not engaged with any band support notches 112 at the band support's upper perimeter. As best seen in FIGS. 9 and 10, the mounted continuous band is closely fitted around the medication container and the distance from the container side at which a portion of the band support is located is greater than the distance from the container side at which at least a portion of the band is located. Downward displacement of the mounted band along the longitudinal axis is therefore limited by contact with the protruding band support. The band support provides a great degree of leeway for band fit on cylindrical containers.

When a patient takes her medication she selects the time for the next dose by aligning the next-dose pointer on the mounted band with the inscribed next dosage time period on the band support. This is accomplished by sliding the mounted band upward along the longitudinal axis of the container to disengage it from the band support, rotating the band to align the pointer, and sliding the mounted band downward (between the band support extension member and the mounting surface) to re-engage the band support. The next-dose pointer and the inscribed time period indicia form a reminder indicating when the next dose is due or when the last dose was taken. The mounted band could of course be held stationary while a cooperating member (ex. the container along with the attached band support) is moved or rotated, relative to the schedule member, to make a selection.

Figure 11:
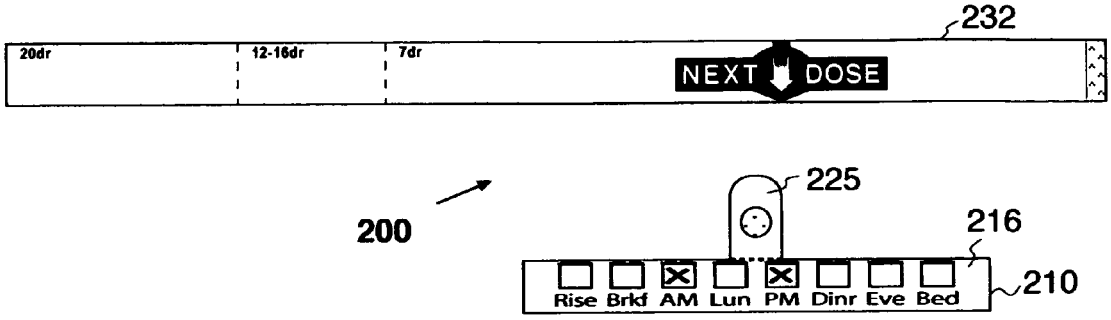
FIG. 11 is a planar view of the front of a second preferred embodiment 200 of my invention as it appears prior to preparation for mounting, fitting and assembly on a medication container.
Figure 12:
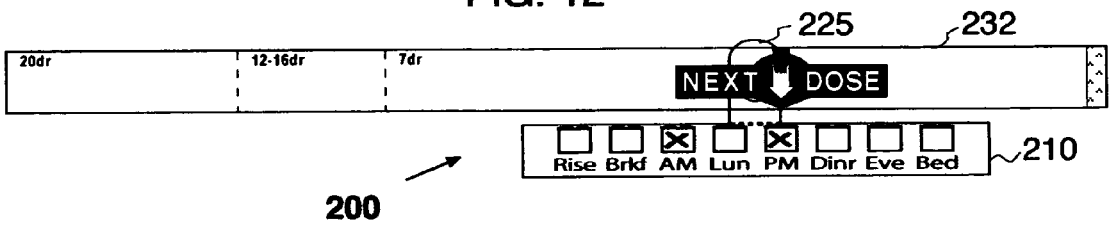
FIG. 12 is another planar view of the front of the device of FIG. 11 as it appears prior to preparation for mounting, fitting and assembly on a medication container. A band and a band support in the device are shown in close proximity to each other.
Figure 13:
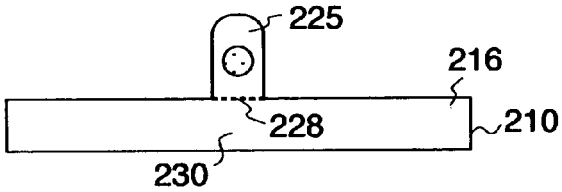
FIG. 13 is a planar view of the front of the band support of FIG. 11 without indicia.
Figure 14:
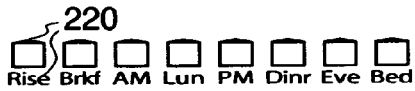
FIG. 14 shows the indicia to be printed on the front of the band support of FIG. 13.
Figure 15:
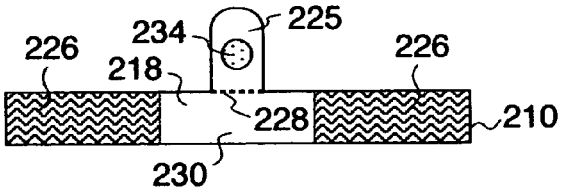
FIG. 15 is a planar view of the back of the band support of FIG. 11.

FIGS. 11 through 15 illustrate a second preferred embodiment of the invention, generally shown as 200 in FIGS. 11 and 12. A band or selector member 232 in the present embodiment differs from the band in device 100 in that the present band 232 has no teeth or notches and is not transparent. As best seen in FIGS. 13 through 15, a band support 210 differs from the band support in device 100 in that the present band support has no teeth or notches. The present band support also further includes a repositionable adhesive and a hinge. Turning now to FIG. 13, seen is a front 216 of the band support without indicia or schedule marks. A vertical extension 225 at the middle portion 230 of the band support includes a horizontal hinge 228 indicated by a dashed line and produced by any suitable method known in the art (ex. creasing) at the indicated location. The hinge facilitates manipulation of the extension after the band support is attached to a container. Indicia 220 (FIG. 14) are printed on the front of the band support. As shown in FIG. 15, opposing side portions of a back surface 218 of the band support carry a coating of pressure-sensitive adhesive 226. The pressure-sensitive adhesive serves to attach the band support to the side of a cylindrical medication container like that of C. The middle portion of the back of the band support including the extension member is not coated with pressure-sensitive adhesive, but the extension member includes a repositionable adhesive 234 as shown. The repositionable adhesive serves to reversibly attach and re-attach the extension to the front of the mounted band. Preferably the repositionable adhesive is in the form of a coating on a portion of the back of the extension member, but any suitable method which produces a similar result will work. Many such methods are known to those skilled in the art. For example, double-sided tape having a permanent adhesive on one side and repositionable adhesive on the other may be applied to all or part of the extension. Another method for localizing adhesive on a portion of the extension is to laminate a film having the requisite repositionable adhesive to the front of the extension to bridge an aperture previously produced in the extension. The adhesive is exposed when viewed from the back of the extension. A patient establishes his customized dosage schedule as previously described in the first preferred embodiment 100 of the invention.

The device 200 is assembled on the surface of the medication container in a manner similar to that of device 100. To attach the present band support 210 to the side of the container, the band support is first folded at the hinge to deform the extension toward the front surface of the band support (away from the container side). The band support is then attached to the wall surface of the container following the procedure for band support 110 of device 100. The present band 232 is prepared and mounted similarly following the procedure for device 100. If necessary, the band is rotated to make the first schedule selection. The band support extension is deformed again at the hinge to return the extension to more or less its original position to cover at least a portion of the band. The back portion of the extension carrying the repositionable adhesive is then pressed against the front of the band so that the repositionable adhesive can take its desired effect. The repositionable extension can thus securely hold the rotatable band at each of a plurality of selected positions and prevent both inadvertent longitudinal and inadvertent rotational displacement of the band on the container. Stated otherwise, the cooperating band is movable to each of a plurality of adherably selectable positions. Rotation of the band is possible while maintaining constant (non-adhesive) engagement with the band support. Those skilled in the art could easily adapt the device to have the repositionable extension reversibly adhere to another member in the device in order to selectively fix the position of the rotatable band and accomplish the same effect. Those skilled in the art will also realize that other adherable means could work well in some applications. For example, static cling, suction, etc. to perform the equivalent function of the adhesive material in the extension. Repositionable statically charged materials are commonly used to temporarily protect surfaces (ex. in consumer electronics). In operation, the adhered extension is pulled away sufficiently from the surface of the band to release the band for rotation. The band is rotated to indicate the next-dose time period and the extension is again pressed against the band to fix or secure the band position on the container. This band support provides a great degree of leeway for band fit on cylindrical containers. A particular advantage of this embodiment is that the band can be repeatedly rotated to make a selection and repeatedly fixed to prevent dislocation without changing its longitudinal position on the container. This reduces the operational height requirements for the device and makes it suitable for use with shorter containers.

Figure 16:
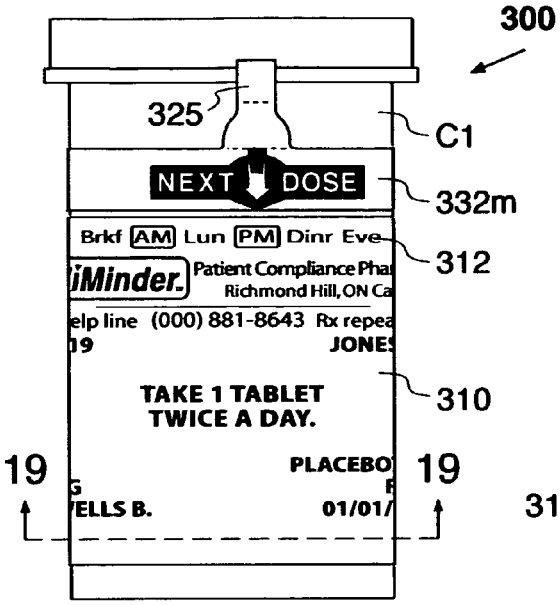
FIG. 16 is a planar view of the front of an additional embodiment 300 of my invention. In this example, the reminder device is assembled on a typical medication container (vial). A band support incorporates a traditional pharmacy prescription label. A band is adhesively repositionable. The medication container as depicted is not part of the invention.
Figure 17:
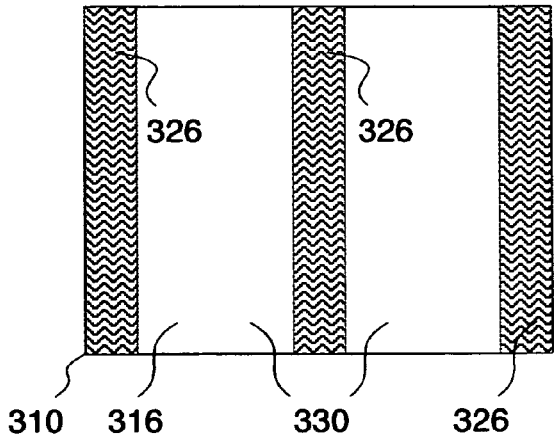
FIG. 17 is a planar view of the back of the band support in the device of FIG. 16. The band support displays an adhesive pattern.
Figure 18:
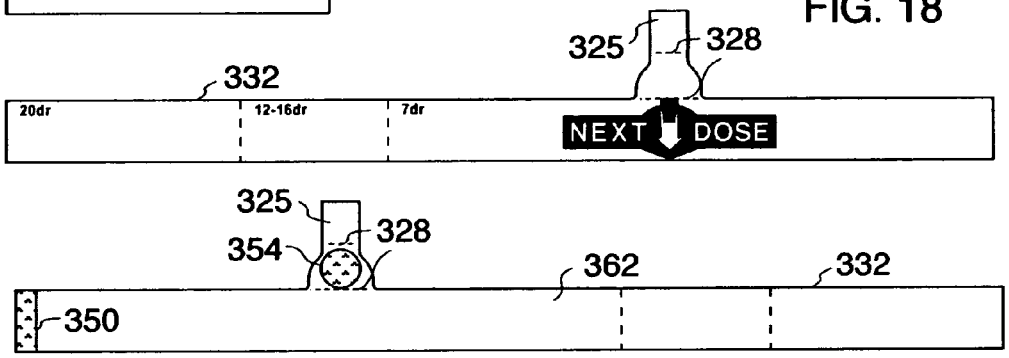
FIG. 18 is a planar view of the front and back of the band in the device of FIG. 16. The band is depicted prior to mounting.
Figure 19:
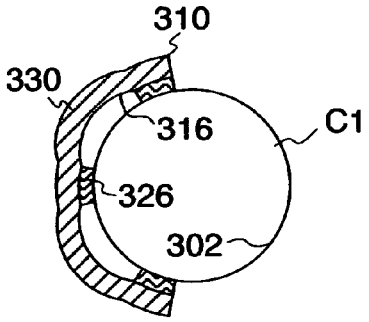
FIG. 19 is an unscaled exaggerated top cross-sectional view of the mounted band support of FIG. 16.

FIGS. 16 through 19 illustrate an additional third embodiment of the invention. Generally shown as 300 in FIG. 16, the band 332*m* (332 mounted) in the present embodiment is the same in all respects as the band 232 in device 200 but further includes an extension 325 at its upper perimeter as is shown in FIG. 18. The extension includes a set of hinges 328 which are produced by any suitable method known in the art such as for example, structural perforations. A portion at one end of the band includes a repositionable adhesive 350 on the back surface 362. A portion of the extension 325 between the set of hinges also includes a repositionable adhesive 354 on its back. As seen in FIG. 16, the band support 310 serves as a traditional prescription label, but further includes scheduling indicia 312 including the customized dosage schedule which may be produced at the same time as instructions for use are printed on the label. As best seen in FIG. 17, portions of the back surface 316 of the band support retain a coating of pressure-sensitive adhesive 326. The pressure-sensitive adhesive serves to attach the band support to a suitable medication container C1. Portions 330 of the back of the band support between the pressure-sensitive coated portions are not coated with adhesive and are therefore non-adhesive. The non-adhesive portions of the band support are embossed. The band support is attached to the container in the same manner as a traditional pharmacy label taking care to provide sufficient space above the label for mounting of the band. As best seen in FIG. 19, when the band support is attached to the container, the embossed portions are positioned at a radial distance from the wall 302 which is greater than the radial distance of the adhered portions (having adhesive on the back) from the wall of the container. Relatively thin band support label materials are thusly able to provide substantially improved leeway for band fit on the container. The technique overwhelmingly produces a situation in which the radial distance from the container side at which a portion of the band support is located is greater than the radial distance from the container side at which at least a portion of the band is located. In preparation for its mounting, the band length may be shortened, if necessary, as previously described in the first preferred embodiment 100. The band is then closely fitted around the container to form a continuous band just above the band support as described in the first preferred embodiment. If necessary, the band extension is folded back from the container surface and the band is rotated to make a schedule selection. The band extension is then pressed down against the container wall surface so that the repositionable adhesive associated with the band extension can take its desired effect and reversibly fix the band at the selected position. When medication is taken, the band extension is pulled away from the container surface sufficiently to release the band for rotation. The band may then be rotated again to make the next-dose selection. The band extension is then pressed down against the container wall to again fix the band position on the container. Stated otherwise, the cooperating band is repositionable to each of a plurality of adherably selectable positions. Rotation of the band is possible while maintaining constant engagement with the band support. Those skilled in the art could easily adapt the device to have the repositionable extension reversibly adhere to another member (ex. the band support) in the device in order to selectively fix the position of the rotatable band and accomplish the same effect. While the band support in the present embodiment is convenient as a rail guide for rotating the band, the band in the present embodiment does not strictly require the band support to function properly. The band may cooperate with a member that is not raised from the wall surface. For example, cooperating indicia could be engraved in the wall of the container or even be inside the container but visible from the outside. The present band could therefore work with prescription labels that are of a consistent effective thickness (ex. not folded or embossed) such as conventional pharmaceutical labels.

Figure 20:
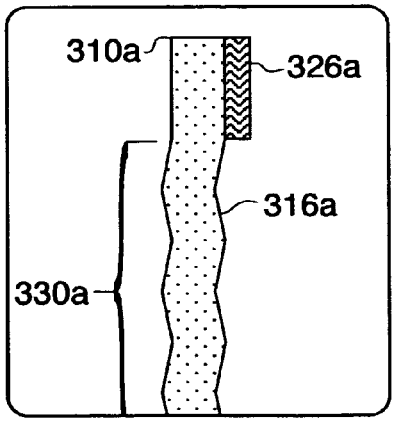
FIG. 20 is a greatly enlarged, fragmentary, top cross-sectional view showing an unmounted band support in which creasing enhances support of a cooperating band.

Many other methods to increase effective support thickness (ex. radial support area) of a band support will now become apparent to those skilled in the art. FIG. 20 illustrates an additional method applied to an unmounted band support like that of band support 332 in embodiment 300 of the invention. Shown in the greatly enlarged fragmentary cross sectional top view of FIG. 20, band support 310*a* includes a pressure-sensitive adhesive 326*a* on a plurality (not shown) of portions of back surface 316*a*. A non-adhesive portion or portions 330*a* between the adhesive portions is accordion folded or accordion creased to produce the corrugated shape shown. When mounted on a cylindrical container, the unadhered portions work with the adhered portions to produce at the non-adhered portions (non-adhesive portions) an effectively thicker support than is present at the adhesive portions.

Figure 21:
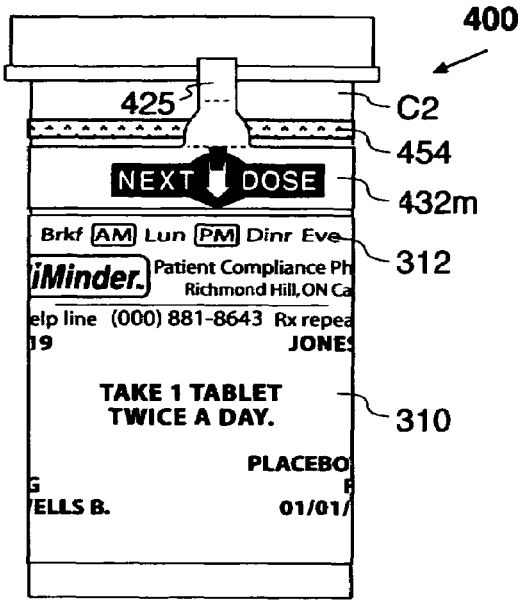
FIG. 21 is a planar view of the front of an additional embodiment 400 of my invention. In this example, the dosage reminder device is assembled on a medication container (vial) which includes a strip of repositionable adhesive. A band in the device is adhesively repositionable.
Figure 22:
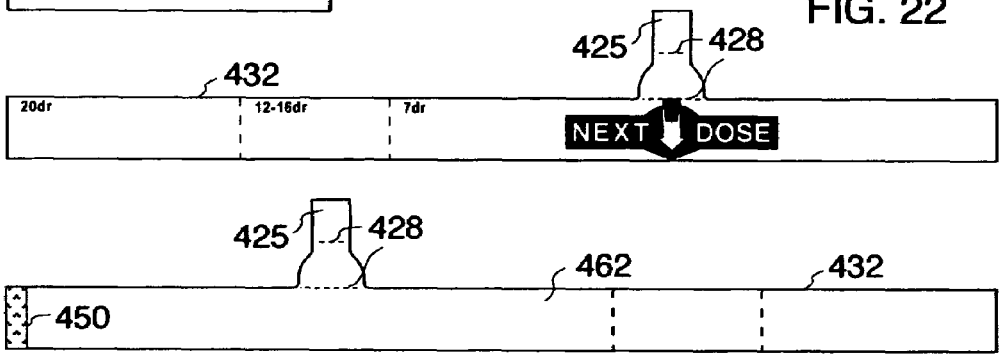
FIG. 22 is a planar view of the front and back of the band of FIG. 21 prior to mounting.

FIGS. 21 and 22 illustrate an additional fourth embodiment of the invention. Generally shown as 400 in FIG. 21, the band support in the present embodiment is the same band support 310 as is used in the previous embodiment 300 of the invention. The band 432 (indicated as 423*m* when mounted) in the present embodiment differs slightly from band 332 in embodiment 300, a band extension 425 not including any repositionable adhesive. The present band is the same as band 332 in all other respects. As best seen in FIG. 22, the structural perforations 428 and the repositionable adhesive 450 on the back 462 of the band are equivalent to those used in embodiment 300. Turning back to FIG. 21, a suitable cylindrical container C2 includes a coating of repositionable adhesive 454 on the exterior wall of the container. The coating may be applied onto the container by any suitable method known in the art, such as spraying, roller, printing etc. Preferably the coating is applied as a narrow adhesive band which surrounds the container. Other patterns as well as those that only partially circumscribe the container will work in many applications. The device is assembled on the surface of the container by mounting the band around the container and attaching the band support in separate steps. In preparation for its mounting, the band length may be shortened, if necessary, as previously described in the first preferred embodiment 100. To mount band 432 around the container, the band is first folded at the hinge joining the extension to the band to deform the extension toward the front surface of the band support (away from the container side). The band is then closely fitted (not tightly) around the container to form a continuous band as described in the first preferred embodiment at the position on the container shown in FIG. 21 such that the band extension 425 may subsequently cover a portion of the container adhesive 454. The band extension is deformed again at the hinge to return the extension to more or less its original position to cover at least a portion of the container adhesive. The back of the extension is then pressed against the container so that the repositionable adhesive can take its desired effect and thereby reversibly fix or secure the location of the band on the container. The band extension may be manually grasped and held between fingers to pull the extension away from contact with the container adhesive and free the band for rotation about the container. The band support is attached to the container just below the band in the same manner as a traditional pharmacy label. The cooperating band is movable to each of a plurality of adherably selectable positions. Rotation of the band is possible while maintaining constant engagement with the band support. The band can be repeatedly rotated to make a selection and repeatedly fixed to prevent dislocation without changing its longitudinal position on the container. Operation of the device 400 is similar to and is functionally the same as device 300.

Figure 23:
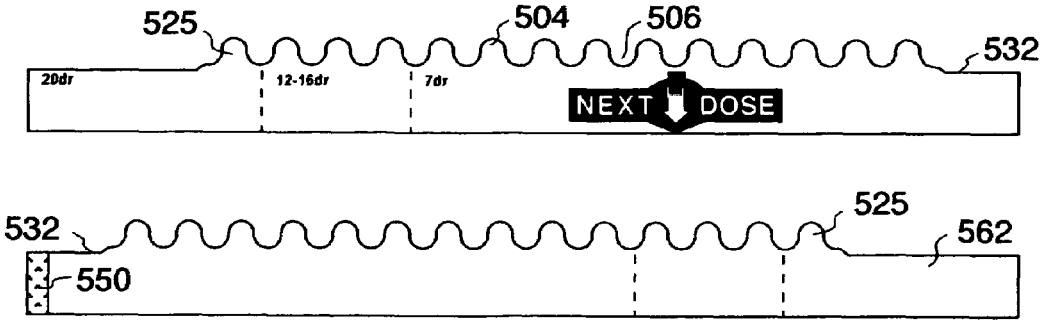
FIG. 23 is a planar view of the front and back of the band of FIG. 24 prior to mounting. The band includes a plurality of deformable extensions forming engageable teeth and notches.
Figure 24:
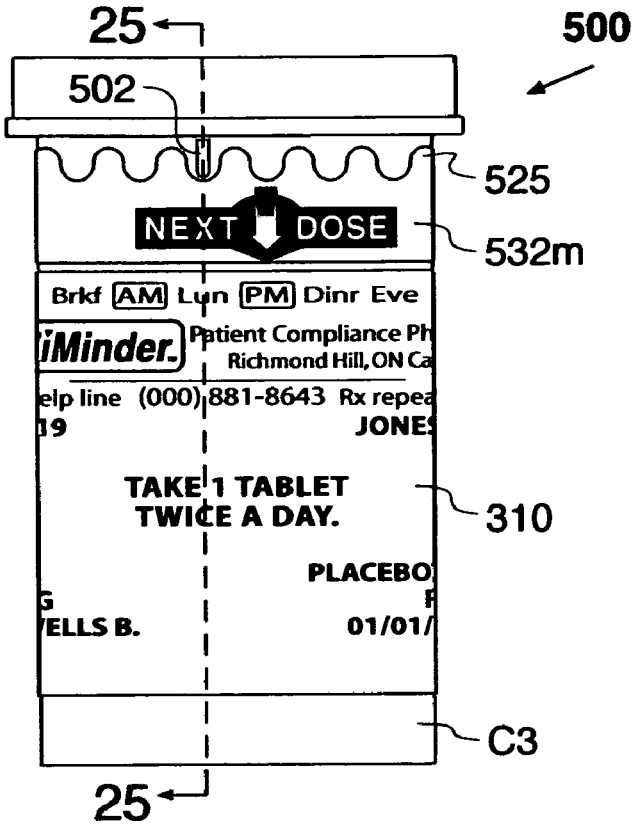
FIG. 24 is a planar view of the front of an additional embodiment 500 of my invention. In this example, the dosage reminder device is assembled on a medication container (vial) which includes a raised rim member. A band in the device is deformably repositionable.
Figure 25:
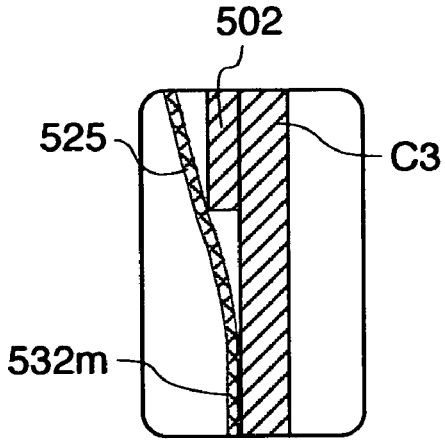
FIG. 25 is a greatly enlarged, fragmentary, side cross-sectional view of the device of FIG. 24 showing the mounted band being deformed by the raised rim member during rotation.

FIGS. 23 through 25 illustrate an additional fifth embodiment of the invention. Generally shown as 500 in FIG. 24, the band support in the present embodiment is the same band support 310 as is used in the previous embodiment 400 of the invention. Like band 432 in embodiment 400, the present band 532 (indicated as 532*m* when mounted) includes a repositionable adhesive 550 on the back 562 of the band, however the present band differs slightly from band 432. The two bands are the same in all respects except that the extension 425 is replaced by a plurality of extensions 525 forming a row of rounded teeth 504 and notches 506 along the upper perimeter of the band. The teeth and notches are shaped to mate with or engage a rim member 502 on the wall of a suitable container C3. The rim member is preferably formed on the surface of the container from the same material as the container when the container is formed. Rim members produced from other materials or otherwise manufactured and attached by any suitable means (ex. a cardboard label with adhesive) will also work in many applications. As best seen in FIGS. 24 and 25, the container C3 is similar to container C2, but further includes the rim member near the top of the container. The rim member extends outward (more or less perpendicularly) from the wall of the container sufficiently to engage the teeth and notches of the closely mounted band 532*m*, thereby hindering inadvertent upward and inadvertent rotational movement of the mounted band. The device is assembled on the surface of the medication container by mounting the band around the medication container and attaching the band support in separate steps. In preparation for its mounting, the band length may be shortened, if necessary, as previously described in the first preferred embodiment 100. The band 532 is positioned near the top of the container such that the rim member engages one of the band extensions as shown in FIG. 24 and the band is formed into the loop or continuous band 532*m* following the procedure described in the first preferred embodiment 100. The band support 310 is then attached to the container just below the mounted band following the procedure previously described for device 300. As best seen in FIG. 25, when the band is forcefully rotated to make a selection, the engaged extension is deformed away from the container by contact with the rim member 502 and slides over the rim member such that the rim member engages the next adjacent extension. Rotation of the band is possible while maintaining constant engagement with the band support. The band can be repeatedly rotated to make a selection and repeatedly fixed or secured to prevent dislocation without changing its longitudinal position on the container.

Figure 26:
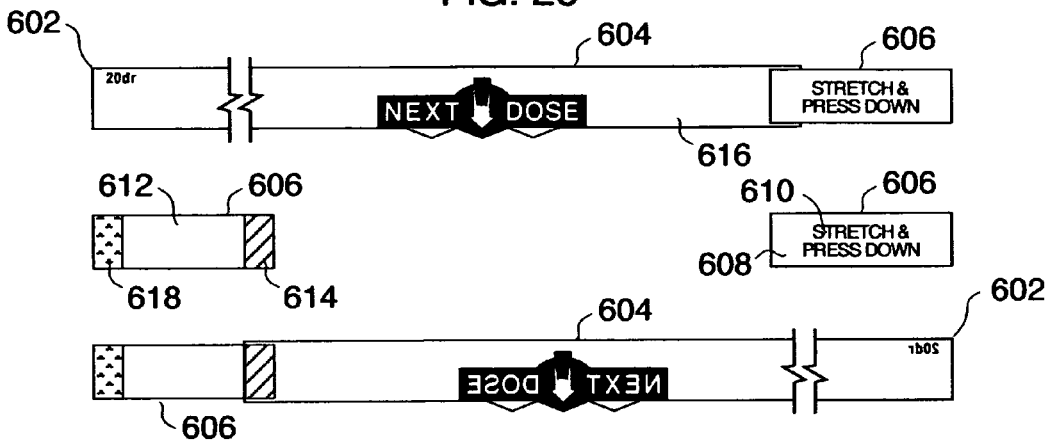
FIG. 26 depicts a segmented planar view of the front and back of an elastic band prior to mounting in which a portion of the band includes an elastic material.
Figure 27:
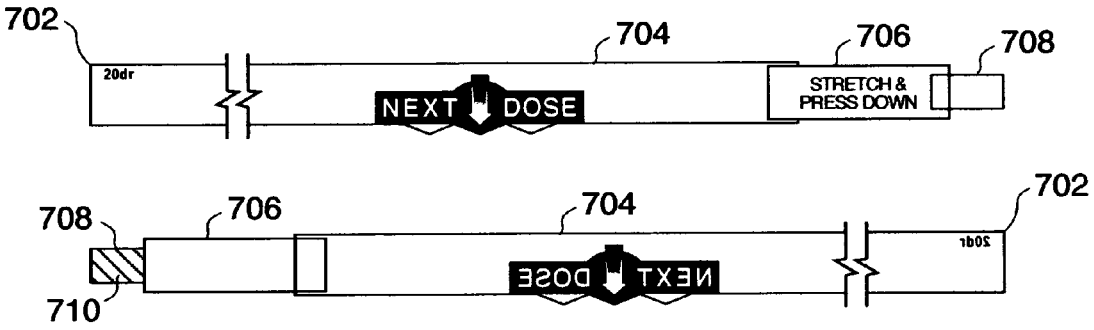
FIG. 27 depicts a segmented planar view of the front and back of an elastic band prior to mounting in which adhesive tape is used to mount the band on a container (not shown).
Figure 28:
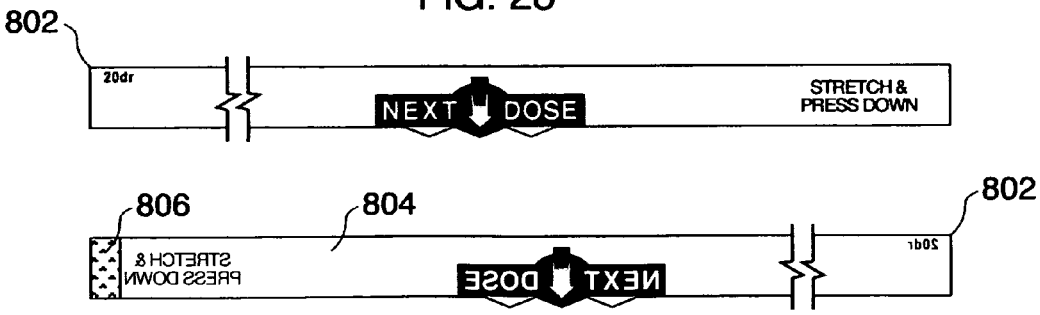
FIG. 28 depicts a segmented planar view of the front and back of a translucent elastic band prior to mounting. The entire band is elastic and a portion on the back carries repositionable adhesive
Figure 29:
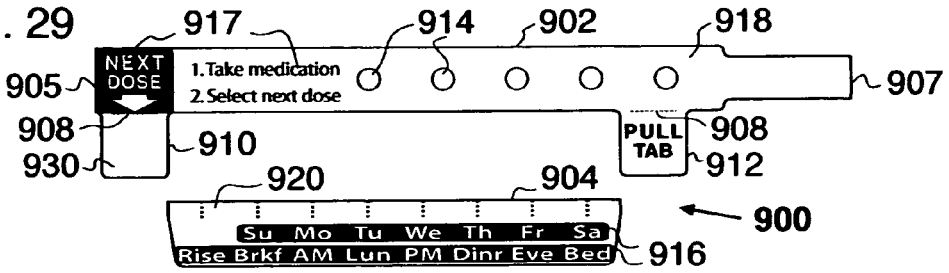
FIG. 29 is a planar view of the front of an additional embodiment 900 of my invention. In this example, a band and a band support member are applied to a container somewhat concurrently or in a single step.

FIGS. 26 through 28 illustrate variations of a band that facilitate proper mounting around a cylindrical container in devices made according to the invention. Maintenance of correct band fit is also enhanced over the usable life of a device, particularly in containers having tapered walls. Seen in FIG. 26 is a substantially rectilinear elastic band 602, the band easily resuming its original shape after being stretched or expanded. The elastic band includes a non-expandable member 604 and an expandable member 606, the members being joined preferably permanently together by any suitable means known in the art. In the present illustration, the back 612 of the expandable member retains a spot coating of adhesive 614 at one end which serves to join the members together. The members are joined by laying the expandable member over the front 616 of the non-expandable member in the position shown in the illustration and pressing the two members together at the location of the adhesive until the adhesive between the two members takes its desired effect. The opposing end of the back of the expandable member retains a spot coating of preferably repositionable adhesive 618 which serves to mount the band 602 as a loop or continuous band around a cylindrical container. Permanent adhesive would also work in some applications. The non-expandable member 604 may be produced from the same materials and in a like manner as the band 132 in the first preferred embodiment 100 of the invention. The expandable member 606 is preferably manufactured from suitable flexible sheet stock or roll stock, and may be punched, cut, or similarly manufactured. The material may be of woven or non-woven construction and may include natural or synthetic fibers. Desirable characteristics, such as percentage of stretch before permanent elongation or break, contraction force, clarity, surface texture etc. can be engineered into the material by those skilled in the art. Examples of some woven elastic materials, which may be made suitable are those used in nylon hosiery and those commonly used in wound bandages. Vinyl and some polyethylene films can function as non-woven elastics. Commercial examples of non-woven elastic use can be seen in adhesive bandages and closure tapes in disposable diapers. Preferably the expandable member 606 is a non-woven material. The front 608 of the expandable member includes application indicia 610 produced by any suitable method. The band 602 is prepared for mounting and is mounted in a similar fashion to that of the band 132 in the first preferred embodiment 100 of the invention. The only difference in the new band being that the expandable member is stretched slightly before pressing down onto the overlapped portion of the non-expandable member to form a loop or continuous mounted band. Because the band is stretched as it is mounted around the container, the band remains under constant tension and maintains improved fit on the container. A reminder device that includes band 602 in place of band 132 may be operated in the same manner as a device that includes band 132.

FIG. 27 shows an elastic band 702 similar to elastic band 602. Elastic band 702 includes a non-expandable member 704 being the same as non-expandable member 604 of band 602. Band 702 also includes an expandable member 706. The expandable member 706 is the same as expandable member 606 of the previous elastic band excepting that expandable member 706 carries no adhesive coating. The expandable member is joined to the non-expandable member by any suitable means known in the art such as for example heat or chemical fusion or sonic welding. Elastic band 702 further includes a strip of transparent adhesive tape 708 (ex. polyester film) adhered to the expandable member 706 as shown. The tape, which carries a coating of adhesive 710 on the back, serves to mount the band 702 as a loop or continuous band around a cylindrical container. The elastic band 702 is prepared for mounting and is mounted in the same manner as elastic band 602 (previously described). A reminder device that includes band 702 in place of band 602 may be operated in the same manner as a device that includes band 602.

FIG. 28 shows a substantially rectilinear band 802 produced from elastic material. The expandable band 802 is the same in all other respects as the band 132 of the first preferred embodiment of the invention 100. The band material is preferably translucent, but materials that will also work in many applications can range from opaque to transparent. The back 804 of the present band carries a spot repositionable adhesive 806 at one end which serves to mount the band 802 as a loop or continuous band around a cylindrical container. The elastic band 802 is prepared for mounting and is mounted in the same manner as elastic band 602 (previously described). A reminder device that includes band 802 in place of band 132 may be operated in the same manner as a device that includes band 132.

Figure 30:
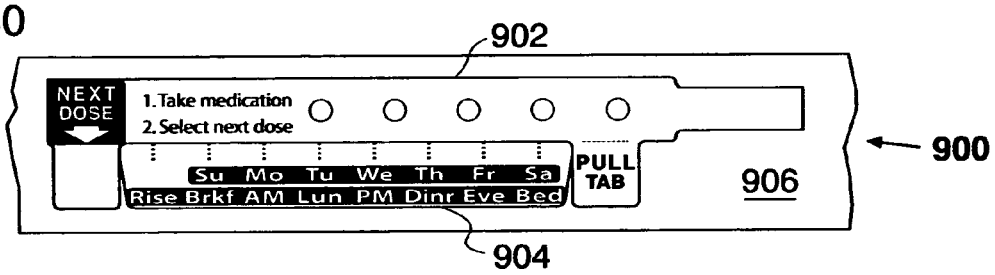
FIG. 30 is a planar view of the front of embodiment 900 of my invention as it appears on a release liner.
Figure 31:
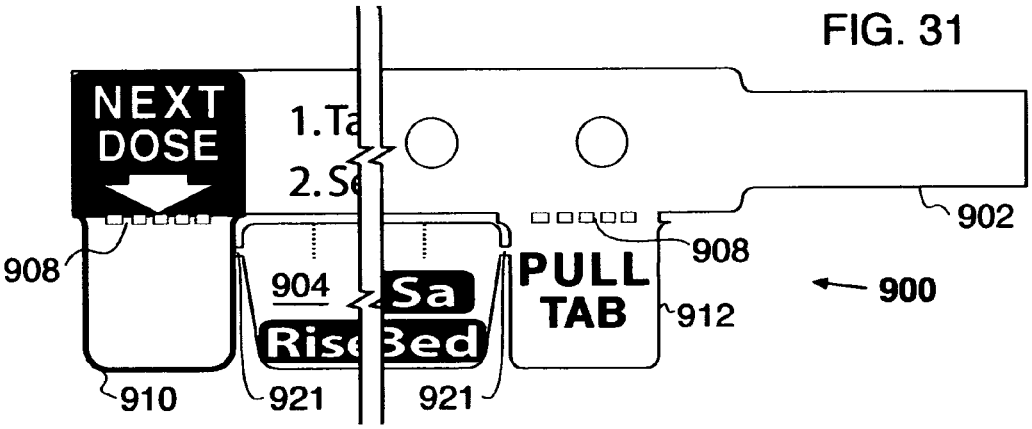
FIG. 31 is an enlarged segmented planar view of the front of the device of FIG. 30.

FIGS. 29 through 37 illustrate an additional sixth embodiment of the invention. Generally shown as 900 throughout the figures, the reminder device is formed from two transparent film parts or members: a selector band 902 and a band support 904. The two device members (band and band support) are produced from a common sheet carrying zoned adhesive on the back surface, which serves to temporarily hold (i.e. until required for use) the device members on a carrier or release liner 906 sheet as is common in the art. A continuous liner 906 holding a plurality of devices may be put up in a roll for convenience. The two device members are positioned on the liner so as to facilitate manual or automated somewhat concurrent or single-step removal of both members for application to a suitable container in a single step. As best seen in FIG. 30, the excess sheet material (outside the perimeter of the device) has been removed as is common in the art, leaving the device on the now oversized liner. Automated application of such pressure-sensitive members is well known in the art and is commonly used for application of labels. The band includes a first end 905 and a second end 907 and is constructed with a hinged 908 indicator or selector tab 910 and a hinged 908 pull tab 912. As illustrated, suitable indicia 917 are preferably produced on a front surface 918 of the band. In particular, the tab portion of the next-dose selector band is translucently colored 930 (ex. light blue) to produce a discernible contrast between it and closely adjacent indicia when moved over the schedule. In combination with the underlying member, the colored tab effectively produces a perceived color change. The tab 910 permits highlighting a selection while still leaving the entire schedule visible, an important element in improving patient compliance. This is in sharp contrast to, and is far more desirable than a member including an opening or window to selectively disclose otherwise hidden information, as proposed by some previous reminders. A raised series of dots 914 on the front surface of the band serve as additional gripping means for manipulating the band after mounting. The raised dots are produced by the application of tactile material. An exemplary method is to print with tactile ink generally used for printing in Braille for visually impaired users, but other methods known in the art (ex. thermography) will work in some applications. The band support 904 includes a universal schedule 916 preferably produced on a front surface 920 of the band support member in black knock-out type. The clear characters allow for easy customization of the schedule. To customize the schedule a user inscribes a line through (eliminates) the unwanted time periods with a permanent black marker or equivalent FIG. 31 is an enlarged segmented view of the front of the device, showing how the sides of the band support are joined to the sides of the band tabs by attachment points or legs 921. The linking of the band support to the band facilitates processing of the device. Thus allowing single-step removal (from the liner) and single-step application (to a container) of the device.

Figure 32:
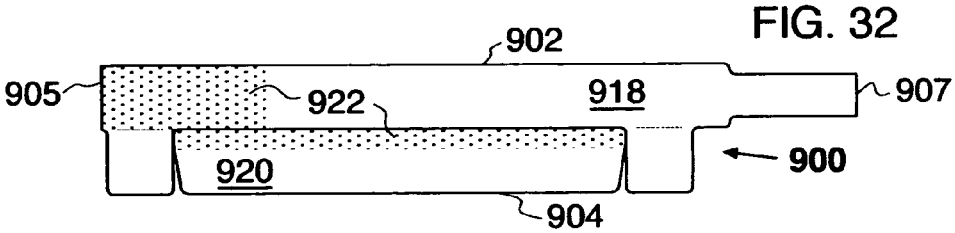
FIG. 32 is a planar view of the front of the device of FIG. 30, showing a pattern of release material.
Figure 33:
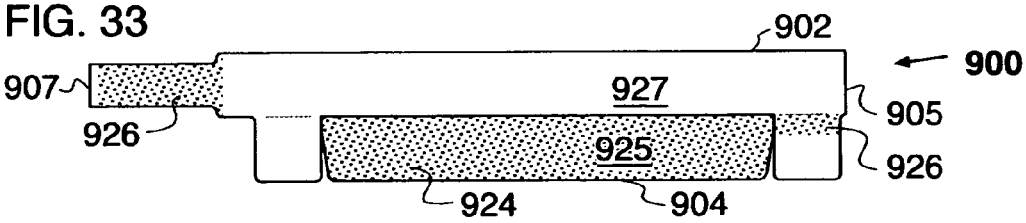
FIG. 33 is a planar view of the back of the device of FIG. 30, showing a pattern of adhesive material.
Figure 34:
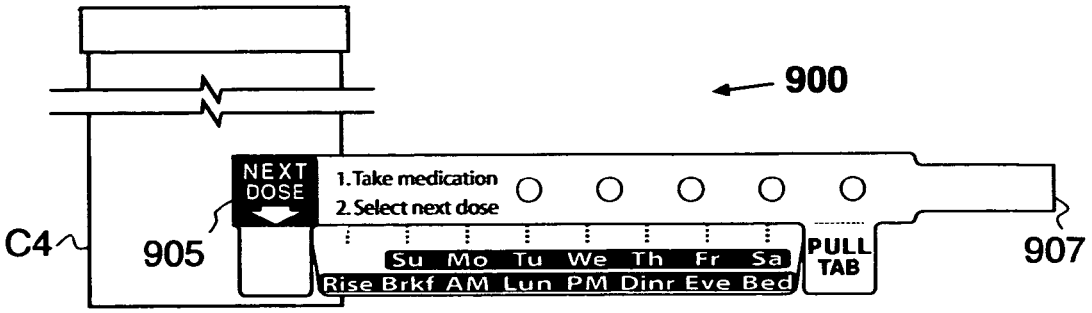
FIG. 34 is a segmented planar view of the front of the device of FIG. 30 and a container showing the starting position for the device being mounted on the container.
Figure 35:
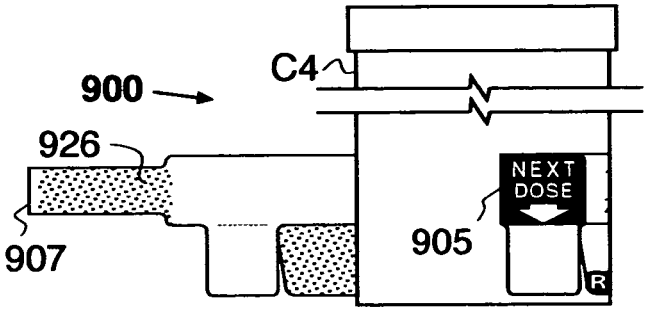
FIG. 35 is a segmented planar view of the front of the device of FIG. 30, showing the progressive position for the device being mounted on the container of FIG. 34.
Figure 36:
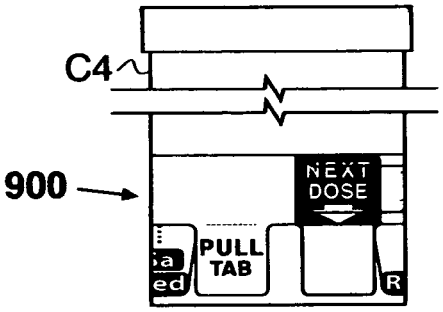
FIG. 36 is a segmented planar view of the front of the device of FIG. 30, showing the final position for the device being mounted on the container of FIG. 34.
Figure 37:
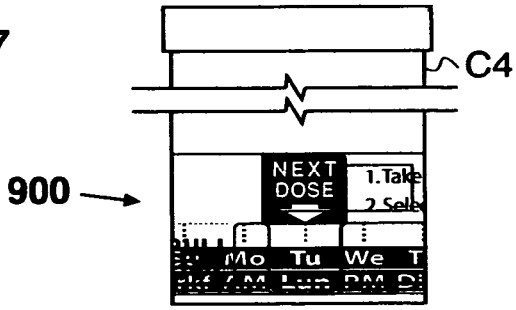
FIG. 37 is a segmented planar view of the front of the device and container of FIG. 36, showing a selector band rotated to select a position on a band support or selectable member.

Turning now to FIGS. 32 and 33, seen is the front surface 918 of the selector band and the front surface 920 of the band support, both including a pattern of release material 922, produced by any suitable means known in the art. Also shown is a back surface 927 of the selector band and a back surface 925 of the band support, both including a pattern of pressure-sensitive adhesive material 924 and 926, produced by any suitable means known in the art. In the current embodiment 900 of the invention a permanent pressure-sensitive adhesive 924 is used on the back 925 of the band support schedule member and a repositionable pressure-sensitive adhesive 926 is used on the back 927 of the band member. It should be noted that it is possible and may be expedient to use the same pressure-sensitive adhesive for all adhesive portions of the device in some applications. When the device 900 is applied to a suitable container C4 as shown in FIGS. 34-37, the adhesive 924 on the back of the schedule (band support) is made to contact the front surface of the container (or optionally the front surface of a prescription or other label on the container) and act as a permanent non-repositionable adhesive. The adhesive 926 portions on the back of the band act as a repositionable adhesive on the surfaces they contact. Starting from the position shown in FIG. 34, the device is pressed onto the container and wrapped to the position shown in FIG. 35. The members are then wrapped and pressed onto the container to the final position shown in FIG. 36 such that the second end 907 overlaps the first end 905 (similar to the manner shown in the first preferred embodiment 100). The length of the device and the circumference of the container are matched so that when the device is wrapped around the container to the final position shown in FIG. 36, the entire adhesive portion 926 near end 907 lands on the front of the band, and not on the container. Customization of the schedule is preferably performed as previously described after mounting the device on the container. To activate the device, both tabs 910 and 912 are folded upward on their respective hinges 908, irreversibly breaking the attachment legs 921 and producing two discrete cooperating members (the band and the band support) located directly on the front surface of the container (or optionally located directly on the front surface of a prescription or other label on the container). It should be noted that since breaking the legs irreversibly alters the mounted device as initially presented and by association irreversibly alters any package or container including the device as initially presented, such alteration can be used as an indication of tampering. In operation the band or selector is rotated around the container to move the next-dose indicator to a selected position as best seen in FIG. 37. The rotation of the band to a selected position locates the adhesive-backed portion of the next-dose tab at the release material on the front of the band support so that the position can be adherably selected or secured. The tab is folded down and digitally pressed onto the band so that the pressure-sensitive repositionable adhesive on the back of the tab can take its desired effect and secure the selection. When medication is taken, the tab is folded upward (at the hinge) to release or disengage it from the band support, the band is rotated to a new selection and the tab is again pressed down. The pull tab may be gripped and moved in the direction of wanted band rotation to assist those having difficulty rotating the band otherwise.

FIGS. 38 through 40 illustrate an additional seventh embodiment of the invention. Generally shown as 1000 throughout the figures, the reminder device includes three distinct members, which are coupled together for ease of somewhat concurrent or single-step application (i.e. linked to facilitate processing), preferably directly on the front surface of a cylindrical container. The device is preferably produced from a transparent sheet (ex. polyester), but a non-transparent sheet will work just as well in many applications. The device (or a plurality of devices) is preferably made from film material carried on a roll of release liner (not shown) made preferably of paper or film. The device in its roll presentation being suitable for automated attachment to a container using conventional or modified labeling machinery in common use. After mounting or attachment to the container, a user can activate the device by manually pulling on tabs in the device, which will produce the three distinct members mounted directly on the front surface of the container. FIG. 38 shows the front of the three distinct members in the device. They have been detached and separated from each other for clarity. Shown are a content-description member 1002 (i.e. label), a selectable member 1004 (band support schedule label) and a movable selection member 1006 (rotatable band selector or indicator label). The content label includes suitable indicia 1008 (ex. printed) and is similar to a standard label that would be required to offer contents of a package or container for sale. Similar labels would readily be found on plastic or glass containers in retail stores. The selectable support member includes suitable schedule indicia 1010 (ex. printed) for regimented consumption of any attached container contents. The movable or rotatable selector member includes suitable indicia 1012 (ex. printed) that may provide information for activation and operation of the device and provide any additional wanted information. Obviously the location of described information need not be strictly confined to the mentioned areas, so long as the reminder can fulfill its function. Hinged 1014 tabs 1016 extending from the upper perimeter of the movable member are joined to side end 1018 and opposing side end 1020 of the content label by legs like those in the sixth embodiment of the invention at attachment points 1022, 1024. Hinged 1014 tabs 1017 extending from the lower perimeter of the movable member are joined to side end 1023 and opposing side end 1025 of the selectable member label by legs like those in the sixth embodiment of the invention at attachment points 1026, 1028. The corners of the tab extensions include curved weakened lines or structural perforations 1030 for facilitating detachment of the tabs from the corners. The movable member further includes a readherable security tab 1032 at one end. Best seen in FIG. 39 is the front of the device as it appears on the release liner (not shown) prior to mounting on a container (like that of C4 in 900). Portions, indicated by shading, of the printed front surface 1034 of the selector and the printed front surface of the selectable member carry a release coating 1036 engineered to facilitate removal of any subsequently attached pressure-sensitive adhesive materials. The back 1038 of the device (FIG. 40) is zone coated with a single permanent pressure-sensitive adhesive (ex. hot melt) such that some portions, indicated by shading, carry adhesive 1040 while others do not. When a single pressure-sensitive adhesive is used on all adhesive portions, the adhesive may be caused to behave differently, subject to the surface onto which the adhesive portion is later pressed. For example, the size of the reminder device is closely matched to a suitably sized container (not shown) such that when the device is wrapped around the container in mounting, all the adhesive portions of the selector, exclusive of the tabs (1016, 1017), land on the front surfaces of the selector and the selectable member. When the device 1000 is applied to a suitably matched container, the adhesive on the back of the content label, the back of the selectable member and the back of the movable member tabs is made to contact the container and act as a permanent non-repositionable adhesive. The adhesive portions on the back of the security tab 1032 are made to contact release coated front surface portions and act as a repositionable adhesive. A portion of the adhesive adjacent to the security tab is made to contact a portion of the front surface of the movable member which is not release coated and therefore acts as a permanent adhesive (forming a permanent continuous loop around the container). To activate the device, both upper tabs are folded downward and both lower tabs are folded upward on their respective hinges, irreversibly breaking all the attachment legs, and breaking the attachments at their perforated corners. Thereby leaving three discrete members (the content label, the selector and the selectable support member) located directly on the front surface of the container. Since breaking the above attachments irreversibly alters the mounted device as initially presented and by association irreversibly alters any package or container including the device as initially presented, such alteration can be used as an indication of tampering. To operate the device, the readherable security tab is lifted to disengage it from the underlying member surface. The selector is then moved or rotated around the container to locate the next-dose pointer at a selected position, and the security tab is pressed down. The tab is digitally pressed onto the selectable member so that the pressure-sensitive repositionable adhesive on the back of the tab can take its desired effect and secure the selection. When medication is taken, the security tab is once again lifted to release or disengage it from the selectable member, the band is rotated to a new position and the tab is again pressed down to adherably and securely select the new position. The pull tabs may be gripped and moved in the direction of wanted band rotation to assist those having difficulty rotating the band otherwise.

Figure 44:
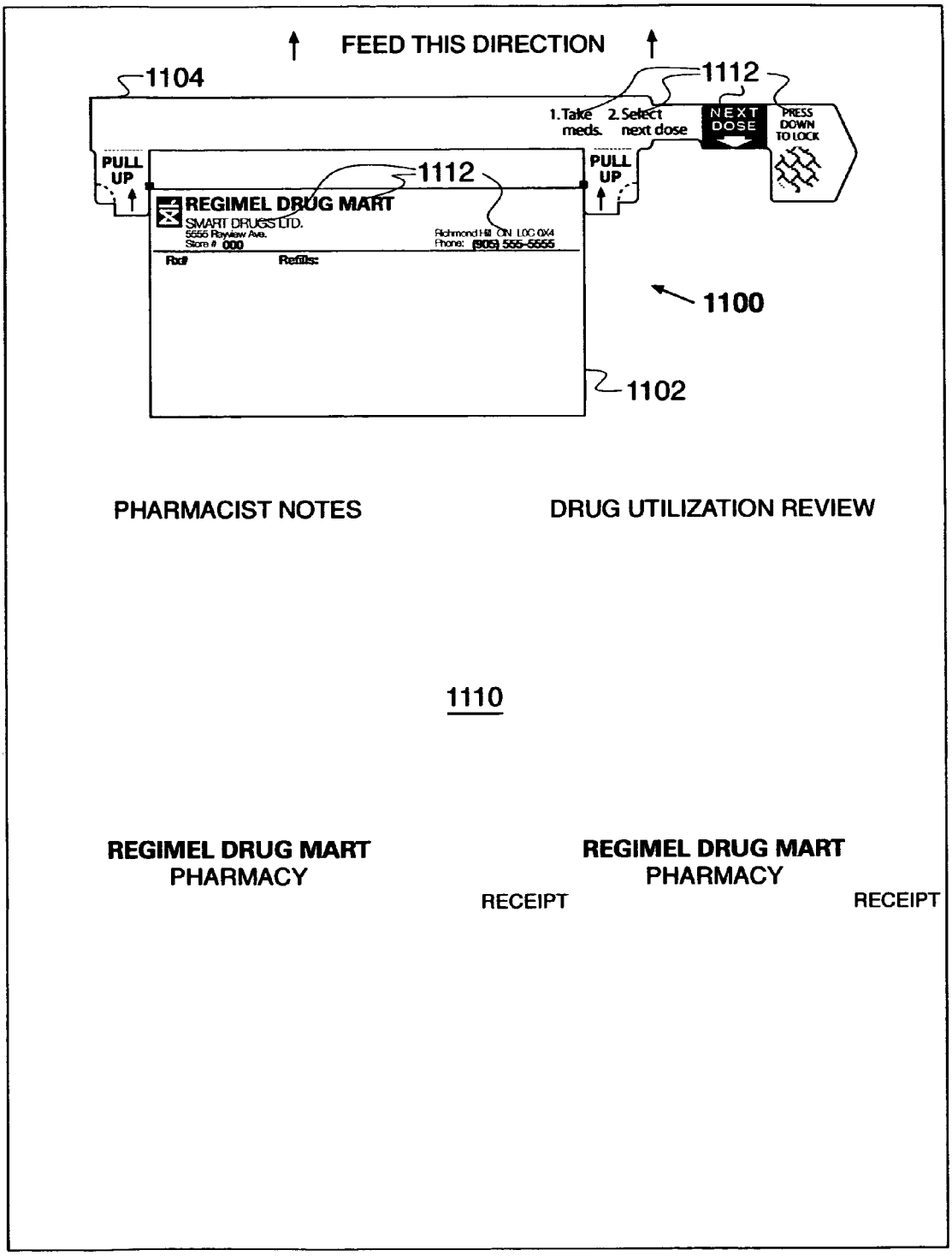
FIG. 44 is a front view of the front surface of the label device of FIG. 42 located on a label sheet, according to the present invention.

FIGS. 41 through 47 illustrate an additional eighth embodiment of the invention. Generally shown as 1100 throughout the figures, the reminder device includes two distinct members, a selectable support member 1102 and a selector or next-dose pointer member 1104. The members are both produced as adhesive labels. Preferably the label members are linked together (to facilitate processing) by at least one pair of attachments located preferably at points 1106, 1108 for ease of applying somewhat concurrently or in a single step, onto the front surface of a suitable cylindrical prescription container C5. Other configurations for attachment between the two labels will also work. Unlinked members will work equally well, but require mounting in separate steps. The device is preferably produced on a transparent sheet, but a non-transparent sheet will work just as well in many applications. As seen in FIG. 44, the label reminder device 1100 may be formed as part of a standard-sized label sheet 1110, with die-cut lines or equivalent being provided to define the peripheries of the device and permit its separation from a release liner of the label sheet. It is to be appreciated that breakable attachments at points (not shown) as are known in the art may further be included at the peripheries of the device and the surrounding sheet as may be necessary to achieve desirable handling performance of the label sheet and the device. The label sheet may then be inserted into a computer printer to enable printing of appropriate custom indicia onto the front surfaces of the label members. The illustrations show custom printing on both of the label members, but custom printing on only one of the label members is not precluded. Certain indicia 1112, such as the name of the pharmacy, contact information for the pharmacy, and device operation instructions may be preprinted onto the device labels prior to the custom indicia imprinting period. Alternatively, the label members may be left completely blank, and be printed with both custom and generic indicia at the time of pharmaceutical purchase so long as such printing is restricted to print receptive areas of the label surfaces. In similar fashion to that of embodiment 1000, portions of the front surfaces of the selectable label member and the selector label member in the current embodiment 1100 are coated with a release material or equivalent in predetermined pattern 1130 as best shown by the shaded areas in FIG. 41. Other variations of patterns may be utilized so long as suitable portions of the selectable label member, later contacted by adhesive, facilitate release of the adhesive member.

Figure 45:
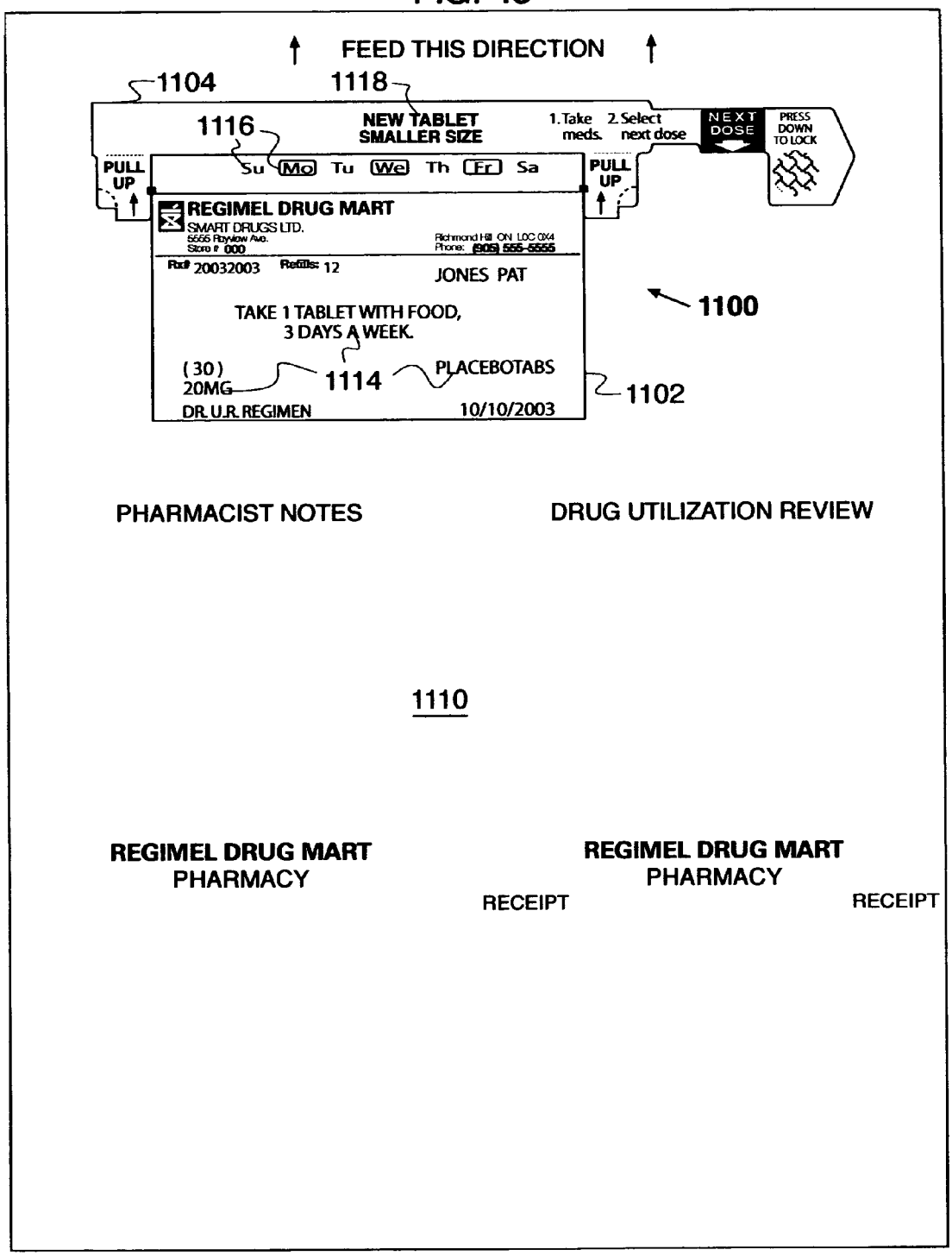
FIG. 45 is a front view of the label device of FIG. 44 with additional indicia printed thereon.

FIG. 45 depicts the label device 1100 and contiguous label sheet 1110 after the custom patient indicia has been printed onto the front surfaces of the label device members. In the example depicted by FIG. 45, a first set of custom indicia 1114 representative of pharmacist notes and instructions is printed on the mid and lower portions of the selectable label. The first set of indicia provides information that is typically included in a standard prescription label in current practice. A second set of suitable custom indicia 1116 indicative of a dosage schedule is printed in a row at the upper portion of the selectable label member. A box around the appropriate designations serves to highlight the relevant dosage periods. A third set of suitable custom indicia 1118 is printed on the selector or movable label member. Those skilled in the art will find many variations to convey suitable instructions. This example is provided by way of illustration only and is not intended to limit the scope of the invention. The indicia to be printed on the device labels may be advantageously generated or selected by using computer software and equipment designed for this purpose.

Figure 46:
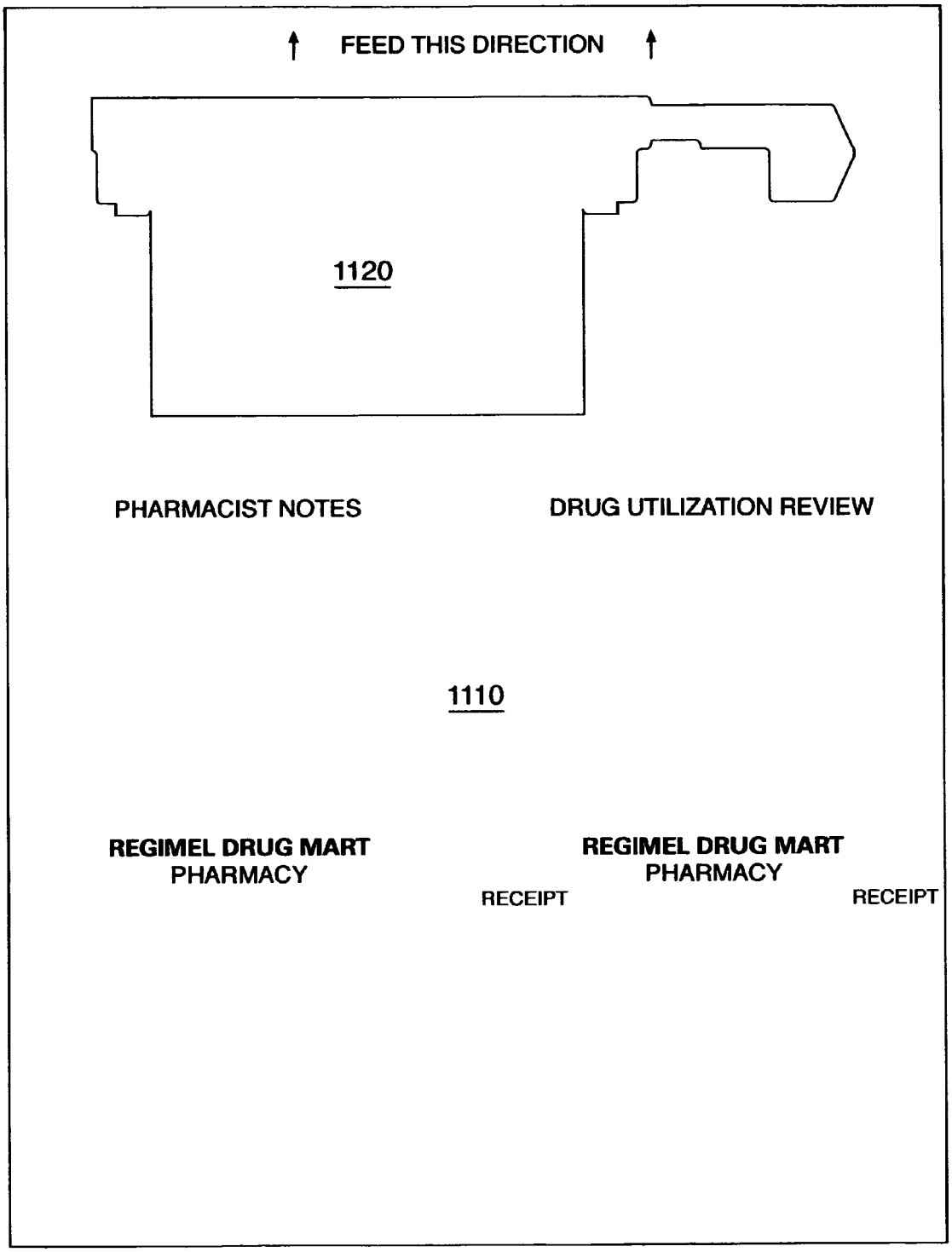
FIG. 46 is a front view of the label sheet of FIG. 44 after the label device has been removed.

FIG. 46 depicts the label sheet 1110 after label device 1100 has been removed therefrom. A release liner 1120 is disposed adjacent to the rear surface of label device 1100 to allow the device to be easily separated from the remainder of the label sheet 1110.

Figure 47:
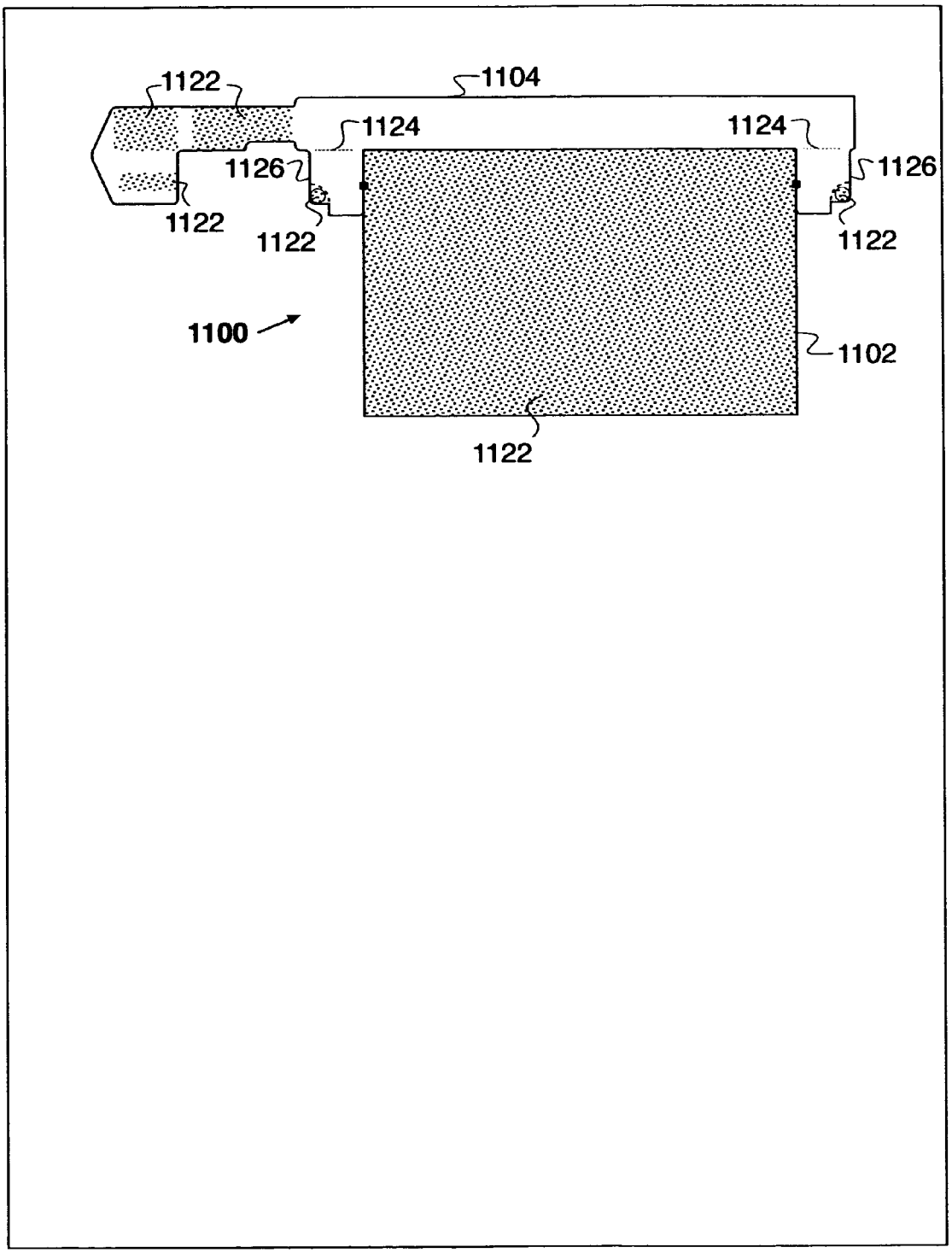
FIG. 47 is a rear view of the label device of FIG. 44 depicting an adhesive pattern.

FIG. 47 shows a rear view of the label device 1100 after removal from the liner 1120 (FIG. 46). As shown, a rear surface of the selectable label member 1102 and the selector label member 1104 have an adhesive material 1122 disposed thereon. Although FIG. 47 illustrates a predetermined pattern of adhesive material 1122, other variations of patterns may be utilized. A requirement for the pattern of adhesive material 1122 is that the selectable label member 1102 must be permanently affixed. An additional pattern adhesive requirement is that the back of the selector label member be adherable to the front surface of the selector label member when mounted on the container so as to form a continuous loop around the container, the loop being easily rotatable once the device is activated. Another requirement for the pattern of adhesive material 1122 is that when the device is mounted on the container, a portion including adhesive on the back of the selector label can be made to contact the release coating on the front surface of the selectable label member. And also that a portion including adhesive on the back of the selector label can be made to contact the release coating on the front surface of the selector label member. Although not strictly necessary to produce the device 1100, in the depicted example, the selector label also includes hinged 1124 pull tab extensions 1126. The pull tab corners include adhesive material 1122 for permanent affixing and include structural perforations 1128 for releasing the pull tabs after the selector label is mounted on a container.

Turning back to FIGS. 42 and 43, depicted is a method for applying the label device 1100 to the pharmaceutical container C5. This method has a single step application wherein the device is wrapped around the container C5 and affixed thereto by adhesive material located on the device rear surface. In a procedure similar to that described in previous embodiment 900, from the position shown in FIG. 42, the device labels are wrapped around the container C5 to the final position shown in FIG. 43. Such wrapping causes the adhesive selectable label member and the adhesive portions (the corners) on the pull tab extensions to be permanently fixed to the container. Such wrapping also causes the last applied end including a security tab extension 1134, of the selector label to overlap the first applied end of the selector label. A portion of the overlapping end adheres to overlapped portions of the selector label as well as to a portion on the front surface of the selectable label. Since an adhesive portion of the overlapping adhesive end contacts a non-release portion 1132 (not release coated) on the front surface of the selector label, the selector label member is formed into a permanent continuous loop. The remaining adhesive overlapping portions, being located on release surfaces, are repeatedly unadherable from and readherable to those release surfaces.

To activate the device, the pull tab extensions are lifted to fold on their hinges, breaking the links with the selectable label at the attachment points 1106 and 1108 and releasing the pull tabs from the adhered corners at the perforations 1128. Additionally, lifting the security tab from the release-coated surface of the selectable label frees the selector member to rotate around the container. The selectable label limits downward longitudinal displacement of the movable label member. Pressing down the security tab adherably engages the tab and secures the movable member at the selected position. Operation of the device is similar to that previous described in embodiment 1000. When medication is taken, the security tab is lifted to release or disengage it from the selectable member. The selector is then moved or rotated around the container to locate the next-dose pointer at a selected position, and the security tab is pressed down to adherably and securely select the new position. The pull tabs may be gripped and moved in the direction of wanted rotation to assist those having difficulty rotating the selector label otherwise.

Since breaking the attachment links on the label members irreversibly alters the mounted device as initially presented and by association irreversibly alters any package or container including the device as initially presented, such alteration can be used as an indication of tampering. It should be noted that while it is advantageous to apply the device to the container in a single step, the method can easily be varied to apply either the selector member or the selectable member first and the remaining member next following a procedure similar to that described.

Figure 48:
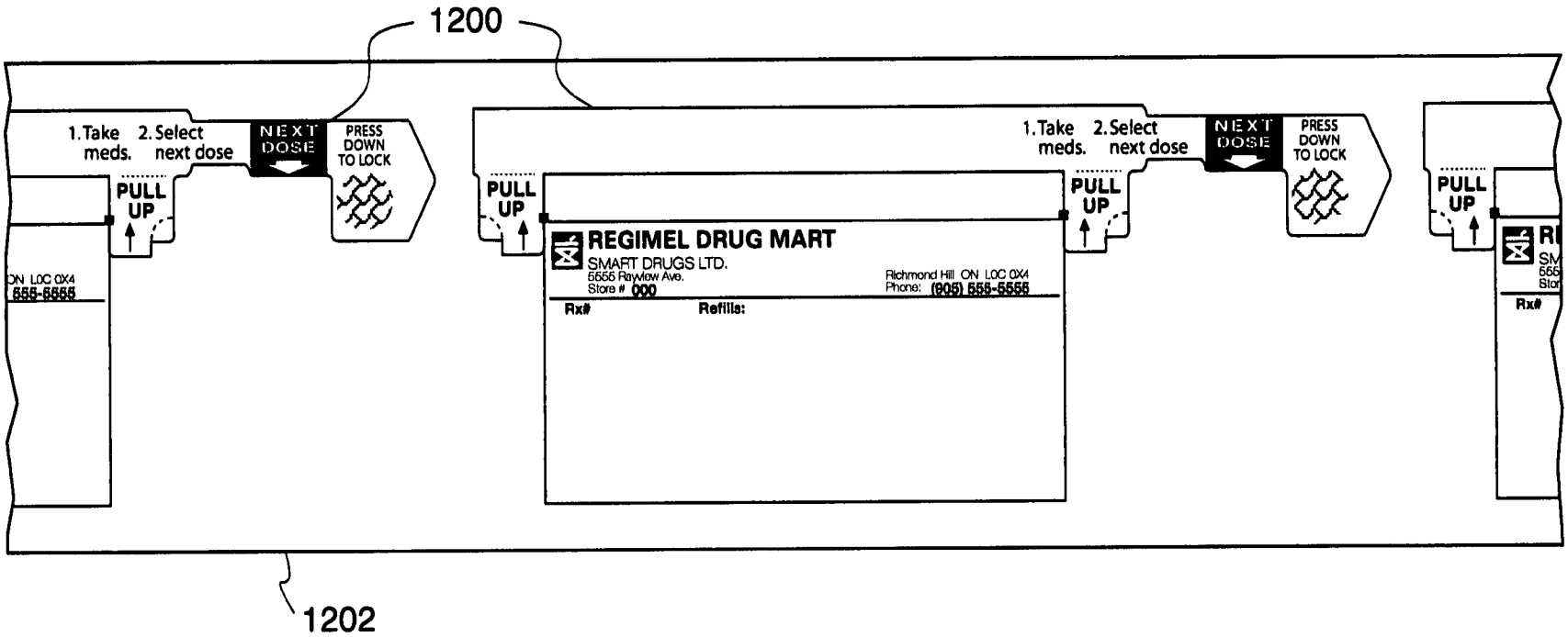
FIG. 48 is a front view of a continuous strip containing multiple label devices.

FIG. 48 depicts an additional ninth embodiment of the invention wherein multiple label devices (collectively denoted 1200) are arranged on a continuous strip 1202. The continuous strip 1202 may be formed into a roll or folded in an accordion-style stack. The label devices 1200 may be fed sequentially into a specialized printer configured to print the desired indicia onto the device labels. Placing the label devices on a continuous strip may facilitate automated printing and application of the devices to pharmaceutical containers. Although not shown, the continuous strip includes a top sheet containing the label devices and a release liner removably attached to the top sheet.

Figure 49:
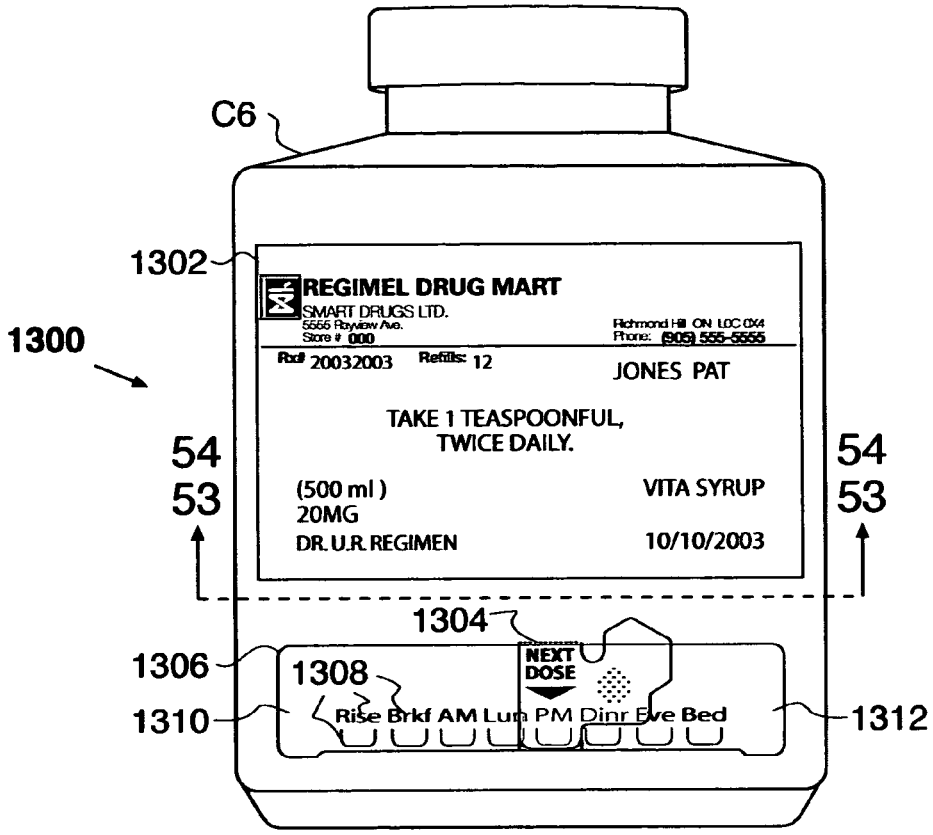
FIG. 49 is a perspective view of embodiment 1300 of the invention. In this example, an adherable support or rail member retentively engages a movable selector. The selector slides along the rail to each of a plurality of selectable positions. The reminder device is shown assembled on a typical medication container bearing a traditional pharmacy prescription label.

FIGS. 49 through 60 depict an additional tenth preferred embodiment 1300 of the reminder device made according to the invention. Shown in the perspective view of FIG. 49, is a typical pharmacy dispensing label 1302 and the reminder device 1300 attached to a front sidewall surface of a suitable pharmaceutical container C6. The device includes a movable first member 1304, which acts as a selector or pointer. The movable member forms a continuous loop, which is retentively engaged by a cooperating selectable support or rail second member 1306 in the device. The movable member is repositionable to each of a plurality of selectable positions by sliding the movable member along the rail. The selected position may be adherably secured. The selectable support member includes adherable means for attaching the device 1300 to the container. The support member further includes a customizable schedule 1308 comprised of dosage time periods arranged in a row such that each time period is individually selectable by the selector. The schedule may be customized prior to or after attaching the selectable member to the container. Preferably either the movable member or both the movable and selectable members are transparent or translucent. Preferably the device is held on the side of the container by permanent attachment of opposing (left and right) end portions 1310 and 1312 of the selectable support member to the container. Attachment of only a single end portion of the support member or attachment to other suitable locations (ex. cap) of the container will still allow the device to operate correctly. While it might be esthetically pleasing and preferable to orient the device vertically or horizontally on the container, such orientation is not required for the device to work. The reminder device is therefore suitable for attachment to virtually all cylindrical and non-cylindrical containers as well as attachment to articles of almost any size and shape. It should be noted that elimination of the need to rotate a device member around a variety of containers, each possibly having a different circumference and therefore needing a different size endless or continuous loop member, permits establishment of a single-sized device with common operating characteristics for all containers.

Figure 50:
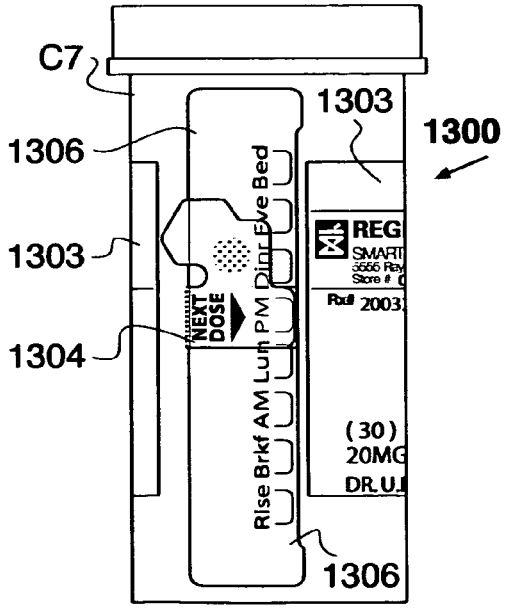
FIG. 50 is a planar view of the front of the device 1300 mounted vertically on a curved sidewall of a prescription vial.

FIG. 50 is a planar view of the side of a cylindrical pharmacy vial C7 showing a prescription label 1303 and the reminder device 1300 affixed to the curved outside surface of the container wall. The deformable device members, the selectable schedule member 1306 and the movable selector member 1304 are shown deforming to the curved wall.

Figure 51:
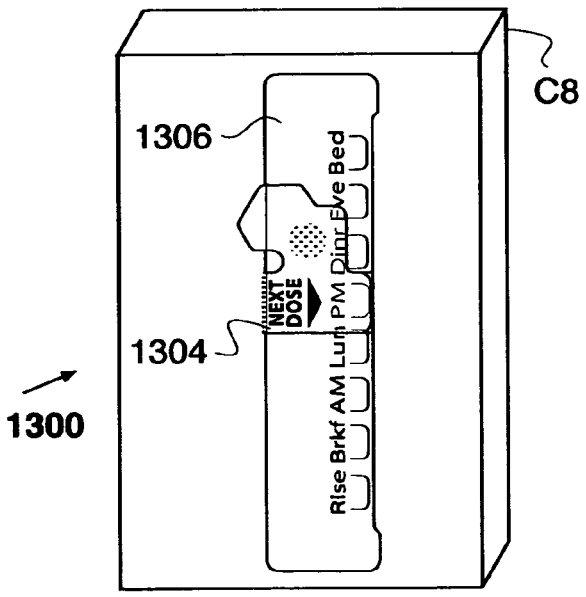
FIG. 51 is a perspective view of the device 1300 mounted on a flat wall of a folding carton.

FIG. 51 is a perspective view of the device 1300 affixed to the surface of a folding carton C8 typically found in the pharmacy and which may contain blister carded tablets or capsules or equivalent. The depicted device is not dependent on container rigidity for correct operation. The device may also therefore be attached to a non-rigid article or container such as a flexible pouch or bag.

Figure 52:
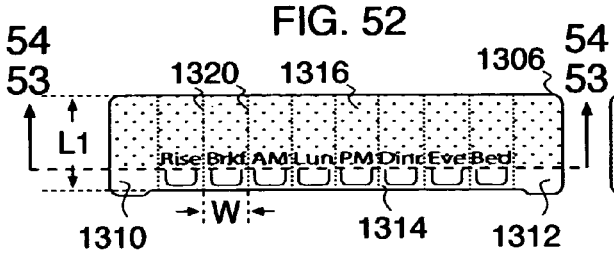
FIG. 52 is a planar view of the front of the selectable rail member of the device of FIG. 49.

FIG. 52 depicts the front of the selectable support member 1306. The selectable member includes opposing left and right end portions 1310 and 1312 separated by a vertically narrower middle portion 1314 having a vertical length equal to L1. The front surface (preferably) of the selectable member includes suitably produced schedule indicia 1308 (FIG. 49). The front surface further includes a predetermined pattern of release material 1316 indicated by the shaded area. As best seen in the segmented cross-sectional bottom view of FIG. 53, the selectable member structure further includes a series of preferred standoffs or spacers comprised of raised lines or bumps 1318 resulting from vertical creases or scores 1320 separating the indicia. The horizontal length between score lines is equal to W. The scores are produced by a method known in the art, such that the standoff bumps 1318 are created on the back or underside of the selectable member as mounted on the front of the container C6. It is to be appreciated that such standoffs may be otherwise produced as is known in the art. In addition to facilitating assembly (later described) of the selector member 1304 with the selectable member 1306, the raised lines 1318 act as détentes or stop members hindering inadvertent sideways displacement of the retentively engaged selector 1304. It is to be considered that other suitable patterns of scores or even perforations or other means may be employed to influence the behavioral characteristics of the rail member. It should be noted that while preferable, standoffs and/or détentes are not strictly necessary to produce the device.

Figure 53:
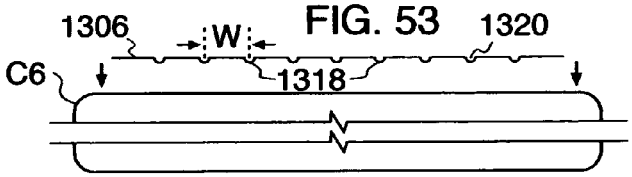
FIG. 53 is a segmented cross-sectional bottom view of the selectable rail member of FIG. 52 as it is being mounted on the container of FIG. 49. Shown are raised lines or bumps on the back of the selectable member as produced by scoring.
Figure 54:
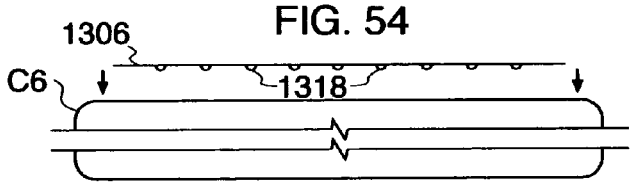
FIG. 54 is a segmented cross-sectional bottom view of the selectable rail member of FIG. 52 as it is being mounted on the container of FIG. 49. Shown are the raised lines or bumps on the back of the selectable member as produced by tactile or thermographic ink.

FIG. 54 depicts the standoff bumps 1318 produced by an alternative means, as seen in a view like that of FIG. 53. The back of the selectable member includes a pattern of tactile material producing the raised areas on the selectable member surface. It is to be considered that for some applications, it may be advantageous to include a different standoff pattern, or to substitute or add raised standoffs or bumps, however produced, on the front surface of the selectable member.

Figure 55:
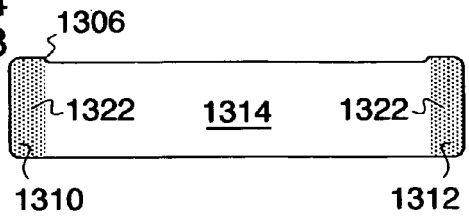
FIG. 55 is a planar view of the rear of the selectable rail member of FIG. 52.

FIG. 55 depicts the rear surface of the selectable support member 1306. The rear surface of the selectable member carries a predetermined pattern of adhesive material 1322 restricted to the opposing left and right ends 1310 and 1312. The adhesive serves to adhere the selectable member to the container or stated otherwise, to adhere the container to the selectable member. The adhesive is preferably a permanent pressure-sensitive material. Other patterns of adhesive material will work so long as the movable member, after assembly with the support member, is movable to each of the required schedule positions. It is to be considered that the support member, as previously indicated, need not strictly be adhered to the container at two attachment points in order for the device to operate correctly. Adhesive material located at only one end of the support member will work in many applications and may even be preferable when the device is to be mounted over indicia (ex. onto a product label). The unadhered portion of the device may be lifted from occluded indicia to access the information.

Figure 56:
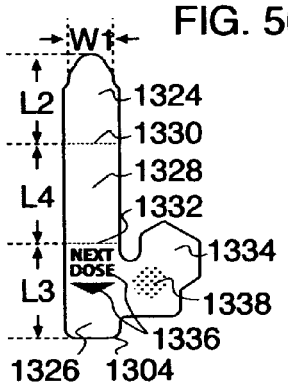
FIG. 56 is a planar view of the front of the selector member of the device of FIG. 49.

FIG. 56 depicts the front surface of the movable selector member 1304. The movable member includes a vertical section comprising a rounded tip, the tip having a maximum horizontal length W1 that is slightly shorter than length W of the selectable member. The tip fits easily between adjacent standoff bumps on the back of the selectable member to facilitate assembly of the two members. The vertical section includes a first end portion 1324 having a vertical length L2, an opposing second end portion 1326 having a vertical length L3 and a middle portion 1328 having a vertical length IA separating the two end portions. First and second horizontal graphic demarcation lines 1330 and 1332 which preferably include structural score lines (or sets of perforations), respectively separate the first end portion from the middle portion and the middle portion from the second end portion. Length L4 is slightly longer than length L1 of the selectable member. Length L2 is slightly shorter than length L4, and length L3 is preferably shorter than length L4. A security tab extension 1334, including anti-displacement means is located adjacent to the second end portion 1326, and also acts as a grip tab, providing a convenient area for gripping the movable member to move the member. The selector acts as a next-dose pointer in the device and is so designated by indicia 1336 suitably produced on the front surface (preferably). Additional indicia 1338 on the front surface of the selector may provide other information (ex. a symbol or text such as "PRESS HERE TO LOCK") as required.

Figure 57:
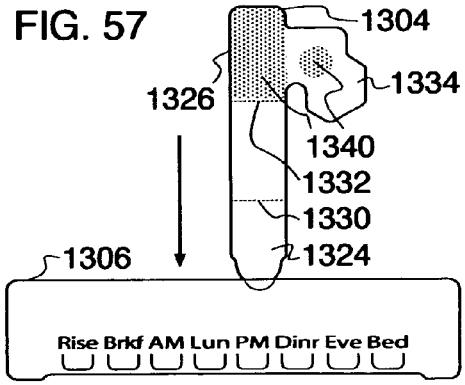
FIG. 57 is a planar view of the rear of the selector member and the front of the selectable member of the device of FIG. 49 showing commencement of assembly of one with the other.

FIG. 57 depicts the rear of the movable member 1304 and the front of the selectable member 1306. The tip at the first end portion 1324 of the selector is shown positioned behind the selectable member for assembly of one member with the other. In the preferred method, the selectable member is affixed to the container prior to assembly with the movable member, however the two members may be assembled together prior to affixing the selectable member to the container. The rear of the movable member includes a predetermined pattern of preferably permanent pressure-sensitive adhesive 1340 located as shown by the shaded areas on the second end portion 1326 and the security tab extension 1334. The adhesive pattern is judiciously applied to assure that when the selector is formed into a continuous loop around the selectable member (i.e. intersects the selectable member), the adhesive areas only contact the folded first end portion 1324 of the selector and only contact the release coated area 1316 of the selectable member.

To activate the device it is necessary to first assemble together the two members 1304 and 1306. To assemble the two members, the movable member is moved down behind the selectable member from the position shown in FIG. 57 to the position shown in FIG. 58, such that the scored lines 1332 and 1330 in the movable member appear outside the upper and lower perimeters of the selectable member. From the position shown in FIG. 58, the movable member is then formed into a continuous loop around the selectable member as follows. The first end portion 1324 is folded forward and down to rest on the front surface of the selectable member. The second end portion 1326 is folded forward and down onto the first portion. Sufficient pressure is applied to the second end portion so that the adhesive on the back of the second portion can take its desired effect The first and second portions are thus bonded together, forming the selector into the desired continuous loop around the selectable member as best seen in the enlarged side cross-sectional view of FIG. 59 and the assembled front view of FIGS. 60. When formation of the continuous loop is completed, the adhesive on the back of the security tab extension 1334 is located on the release area 1316 of the front surface of the selectable member 1306. Pressing down on the security tab causes the movable member to be secured at a selected position by way of the adhesive on the back of the tab and hinders inadvertent displacement. That is, the security tab is adhered to the rail member or stated otherwise, the rail member is adhered to the security tab. The tab may of course be repeatedly disengaged from and readhered to the release surface. Operation of the device is comparable to that of embodiment 1100. When medication is taken the security tab is lifted to disengage it from the selectable member, the selector is moved by sliding along the rail to align the pointer with the next appropriate time period, and the security tab is pressed down to adherably secure the selected position. It is to be appreciated that those skilled in the art may vary the effectiveness of stops or détentes by adjusting the spatial and physical relationship between the movable member and the selectable member. For example, the raised lines or bumps in the selectable member may provide increased resistance to sideways displacement of the moveable member (i.e. the loop) if the middle portion 1328 of the movable member is constructed with a slightly smaller horizontal length than length W of the selectable member. It is also to be appreciated that the movable member may further include additional scores, perforations and other structural elements to impart desirable operational characteristics to the member. While it is preferable that the next-dose pointer be moved to make a desired selection, the pointer member could of course be held stationary while a cooperating member (ex. the container along with the attached rail) is moved relative to the pointer, to make a selection.

Figure 61:
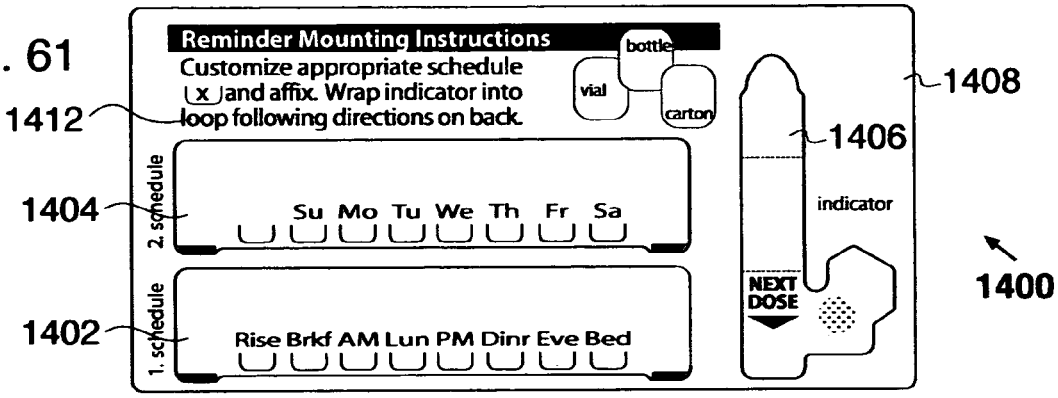
FIG. 61 is a front view of embodiment 1400 of the invention showing the reminder device presented in kit form on a label sheet.
Figure 62:
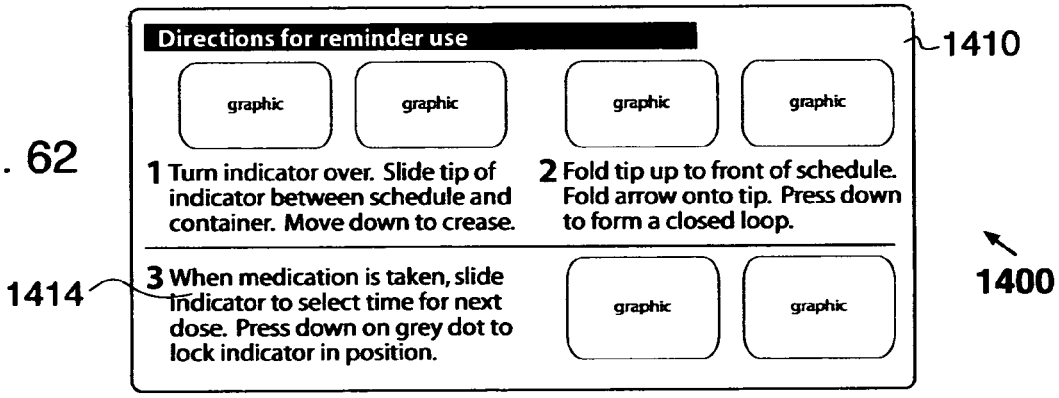
FIG. 62 is a rear view of the reminder device kit of FIG. 61 showing the printed rear of a liner sheet on which a label sheet is held.

FIGS. 61-62 depict an additional eleventh embodiment 1400 of the invention wherein the reminder device is presented as a reminder kit on a convenient label sheet. The sheet is suitable for inclusion inside a carton or for attachment to the outside of a container. Linking of the members to a common label sheet facilitates handling (ex. packing all members inside a carton). The sheet may also be sold separately or be given to a consumer for device application. Alternatively a pharmacist may choose to apply the device from the presented kit format The device is preferably produced on a transparent sheet, but a non-transparent sheet will work just as well in many applications. Like label reminder device 1100 the present embodiment 1400 may be formed as part of a standard-sized label sheet (or label roll) of convenient size for printing by any suitable means. Preferably multiple copies of the device presentation (i.e. the kit) are produced on a sheet or roll, with die-cut lines or equivalent being provided to define the peripheries of the device members and permit their separation from a release liner of the label sheet It is to be appreciated that breakable attachments at points (not shown) as are known in the art may further be included at the peripheries of the device members linking the device members to the surrounding sheet. Sufficient attachments may be employed as may be necessary to achieve desirable handling performance of the label sheet and the device members. Individual or separable multiples of the single kit presentation depicted in FIG. 61 may then be offered for sale. Except for the differences in indicia on their front surfaces, a first and second selectable schedule member 1402 and 1404 in the present embodiment are identical to the selectable member 1306 in embodiment 1300 of the invention. The selectable members are sufficiently customizable to address the overwhelming majority of possible dosage regimens. Marking or inscribing the scheduling indicia by pen or marker or other suitable means customizes the schedule. The selector or indicator member 1406 in the present embodiment is identical to the selector 1304 in embodiment 1300 of the invention. The general remainder 1408 of the sheet surrounding the device members 1402, 1404 and 1406 includes a coating of adhesive material on its rear surface (not shown) retaining the sheet on the release liner, the rear of which is shown in FIG. 62. The front surface of the sheet may further include descriptive or instruction indicia 1412. The back surface of the release liner may include further descriptive or instruction indicia 1414. After selecting the most appropriate schedule for customization, the remaining schedule may be discarded. As in previous embodiments, customization may be similarly performed either prior to or after attachment of the selectable member to a container. Like that of embodiment 1300, attachment at a suitably convenient location on a container is similar to any standard adhesive label. Activation including assembly of the selector with the selectable member as well as operation of the device 1400 is the same as in previous embodiment 1300. It is to be appreciated that the illustrations show an exemplary arrangement of selector and cooperating selectable member on a release liner for manual assembly. Many other arrangements are of course possible. It will readily become apparent to those skilled in the art that known equipment could be adapted to automate the assembly of a selector with a cooperating member. The reminder device could then be provided as partially or fully assembled for manual or automated application to an article.

Figure 63:
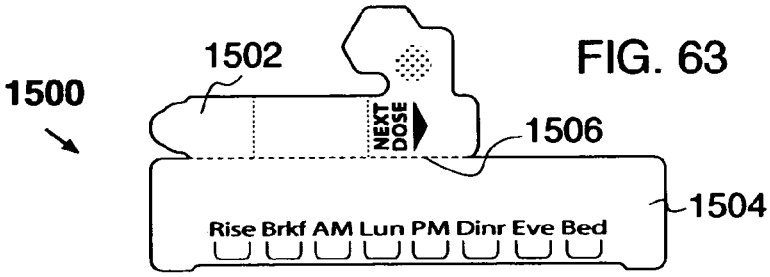
FIG. 63 is a front view of embodiment 1500 of the invention showing a selector and a selectable member coupled to permit application of the device in a single step.

FIG. 63 depicts an additional twelfth embodiment 1500 of the invention wherein selector 1502, being similar to the selector 1304 of the previous embodiment 1300 and selectable member 1504, being similar to the selectable member 1306 of the previous embodiment, are coupled along a structural perforation line 1506. This embodiment enables the device 1500 to be applied to a suitably prepared container in a single step as later described.

Figure 64:
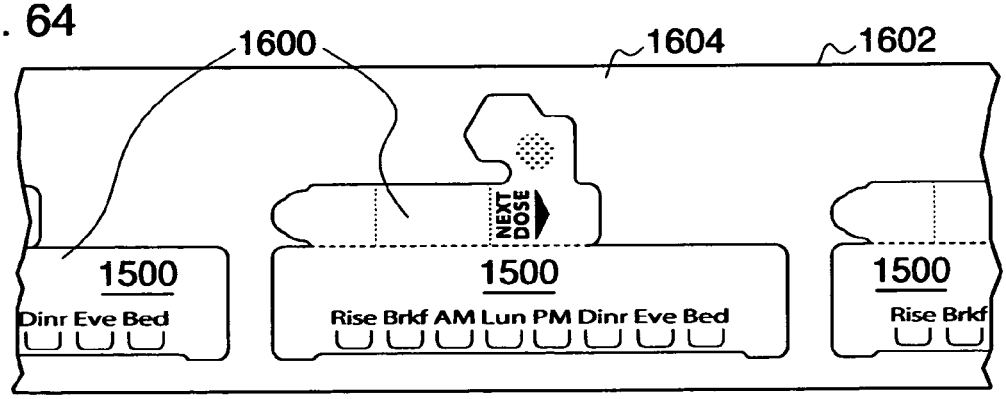
FIG. 64 is a front view of embodiment 1600 of the invention showing multiple devices like that of FIG. 63 arranged on a continuous strip.

FIG. 64 depicts an additional thirteenth embodiment of the invention wherein multiple devices like that of 1500 (collectively denoted 1600) are arranged on a continuous strip 1602. The continuous strip 1602 may be formed into a roll or folded in an accordion-style stack. The label devices 1600 may be fed sequentially into a specialized printer configured to print the desired indicia onto the device labels. Placing the label devices on a continuous strip may facilitate automated printing and application of the devices to suitably prepared pharmaceutical containers. The continuous strip includes a top sheet 1604 containing the label devices and a release liner removably attached to the top sheet. The devices on the strip may further or entirely be processed manually as previously described.

Figure 65:
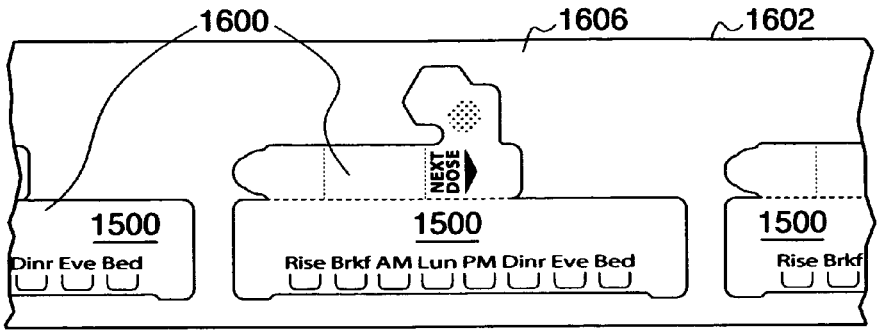
FIG. 65 is a front view like that of FIG. 64 showing a release liner after a remainder of the top sheet around the reminder devices has been removed.

FIG. 65 depicts the strip of FIG. 64 after the top sheet surrounding the devices 1600 has been removed, exposing the release liner sheet 1606. In the presentation shown in FIG. 65 the devices may be applied to a suitably prepared container by high-speed commercial labeling equipment.

Figure 66:
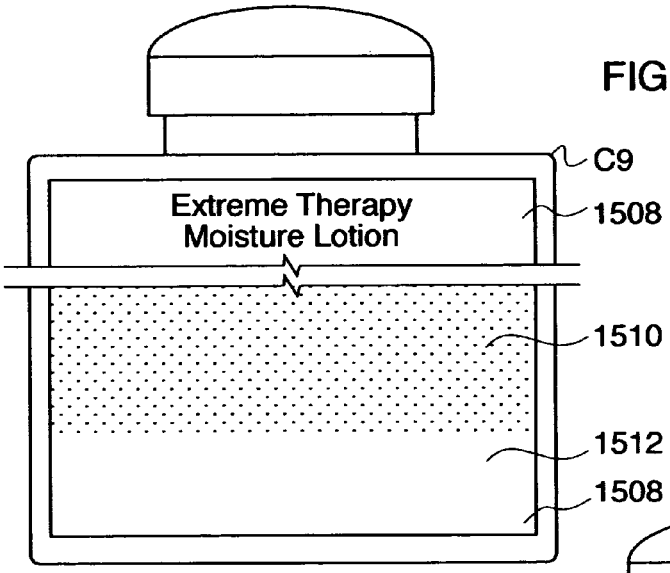
FIG. 66 is a segmented planar view of the front of a container including an attached label. The front surface of the label has been release coated in a predetermined pattern to receive application of the reminder device 1600 in a single step.
Figure 67:
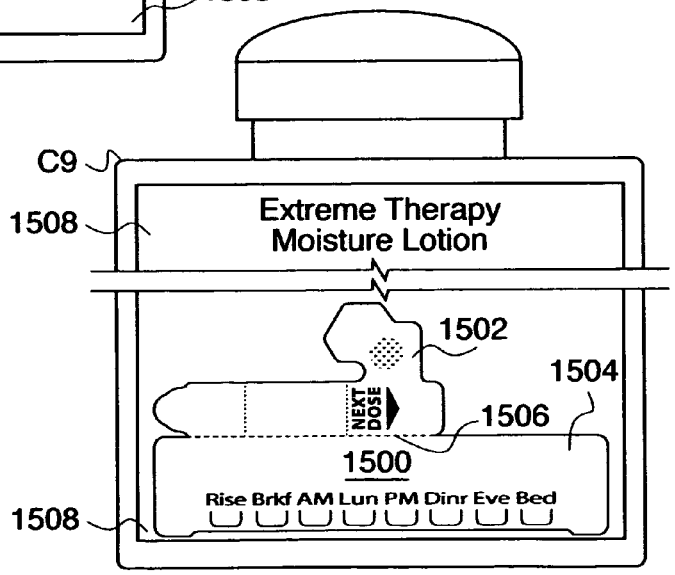
FIG. 67 is a segmented planar view of the front of the container and the attached label of FIG. 66 after the reminder device 1600 has been applied to the front surface of the label.

FIG. 66 depicts a segmented planar side view of the front of a suitable container C9 suitably adapted by an attached label 1508 to receive application of device 1600 in a single step. The front surface of the label 1508 includes an area, which is coated with release material 1510 (shaded) and an adjacent area 1512, which is uncoated by release material. The device 1500 is removed from the strip 1602 in a single step as is known in the art. The device 1500 is applied to the container in FIG. 66 in a single step as is known in the art such that the selectable member 1504 is applied onto area 1512 and the selector member 1502 is applied onto area 1510 as best seen in FIG. 67. To activate the device, the selector 1502 is first lifted from the surface of the label and uncoupled from the selectable member 1504 along the perforation 1506. All subsequent steps for activation and operation of device 1500 are the same as for device 1300 of the previous embodiment FIGS. 68 through 75 illustrate an additional fourteenth embodiment of the invention. Generally shown as 1700 throughout the figures, the reminder device includes three members, a cooperating selectable member 1702, a movable selector or next-dose pointer member 1704 and a support or rail member 1706. The members are all produced from adhesive label sheet stock, which may be put up in rolls for convenience. The rail member 1706 and the selector 1704 are preferably produced from a transparent film material. The selectable label member 1702 may be produced from either transparent or opaque material. One or more of the label members in the device 1700 may be formed as part of a standard-sized label sheet, in a manner similar to that of label sheet 1110 of embodiment 1000, with die-cut lines or equivalent being provided to define the peripheries of the label and permit its separation from a release liner of the label sheet The label sheet may then be inserted into a computer printer to enable printing of appropriate indicia onto the front surfaces of the label members. Alternatively, one or more of the label members in the device 1700 may be arranged in multiple on a continuous strip similar in manner to that of embodiment 1200, for sequential printing of suitable indicia onto the labels. The label members may be provided arranged for separate selective processing through the printer or provided arranged for collective processing (ex. single pass) of more than one label member in a given device through the printer.

Figure 68:
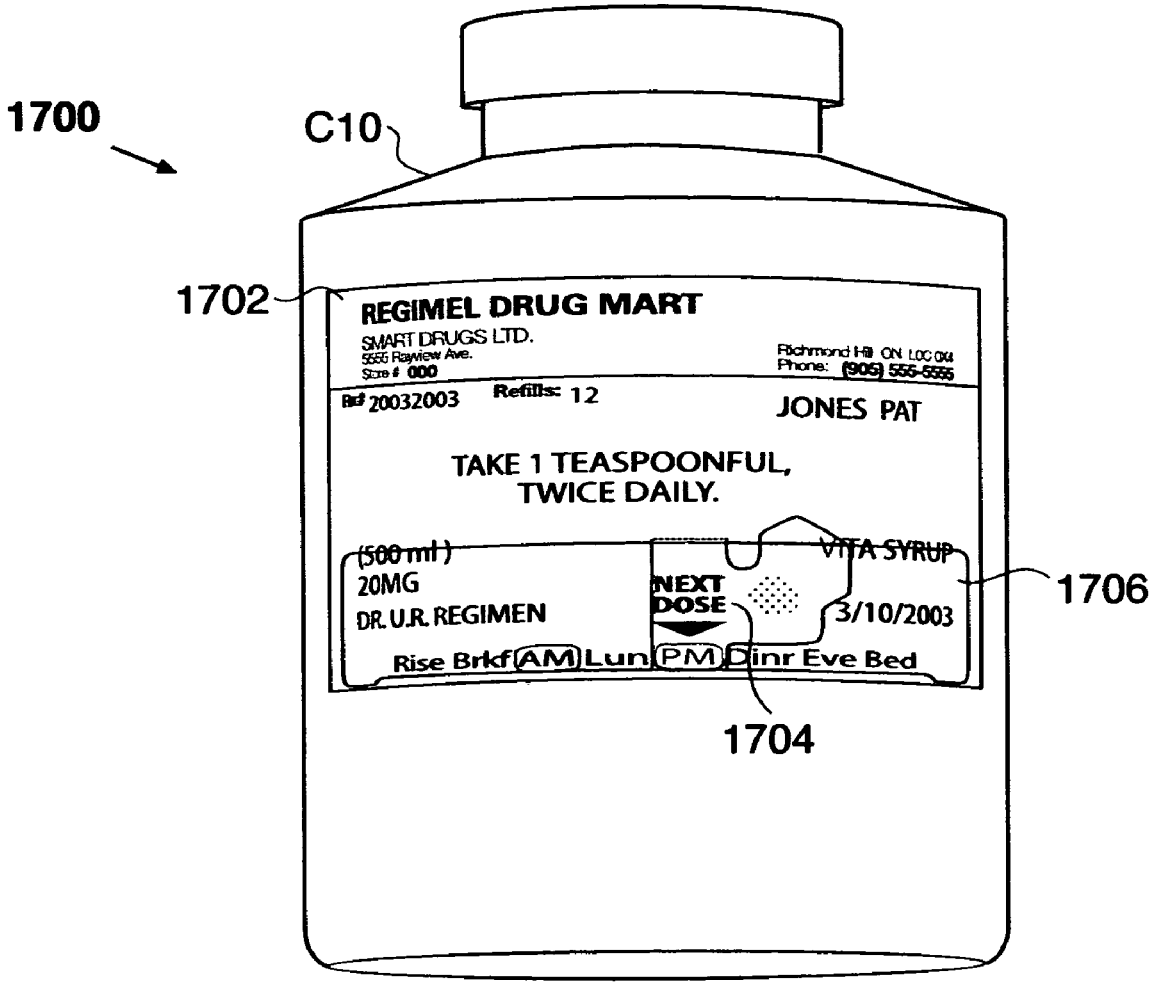
FIG. 68 is a perspective view of embodiment 1700 of the invention showing a selector, a support rail, and a cooperating pharmacy schedule label in the reminder device on the side of a pharmacy container.

FIG. 68 is a perspective view of the device 1700 attached to a pharmacy container C10. The label members in the device are shown deformably held on the curved exterior wall of the container. The activated reminder (i.e. the movable member is engageably movable along the attached rail) shows the movable label member assembled in a loop around the rail label member.

Figure 69:
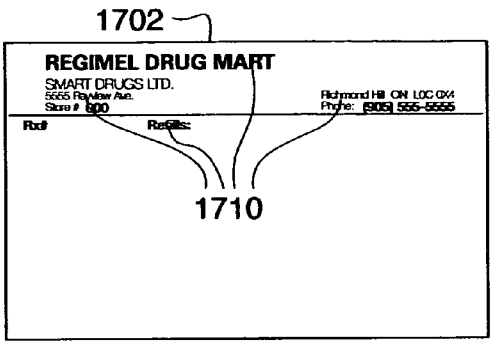
FIG. 69 is a front view of the pharmacy label in the device showing the preprinted indicia.
Figure 70:
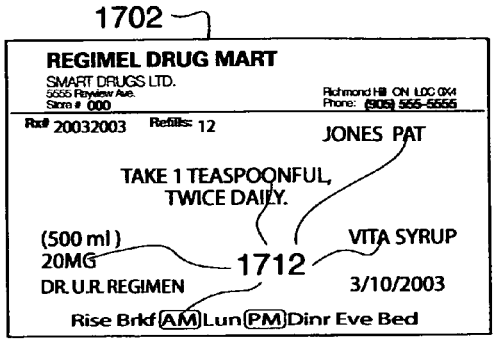
FIG. 70 is a front view of the pharmacy label in the device showing the custom printed indicia.
Figure 71:
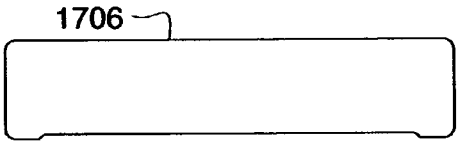
FIG. 71 is a front view of the blank support rail label in the device.

FIGS. 69-75 depict the steps included in producing the device as depicted in FIG. 68. Prior to being affixed to the container C10, the pharmacy label 1702 including pre-printed indicia 1710 on the front surface as shown in FIG. 69 and including a coating of adhesive material on the back surface is passed through a computer printer to produce the custom printed indicia 1712 shown in FIG. 70. The transparent unprinted rail label 1706 depicted in FIG. 71 includes a pattern of adhesive on the back surface distributed like that of the support member 1306 in the embodiment 1300 of the invention.

Figure 72:
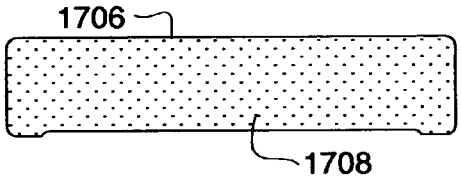
FIG. 72 is a view of a front surface of the rail label of FIG. 71 showing an overall coating of release material.
Figure 73:
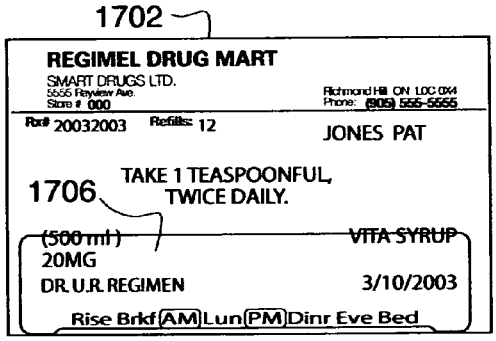
FIG. 73 is a front view of the rail label of FIG. 71 adhered to a front surface of the pharmacy label of FIG. 70.

FIG. 72 shows the entire front surface of the label 1706 covered by a coating of release material 1708. The rail label 1706 is affixed onto the pharmacy label 1702 in the position shown in FIG. 73, preferably after the pharmacy label has been affixed to the container C10.

Figure 74:
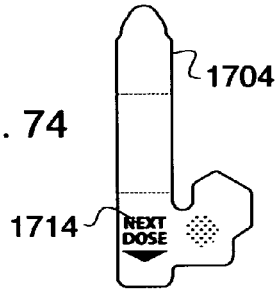
FIG. 74 is a front view of the selector label in the device prior to assembly with the rail label.

FIG. 74 depicts the front surface of the transparent selector label member 1704. Except for a change in the relative position of pre-printed indicia 1714 on the front surface of the member, the label member 1704 is identical to the movable selector 1304 in the previous embodiment 1300 of the invention. The manner of assembly of the selector label 1704 with the support rail label 1706 is the same as assembly of member 1304 with member 1306 in embodiment 1300.

Figure 75:
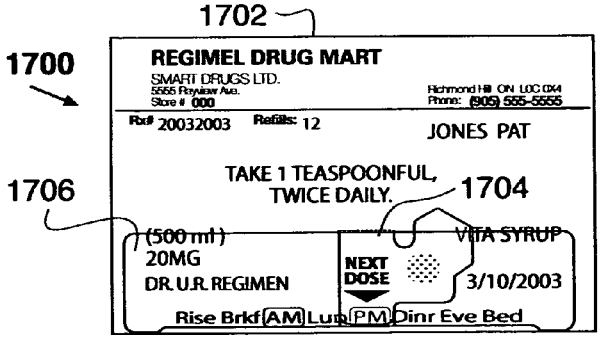
FIG. 75 is a front view of the selector label of FIG. 74 assembled with the rail label of FIG. 73.

FIG. 75 depicts the front of the assembled members in the device. In use, operation of the device 1700 is the same as operation of the device 1300.

FIGS. 76-79 depict one method for producing the custom printed adhesive pharmacy label 1702 in the present embodiment 1700 using a label sheet like 1110 and a suitable printer like that of previous embodiment 1100.

Figure 76:
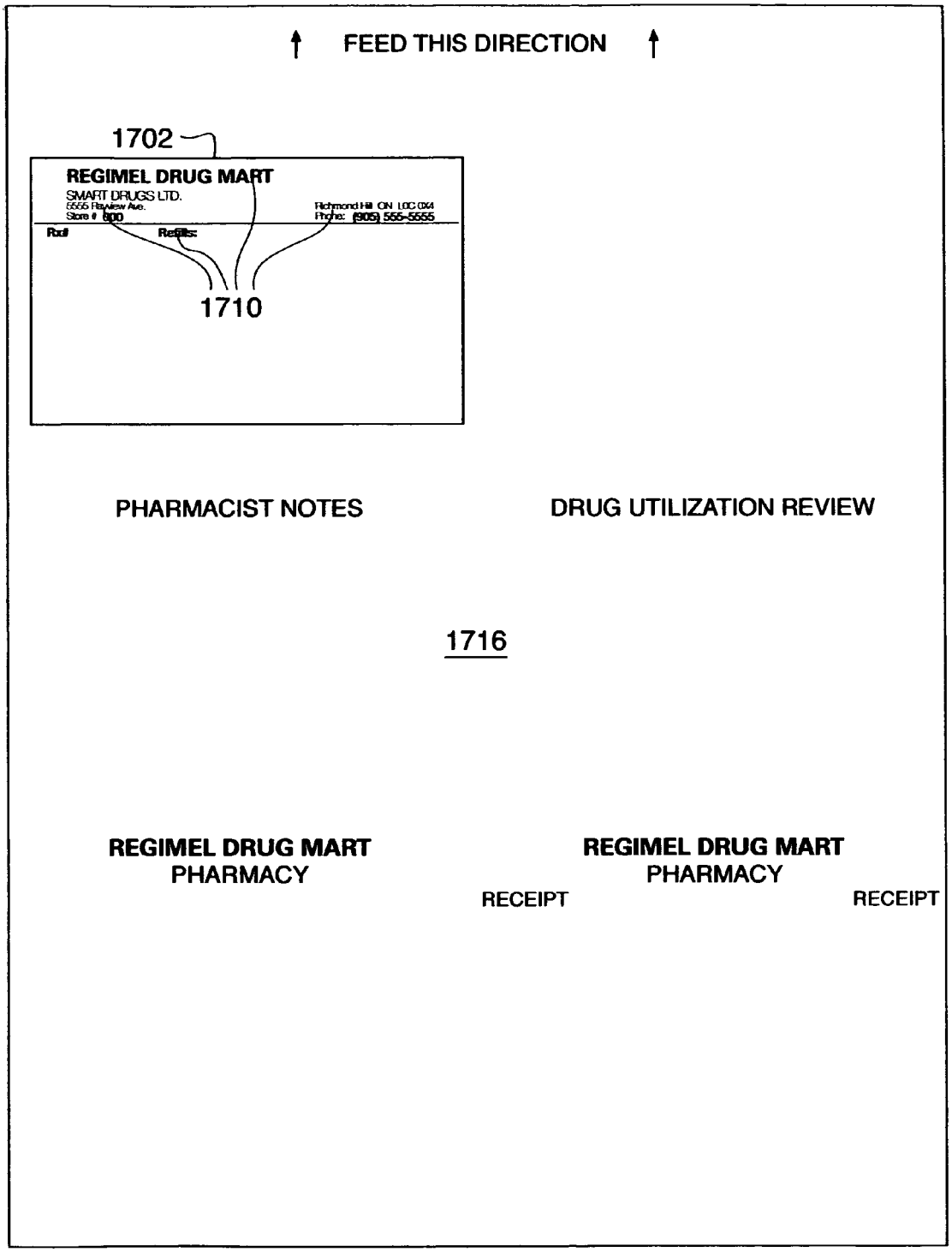
FIG. 76 is a front view of the front surface of the pharmacy label in device 1700 located on a label sheet, according to the present invention.

FIG. 76 depicts the pharmacy label member 1702 including pre-printed indicia 1710 formed as part of a standard-sized label sheet 1716, with die-cut lines or equivalent being provided to define the peripheries of the label and permit its separation from a release liner of the label sheet.

Figure 77:
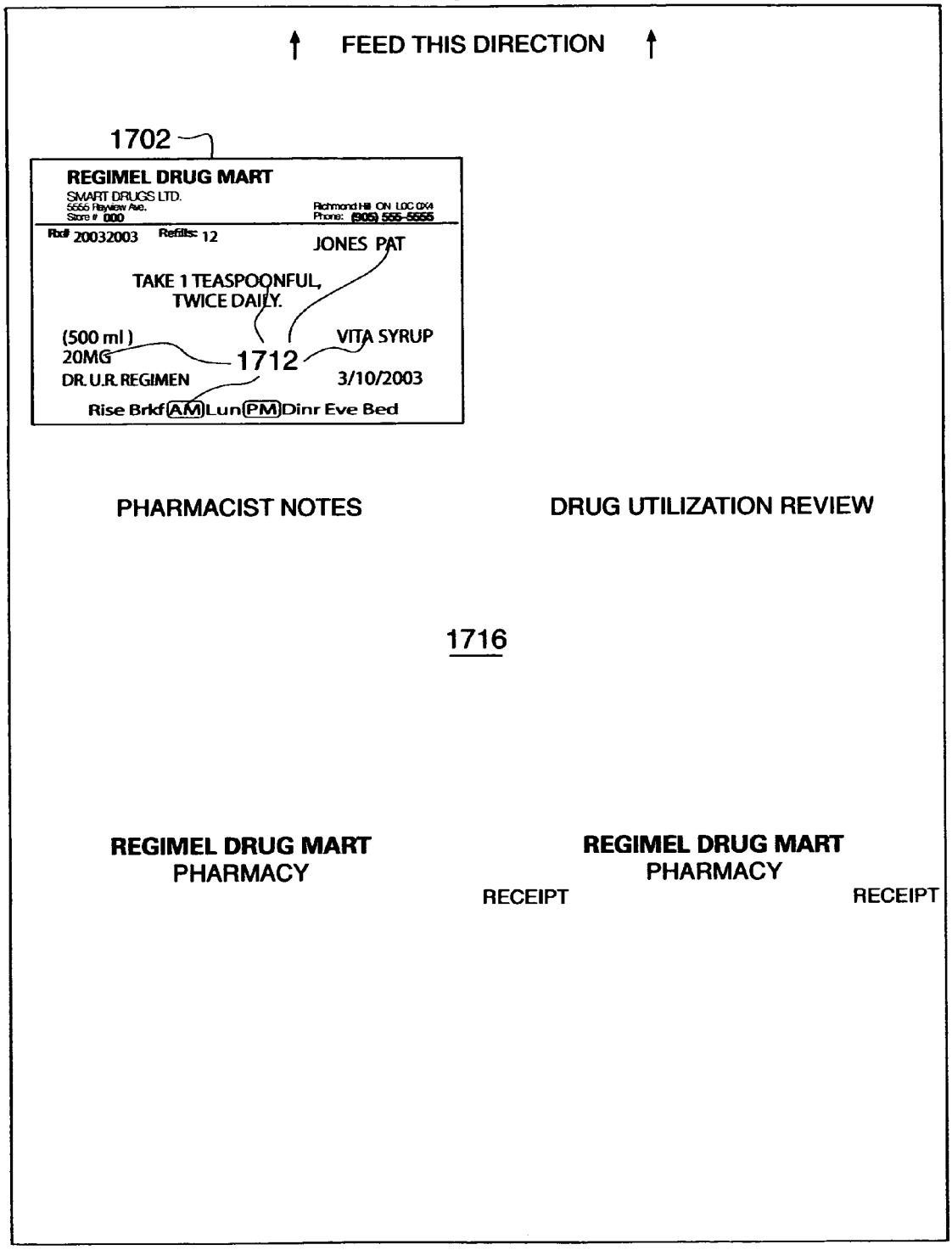
FIG. 77 is a front view of the pharmacy label of FIG. 76 with additional indicia printed thereon.

FIG. 77 depicts the pharmacy label member 1702 of FIG. 76 and contiguous label sheet 1716 after the custom patient indicia 1712 has been printed onto the front surface of the pharmacy label member.

Figure 78:
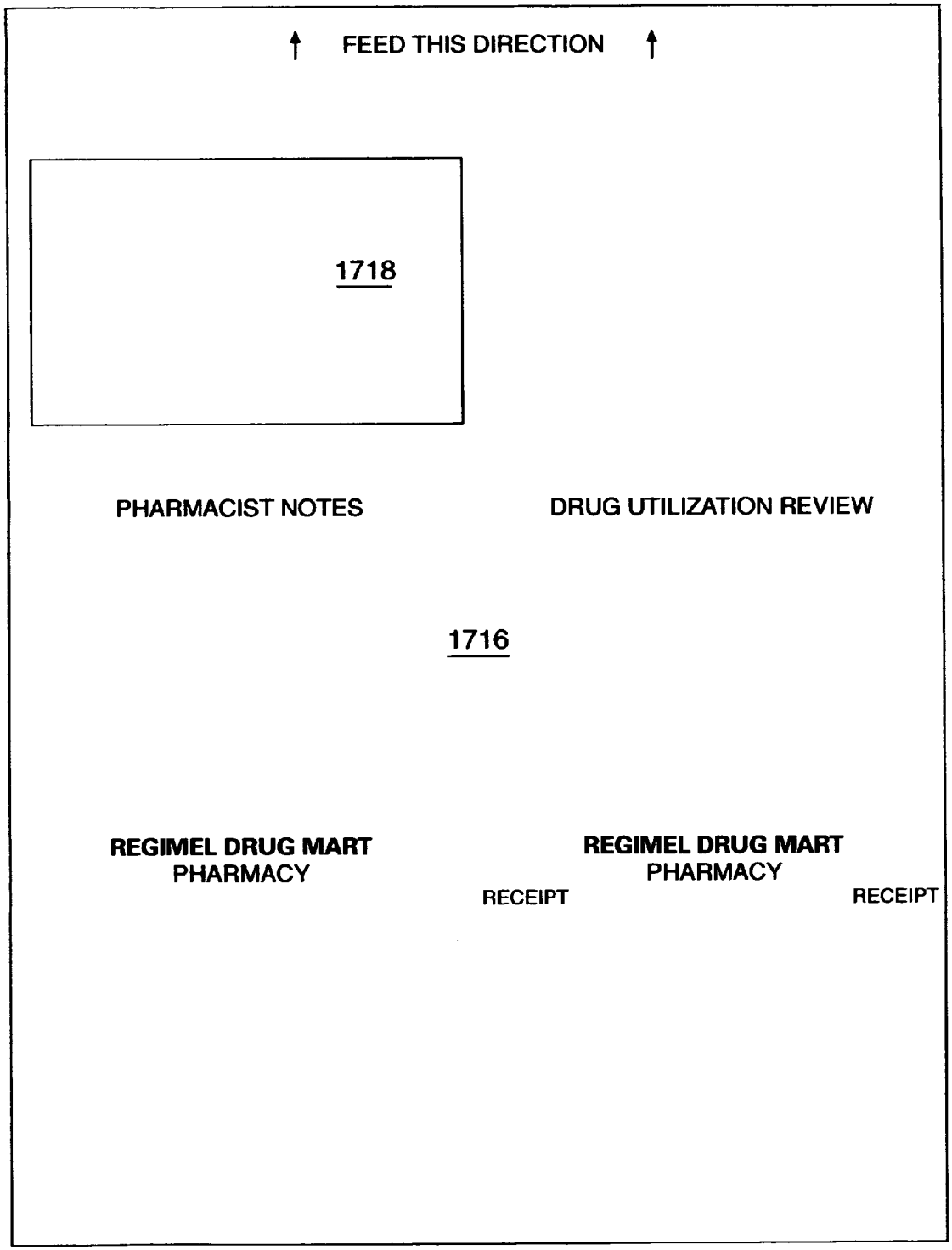
FIG. 78 is a front view of the label sheet of FIG. 76 after the pharmacy label has been removed.

FIG. 78 depicts the label sheet 1716 after the pharmacy label 1702 has been removed therefrom. A release liner 1718 is disposed adjacent to the rear surface of pharmacy label 1702 to allow the label to be easily separated from the remainder of the label sheet 1716.

Figure 79:
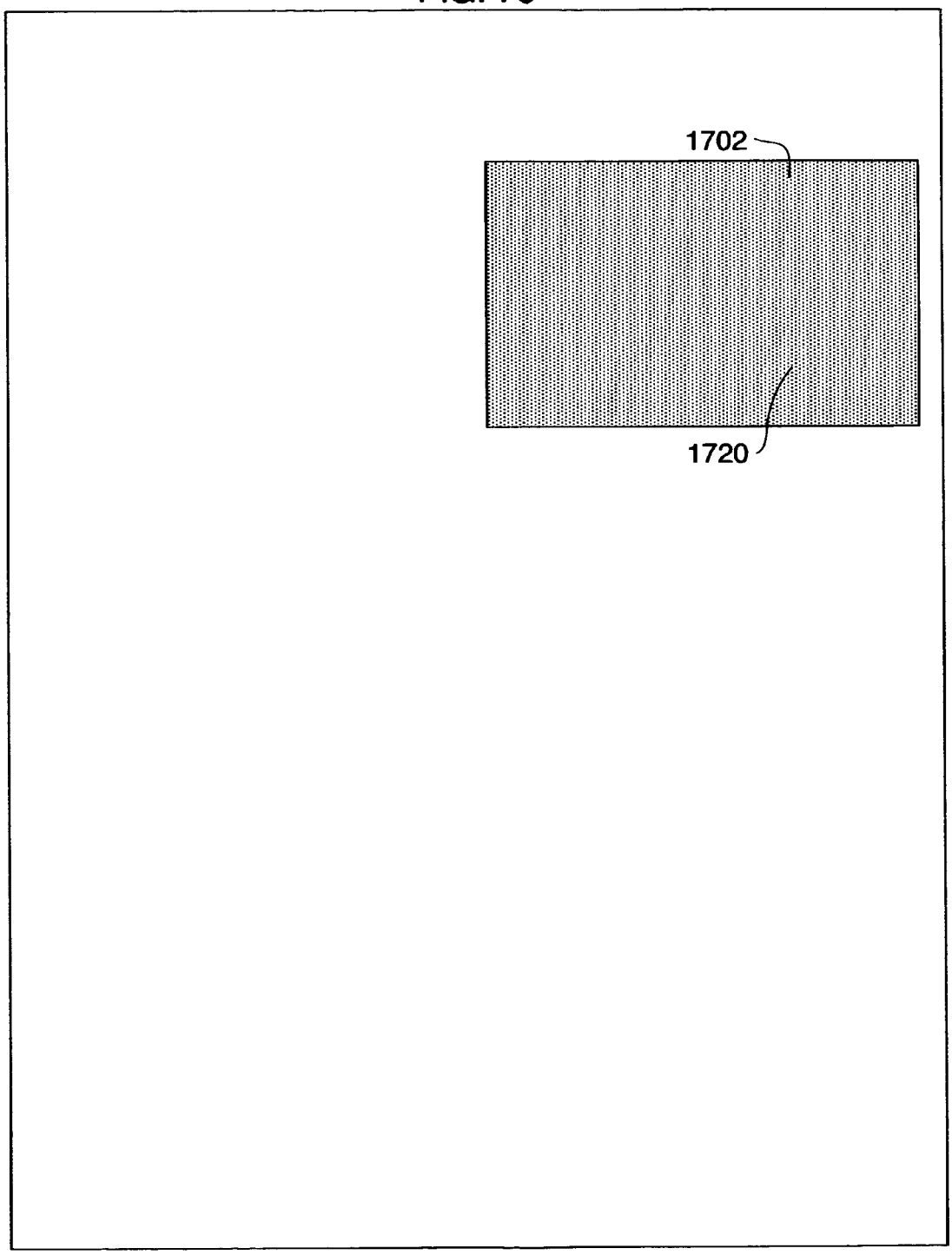
FIG. 79 is a rear view of the pharmacy label of FIG. 76 depicting an overall adhesive pattern.

FIG. 79 shows a rear view of the pharmacy label 1702 after removal from the liner 1718 (FIG. 78). As shown, a rear surface of the pharmacy label member 1702 has an adhesive material 1720 disposed thereon. Although FIG. 79 illustrates an overall predetermined pattern of adhesive material 1722, other variations of patterns may be utilized. A requirement for the pattern of adhesive material 1722 is that the pharmacy label member 1702 must be permanently affixed.

Figure 80:
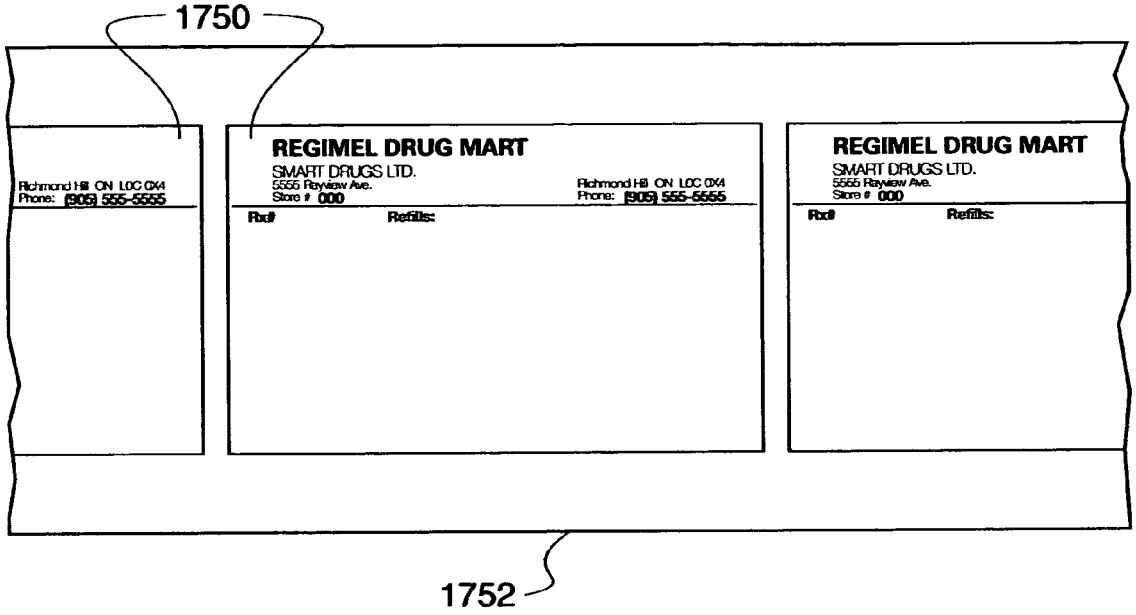
FIG. 80 is a front view of a continuous strip containing multiple pharmacy labels.

FIG. 80 depicts another method for producing the custom printed adhesive pharmacy label 1702 in the present embodiment 1700 wherein multiple pharmacy labels (collectively denoted 1750) are arranged on a continuous strip 1752. The continuous strip 1752 may be formed into a roll or folded in an accordion-style stack. The pharmacy labels 1750 which are linked for processing by the continuous strip, may be fed sequentially into a specialized printer configured to print the desired indicia onto the labels. Placing the labels on a continuous strip may facilitate automated printing and application of the labels to pharmaceutical containers. Although not shown, the continuous strip includes a top sheet containing the labels and a release liner removably attached to the top sheet.

FIGS. 81-84 depict one method for producing the movable selector label member 1704 and the rail label member 1706 in the present embodiment 1700 of the invention on a common sheet The same method may also be used to produce the movable member 1304 and a custom printed version of selectable member 1306 in the previous embodiment 1300 of the invention. The same method may also be used to produce the movable member 1502 and a custom printed version of selectable member 1504 in the previous embodiment 1500 of the invention. Although not shown, it is of course possible to produce all three label members in device 1700 on a common sheet.

Figure 81:
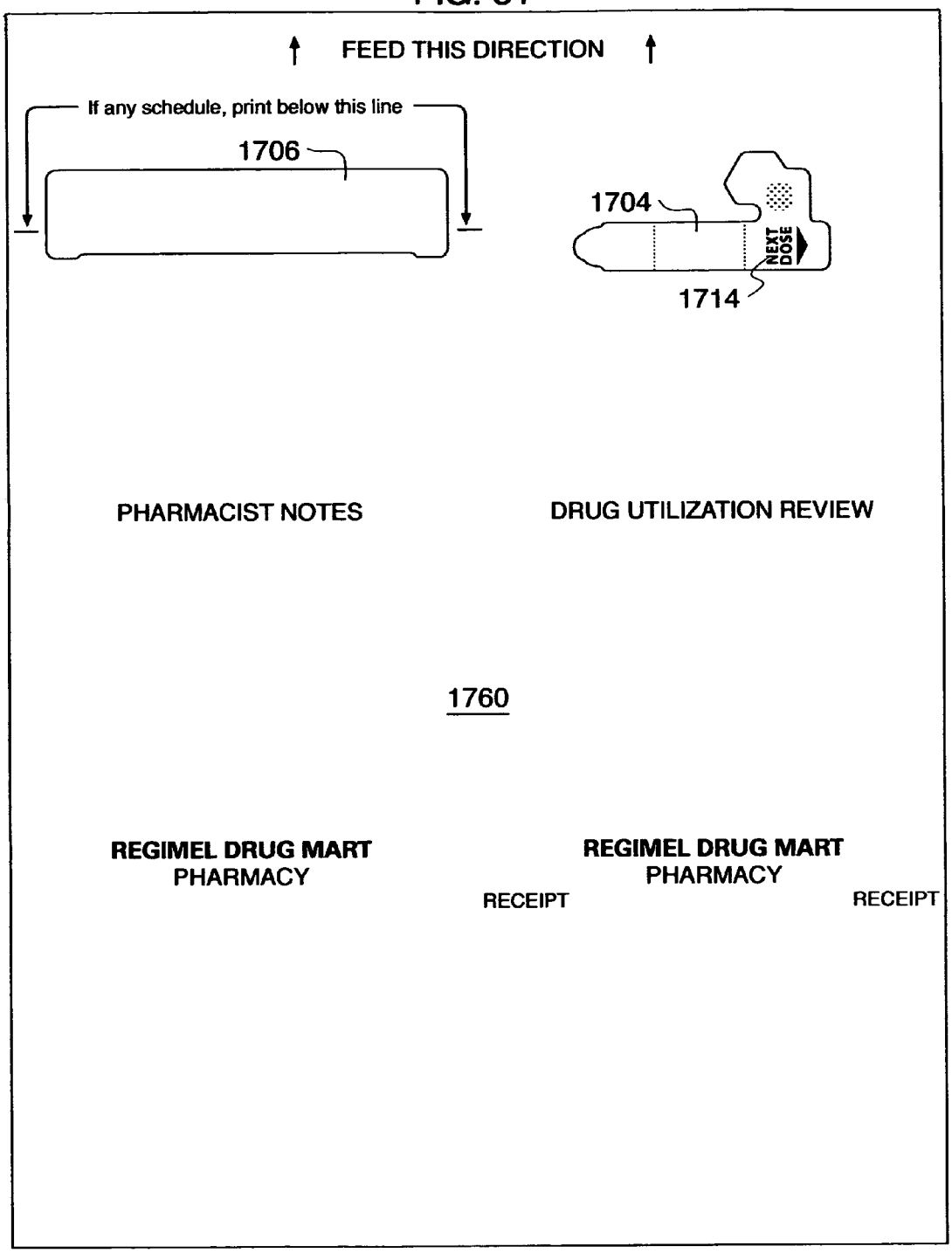
FIG. 81 is a front view of the front surface of the rail label and a front surface of the selector label in device 1700 located on a common label sheet, according to the present invention.

FIG. 81 depicts the selector label member 1704 including pre-printed indicia 1714 and the rail label member 1706, both formed as part of a common transparent standard-sized label sheet 1760, with die-cut lines or equivalent being provided to define the peripheries of the labels and permit their separation from a release liner of the label sheet.

Figure 82:
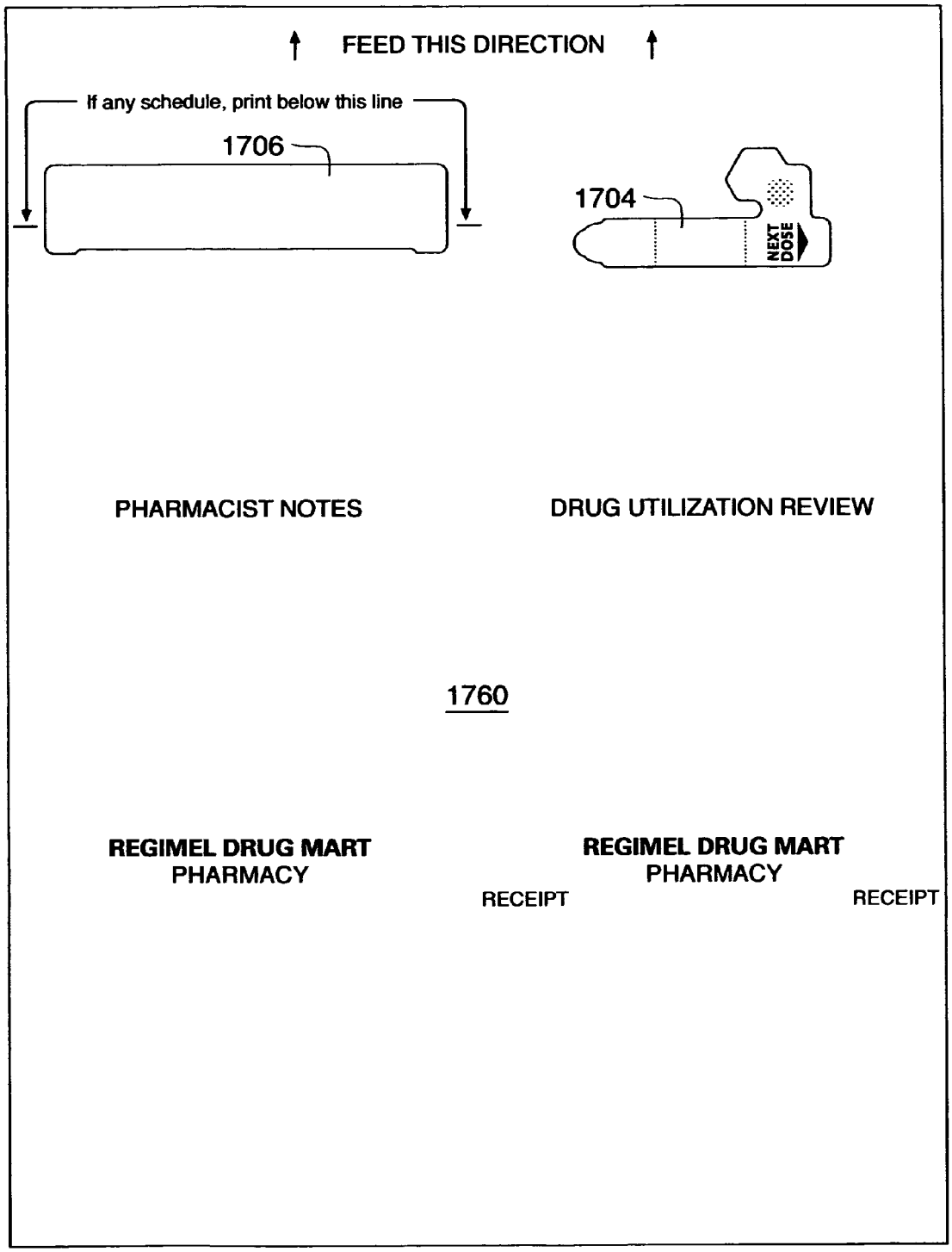
FIG. 82 is a front view of the rail and selector labels of FIG. 81 with no additional indicia printed thereon.

FIG. 82 depicts the label members 1704 and 1706 of FIG. 81 and contiguous label sheet 1760 after the label sheet has been processed by the same or equivalent printer used for printing the custom patient indicia 1712 onto the front surface of the pharmacy label 1716. Since no custom indicia are required on the rail label in the present embodiment 1700, the printer may be instructed to process the label sheet 1760 without producing any printing or the label sheet 1760 may simply be withheld from the printer. It should be noted that this label sheet might be used to produce a custom version of the selectable member 1306 in previous embodiment 1300 by instructing the printer to print the appropriate schedule information onto the label 1706.

Figure 83:
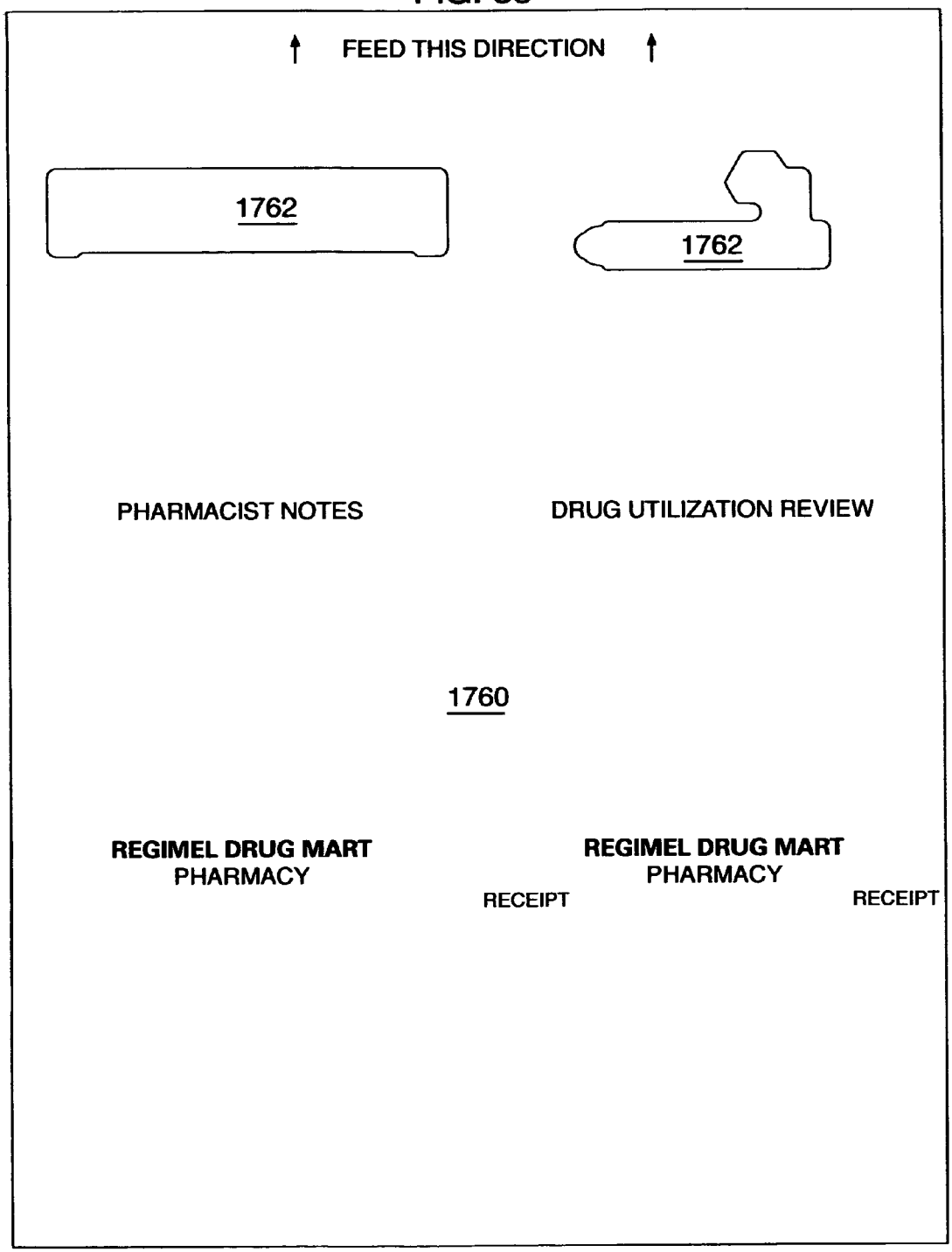
FIG. 83 is a front view of the label sheet of FIG. 81 after the rail and selector labels have been removed.

FIG. 83 depicts the label sheet 1760 after the label members 1704 and 1706 have been removed therefrom. A release liner 1762 is disposed adjacent to the rear surface of the label members 1704 and 1706 to allow the labels to be easily separated from the remainder of the label sheet 1760.

Figure 84:
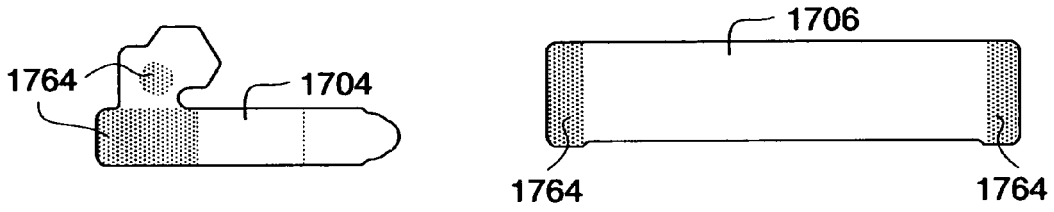
FIG. 84 is a rear view of the rail and selector labels of FIG. 81 depicting adhesive patterns.

FIG. 84 shows a rear view of the selector label 1704 and the rail label 1706 after removal from the liner 1762 (FIG. 83). As shown, a rear surface of the selector 1704 and the rail label 1706 members, has an adhesive material 1764 disposed thereon. FIG. 84 illustrates a predetermined pattern of adhesive material 1764 on both members. Other variations of patterns may be utilized so long as the selector label may be assembled with the rail label as previously described and the rail label may be affixed to an article such that the selector may cooperate with a member in the device to form a reminder.

FIGS. 85-88 depict an additional fifteenth embodiment 1800 of the invention. In the present embodiment 1800, the reminder device is formed as part of a label sheet including a top sheet and a release liner (similar to the label sheet 1110 in the previous embodiment 1100) for automated application to the outside wall surface of a container. The label sheet (not shown) which is put up in a roll (not shown) for commercial printing includes all label elements necessary to label a container for use and to affix the reminder device. All the label elements are coupled or linked for processing so that application may be performed in a single step using standard labeling equipment with little or no modification.

Figure 85:
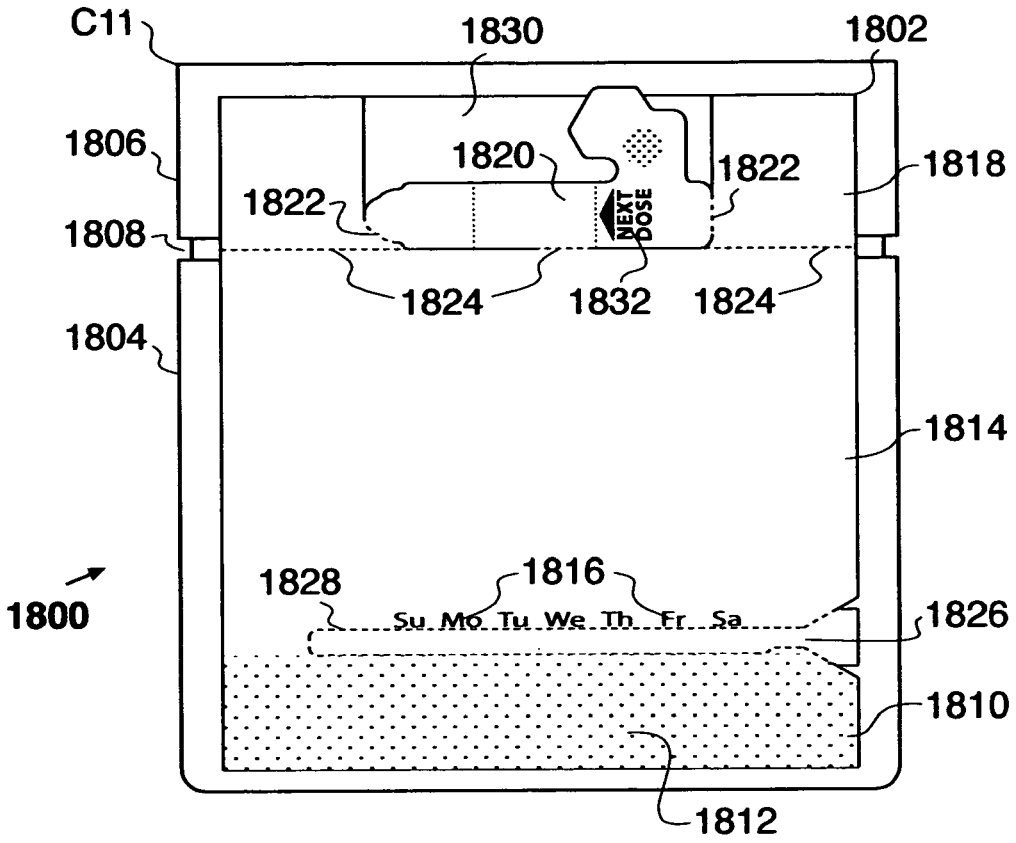
FIG. 85 is a planar view of the front of embodiment 1800 of the invention. In this example, the reminder includes a tamper-evident reminder device label attached to the side of a container. A tear strip in the label is removable to produce a rail and a selector is removable for assembly.

FIG. 85 depicts the front surface of a reminder device label 1802 permanently attached to a sidewall 1804 of the container C11. The outer circumferences of the container sidewall and the container closure (i.e. cap) are approximately equal causing the sidewall 1804 of the container and a side 1806 of the attached cap to rest in approximately the same vertical plane. When the container is closed as in the illustration, a narrow recess 1808 is exhibited adjacent to the bottom perimeter of the cap. The reminder label 1802 includes a lower rail portion 1810, the front surface of which is coated with a release material 1812, a middle portion 1814 including schedule indicia 1816 and an upper portion 1818 including a removable selector 1820 coupled to the contiguous upper portion by structural perforations 1822. The selector 1820 is similar to selector 1704 in embodiment 1700 except for changed orientation of indicia 1832 on the front surface of the selector. The middle label portion, which is blank in the illustration, would normally carry suitable product information to make the contents sellable or carry other suitable printed indicia. Structural perforations 1824 separating the upper and middle portions and coupling a portion of the selector member horizontally traverse the reminder label 1802. A removable tear strip 1826 defined by structural perforations 1828 at its perimeter is located just below the schedule indicia 1816 and separates the middle portion 1814 from the rail portion 1810. After die cutting (including perforating) to define the peripheries of the device members, the remainder of the top sheet (not shown) surrounding the peripheries of the device members is removed. As can be seen from the illustration in FIG. 85, when the reminder label 1802 is mounted on the closed container C11, it is positioned to bridge the recess 1808 such that the perforations 1824 overlie the recess.

Figure 86:
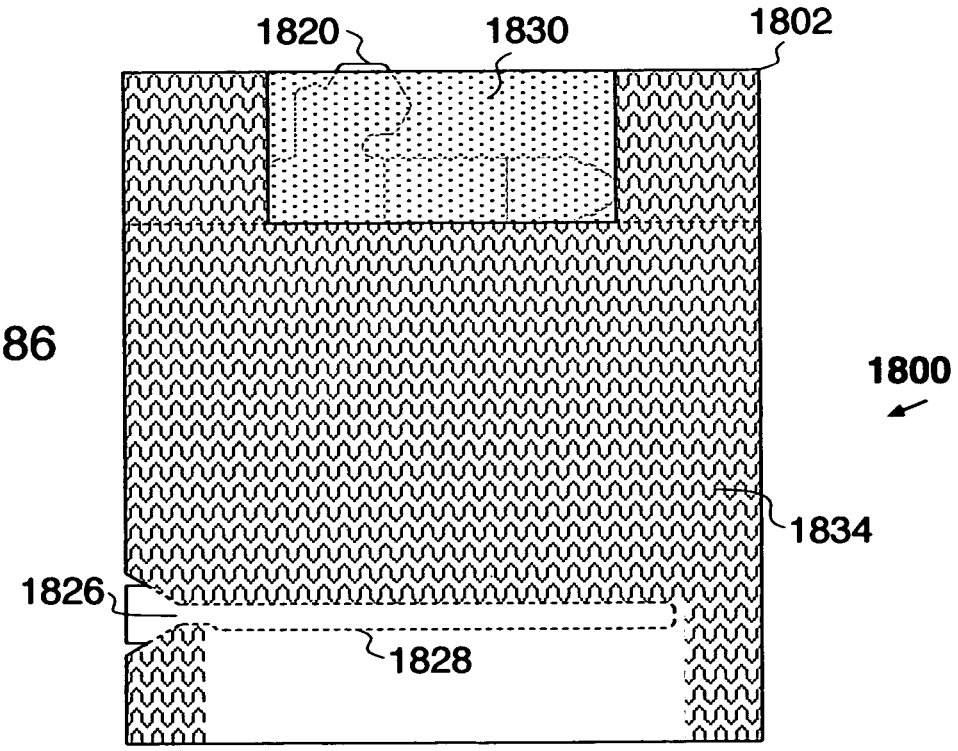
FIG. 86 is a rear view of the reminder device label of FIG. 85 showing an adhesive pattern and a retained portion of liner.

FIG. 86 depicts the rear of the reminder label with the release liner removed from all areas except a portion 1830 covering the rear of the selector label 1820. A method for die cutting the liner to leave a portion of the liner attached to a portion of the reminder label when the reminder label is peeled from the rest of the liner sheet is known in the art. Although FIG. 86 illustrates a particular shape and size for the liner portion 1830, the only requirement for the shape and size of the liner portion 1830 is that adhesive areas on the back of the selector be covered. Although not shown, the rear of the selector label 1820 and more particularly the adhesive pattern on the rear surface of the selector label 1820 is identical to the rear of the selector label 1704 in the embodiment 1700. As shown, a rear surface of the reminder label 1802 has a permanent adhesive material 1834 disposed thereon. Although FIG. 86 illustrates a predetermined pattern of adhesive material 1834, other variations of patterns may be utilized.

Turning back to FIG. 85, the opposing adhesive ends (separated by the selector) of the upper portion 1818 of the reminder label are permanently adhered to the side of the cap 1806. The release liner portion 1830 covers the rear of the selector 1820 and the selector remains unadhered to the cap. The entire adhesive middle portion 1814 of the reminder label is adhered to the side 1804 of the container. The opposing adhesive ends of the lower portion 1810 of the reminder label are adhered to the side 1804 of the container. In order to activate the device 1800, the tear strip 1826 and the selector 1820 must first be removed from the reminder label 1802.

Figure 87:
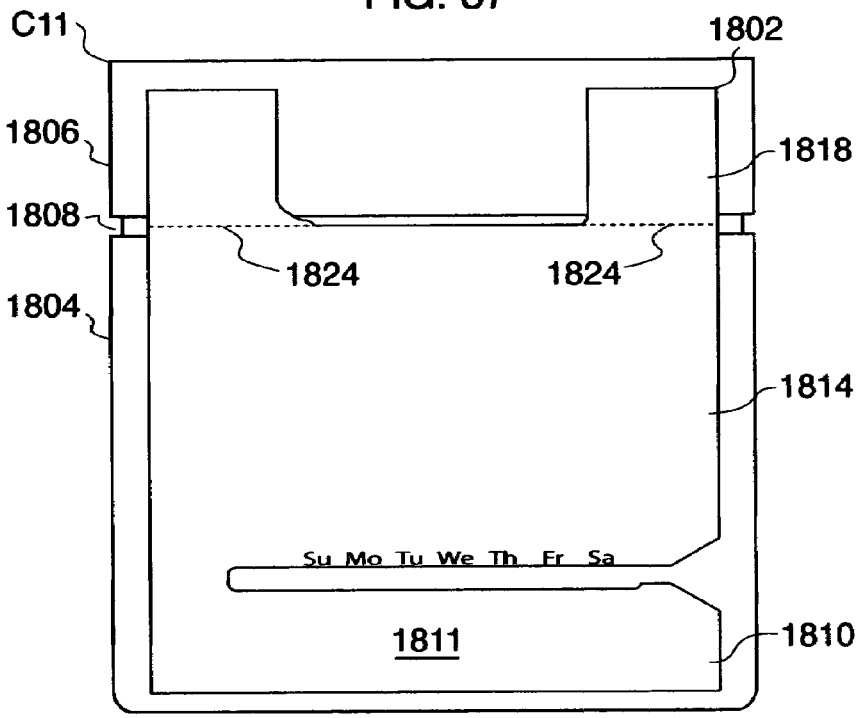
FIG. 87 is a planar view of the front of the reminder label and container of FIG. 85 after the selector and the tear strip have been removed.

FIG. 87 depicts the device of FIG. 85 after the tear strip 1826 and the selector 1820 have been removed from the reminder label 1802. Removing the tear strip produces a rail member 1811 like that of 1706 in embodiment 1700 in the lower rail portion 1810 of the reminder device label. The selector is removed along with the attached release liner from the reminder label by tearing along the coupling perforations. The attached liner may then be removed from the selector so that the selector 1820 may be assembled with the rail member 1811.

Figure 88:
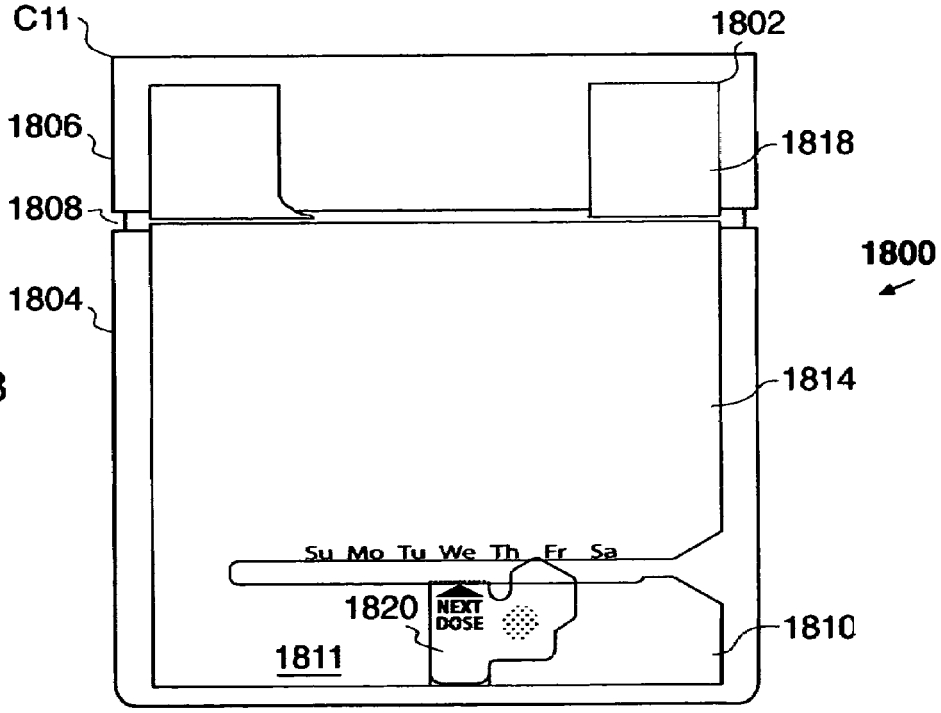
FIG. 88 is a planar view of the front of the reminder label and container of FIG. 87 after the selector has been assembled with the rail and the reminder label has been cut along a structural perforation line.

FIG. 88 shows the selector label 1820 assembled with the rail member 1811. Assembly of the two is similar to the procedure described for assembly of selector 1704 with rail 1706 in embodiment 1700. Operation of the device 1800 is the same as for device 1700. FIG. 88 also shows the label portions adhered to the cap uncoupled from the label portion adhered to the side of the container. This may be accomplished by running a fingernail or equivalent through the line of horizontal perforations 1824 over the recess region 1808. Because permanently adhered portions of the reminder label are continuous between the cap and the container side, the label must be cut (ex. along the horizontal perforation lines) to open the container cap, providing evidence of tampering. From the disclosures in the present and foregoing embodiments it will become apparent to those skilled in the art that the reminder label device members produced on a single adhesive sheet in embodiment 1800, may be adapted for production on a single standard-sized adhesive sheet (or strip) or multiple standard-sized adhesive sheets (or strips). Said standard-sized sheets (and strips) may be suitable for processing through a printer to print custom indicia thereon prior to attachment of the device members to a container, especially a pharmacy container.

FIGS. 89-94 depict an additional sixteenth embodiment 1900 of the invention wherein a movable member is retentively intersectably engageable between a set of cooperating rails in the activated device. Like the reminder device of the previous embodiment 1800, the present device 1900 is formed as part of a label sheet including a top sheet and a release liner for automated or manual application to a container.

Figure 89:
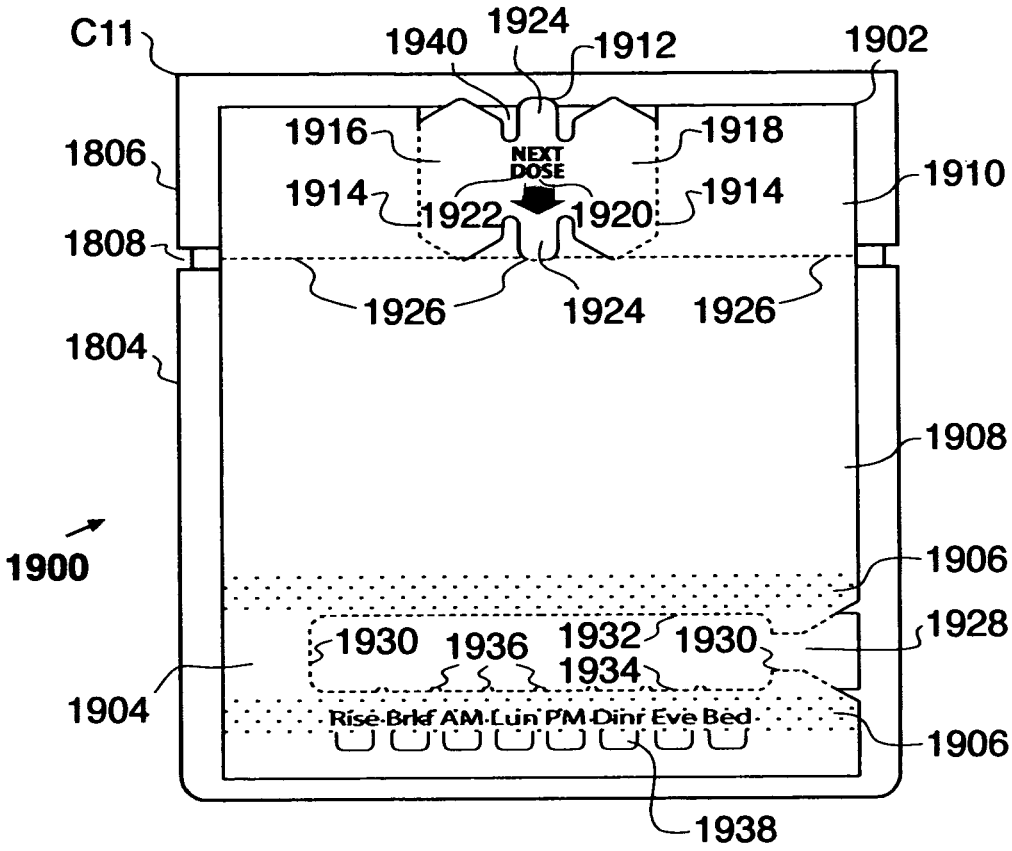
FIG. 89 is a planar view of the front of embodiment 1900 of the invention. In this example, the reminder includes another tamper-evident reminder device label attached to the side of the container of FIG. 85. A tear strip in the label is removable to produce rails and a selector is removable for assembly.

FIG. 89 depicts the front surface of a reminder device label 1902 attached to the sidewall 1804 of the container C11. The reminder label 1902 is adherable and includes a lower rail portion 1904, the front surface of which is pattern coated with a release material 1906. The reminder label also includes a middle portion 1908, and an upper portion 1910 including a removable selector or pointer 1912 coupled to the contiguous upper portion by structural perforations 1914. The selector 1912 includes left 1916 and right 1918 opposing flaps separated by a middle portion 1920 which includes indicia 1922 and opposing upper and lower tabs 1924. The middle label portion 1908, which is blank in the illustration, would normally carry suitable product information to make the contents sellable or carry other suitable printed indicia. Structural perforations 1926 separating the upper and middle portions and coupling a portion of the selector member horizontally traverse the reminder label 1902. The rail portion 1904 includes a removable tear strip 1928 defined by structural perforations 1930 at its perimeter. When the tear strip 1928 is removed from the reminder label, a set of generally parallel rails 1932 and 1934 for retentively intersectably engaging the selector 1912 is produced at the upper and lower perimeters (at the perforations) of the tear strip. The lower rail further includes a plurality of projections 1936 which function as détentes or stops (anti-displacement members) to hinder inadvertent sideways displacement of the selector when it is assembled with the rails. It is to be considered that shape and height of the projections may be altered to achieve a suitable degree of anti-displacement effect Similar projections may of course be substituted or added to the upper rail to control anti-displacement effect. The rail portion 1904 further includes suitable schedule indicia 1938. The pattern of release material 1906 is shown traversing the label 1902 on portions adjacent to the upper rail 1932 and the lower rail 1934, the upper release material portion separating the middle label portion 1908 from the lower rail portion 1904 in the label 1902. After die cutting (including perforating) to define the peripheries of the device members, the remainder of the top sheet (not shown) outside the peripheries of the device members is removed. As can be seen from the illustration in FIG. 89, when the reminder label 1902 is mounted on the container C11, it is positioned to bridge the recess 1808 such that the perforations 1926 overlie the recess.

Figure 90:
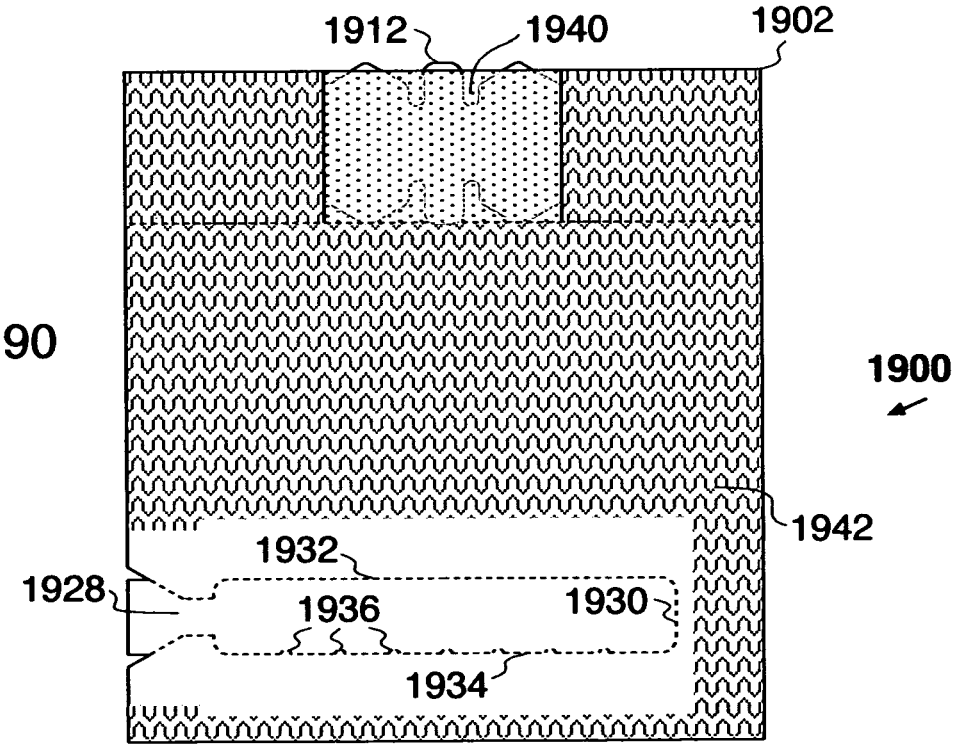
FIG. 90 is a rear view of the reminder device label of FIG. 89 showing an adhesive pattern and a retained portion of liner.

FIG. 90 depicts the rear of the reminder label with the release liner removed from all areas except a portion 1940 covering the selector label 1912. A method for die cutting the liner to leave a portion of the liner attached to a portion of the reminder label when the reminder label is peeled from the rest of the liner sheet is known in the art. Although FIG. 90 illustrates a particular shape and size for the liner portion 1940, the only requirement for the shape and size of the liner portion 1940 is that the adhesive areas on the back of the selector be covered. As shown, a rear surface of the reminder label 1902 has a permanent adhesive material 1942 disposed thereon. Although FIG. 90 illustrates a predetermined pattern of adhesive material 1942, other variations of patterns may be utilized.

Turning back to FIG. 89, the opposing adhesive ends (separated by the selector) of the upper portion 1910 of the reminder label are permanently adhered to the side of the cap

1806. The release liner portion 1940 covers the rear of the selector 1912 and the selector remains unadhered to the cap. The entire adhesive middle portion 1908 of the reminder label is permanently adhered to the side 1804 of the container. The adhesive portions of the lower rail portion 1904 of the reminder label are also permanently adhered to the side 1804 of the container. In order to activate the device 1900, the tear strip 1928 and the selector 1912 must first be removed from the reminder label 1902 for selector assembly with the rail member.

FIG. 91 depicts the device of FIG. 89 after the tear strip 1928 and the selector 1912 have been removed from the reminder label 1902. Removing the tear strip produces a rail member including the upper rail 1932 and the lower rail 1934. The selector is removed along with the attached release liner portion 1940 from the reminder label by tearing along the coupling perforations. The attached liner may then be removed from the selector so that the selector 1912 may be assembled with the rail member.

FIG. 92 depicts a rear surface (liner removed) of the selector label 1912 and shows the permanent adhesive 1942 disposed in a predetermined pattern on the side flaps 1916 and 1918. Other suitable variations of patterns may be utilized.

FIG. 93 depicts one exemplary method of assembling the selector 1912 with the rail member (rails 1932 and 1934). Other suitable methods will work in some applications. The left selector flap 1916 is lifted (away from the container) or folded outwardly slightly and the tabs 1924 are inserted between the reminder label 1902 and the container wall 1804 at the position show in the illustration. As indicated by the horizontal direction arrow, the selector is pulled leftward by the left selector flap 1916. Unadhered portions 1944 (shown in phantom) of the rail portion 1904 are thusly caused to deflect as indicated by the curved arrows in the illustration, allowing advancement of the selector. The right selector flap 1918 is lifted (away from the container) or folded outwardly slightly as the selector is further advanced leftward to the position shown in FIG. 94 allowing the unadhered portions 1944 to return to substantially their original position. Thus the selector flaps 1916, 1918 are located in front of the rail portion 1904 and the selector tabs 1924 are located behind the rail portion 1904 causing the selector to be retentively engaged with the rail member. The projections or détentes 1936 along the lower rail temporarily deflect or deform to permit the selector to change positions when the selector is purposely moved sideways, but act to hinder inadvertent dislocation of the selector. A selected position may be further secured by pressing down on the side flap areas having adhesive (i.e. pressure-sensitive adhesive) to reposoitionably adhere the flaps to the release coating 1906 on the surface of the underlying reminder label. Stated otherwise, the underlying label is adhered to the flaps. It is to be considered that the movable member may further include scores, perforations and other structural elements to impart desirable operational characteristics to the member. Operation of the device 1900 is similar to the operation of the device 1800 in the previous embodiment When medication is taken, the adhered selector side flaps are temporarily unadhered by folding upwardly, the selector is engageably moved by sliding (preferably by pulling on one of the side flaps) to make a new selection, and the side flaps may again be pressed down to further secure the selected position. While it is preferable that the selector or pointer be moved to make a desired selection, the pointer member could of course be held stationary while a cooperating member (ex. the container along with the attached rail) is moved relative to the pointer, to make a selection. Activation of the device 1900 may also serve to disclose evidence of tampering.

FIGS. 95-102 depict an additional seventeenth preferred embodiment 2000 of the invention, wherein automated production of a selector member and a rail member as a laminated label assembly, greatly simplifies assembly for a user. The laminated assembly (i.e. the linked members) is suitable for manual or automated attachment to an article in a single step and provides an easy device activation procedure.

FIG. 95 depicts a front surface of a selector label member 2002 adhered to a release coated liner 2004. The selector shown has been die cut from a contiguous label sheet (not shown) held on the liner 2004, the remainder of the label sheet material outside the peripheries of the selector having been removed. The selector includes left 2006 and right 2008 opposing side flaps separated by a middle portion 2010 including opposing upper and lower tabs 2012 and including indicia 2014 designating the selector as a pointer. The left flap 2006 includes two opposing adherable structure portions 2016, each including a set of structural perforations 2018 defining a closed-path perimeter making the adherable structural portions 2016 separable from the selector 2012. As later described, when a laminated label including the selector 2012 is adhered to a container surface by way of the adherable structural portions 2016, the structural portions may be separated from the selector (structural portions remaining on the container surface) when the left flap is lifted away from the container. The right flap 2008 includes two diagonal score lines 2020 starting at a common point located approximately at the center of the inside margin of the flap and spreading to the outer side perimeter of the flap. The score lines facilitate manipulation of the selector during activation as later described. Other suitable patterns of scores or even perforations or other means may be employed to influence the behavioral characteristics of the selector member.

FIG. 96 (enlarged view) depicts a pattern coating of release material 2022 on the front surface of the selector 2002. Of particular note is the left side flap 2006 showing release coating on the opposing areas 2016 inside the delineating sets of structural perforations 2018.

FIG. 97 (enlarged view) depicts a pattern coating of adhesive material 2024 on a rear surface of the selector 2002. Of particular note is the adhesive 2024 covering only the areas inside the delineating sets of structural perforations 2018.

FIG. 98 depicts a front surface of a rail label member 2026 adhered to a release coated liner 2028. The rail label shown has been die cut from a contiguous label sheet (not shown) held on the liner 2028, the remainder of the label sheet material outside the peripheries of the selector having been removed. The rail label 2026 further includes suitable schedule indicia 2029. A removable tear strip 2030 designated as such by suitable indicia 2032 is delineated by structural perforations 2034. Additional structural perforations 2036 further delineate opposing releasable portions 2038 at the left side of the rail label 2026 above and below the tear strip 2030. The front surface of the rail label further includes a predetermined pattern of release material 2040 indicated by shaded areas adjacent to the generally horizontal perforations of the tear strip 2030.

FIG. 99 depicts a rear surface of the rail label member 2026 and shows a predetermined pattern of adhesive material 2042,2044,2046 disposed thereon. The rail label 2026 is removed from its liner 2028 shown in FIG. 98 and is laminated in register onto the selector label 2002 shown in FIG. 95 to produce a laminated label 2048 temporarily held on the liner 2004.

Figure 100:
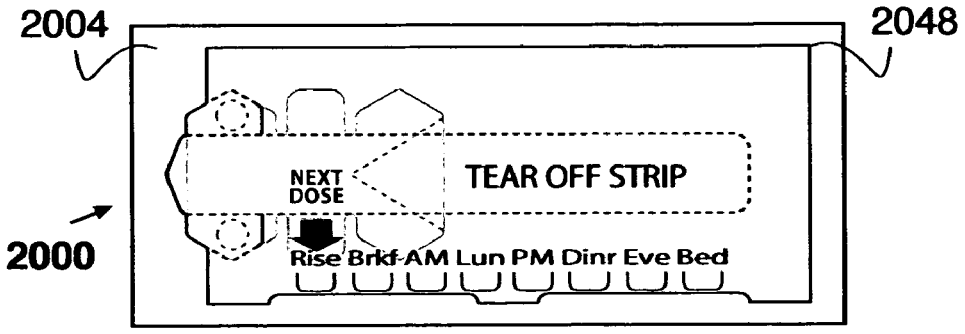
FIG. 100 is a view of the front of embodiment 2000 of the invention. In this example, the rail label of FIG. 98 has been applied in register onto the selector label adhered to the liner of FIG. 95 to produce a laminated reminder label which may be applied to an article in a single step.

FIG. 100 depicts the laminated label 2048 and shows the underlying relative position of the laminated selector label in shading. The pattern adhesive areas 2042 are in contact with the release liner 2004. The 2044 adhesive area is in contact with the release coated area of the selector. The 2046 adhesive areas permanently laminate the two labels together, however the release material areas 2016 within the perforation borders 2018 are only temporarily adhered. The laminated label 2048 may be removed from the release liner 2004 and attached to an article in a single step.

Figure 101:
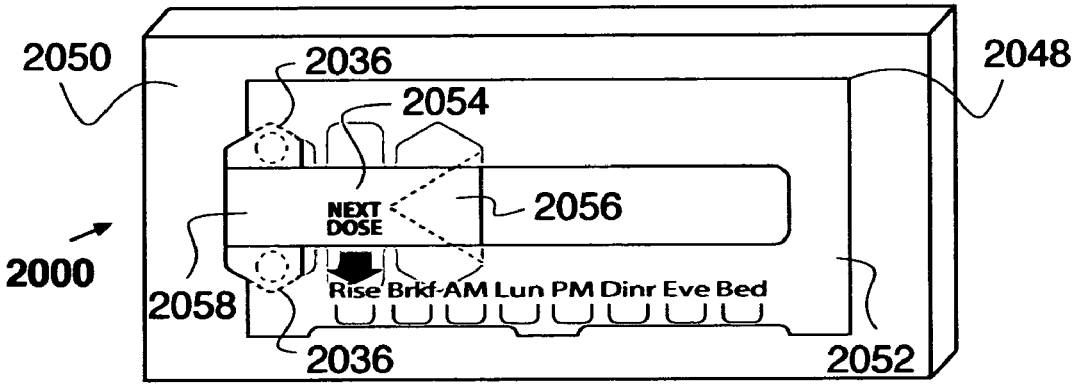
FIG. 101 is a perspective view of the laminated reminder label of FIG. 100 attached to a surface of a carton. The illustration depicts commenced activation.

FIG. 101 depicts the laminated label 2048 attached to the surface of a carton 2050 by way of the 2024 and 2042 adhesive areas on the rear of the laminated label. The illustration shows commenced activation of the reminder device. To activate the device 2000, the tear strip 2030 has been removed by tearing along the perforations 2034 producing a set of generally parallel generally horizontal rails (similar to those in the previous embodiment 1900) in a rail portion 2052 of the label 2048. Removal of the tear strip 2030 has also exposed a generally rectangular portion of an underlying selector 2054 (originally 2002) of the lamination 2048. A right side flap 2056 (originally 2008) of the selector is brought in front of the rail portion by inserting a fingernail under the right side flap at the exposed edge and lifting or folding the flap forward until it clears the rail portion. A left side flap 2058 (originally 2006) of the selector 2054 is lifted or folded forward until the releasable portions 2038 (FIG. 98) are released along the structural perforations 2036. When the left side flap 2058 is lifted, the two adherable structure portions 2016 attached to the container 2050 are left on the container, being released from the left side flap along the perforations 2018. The superimposed lamination layer bridging the areas vacated by 2016 includes adhesive 2046 which may be used in operation of the device. With the left flap lifted, the now repositionable selector is pulled rightward by the right flap such that the left flap is kept in front of the rail portion.

Figure 102:
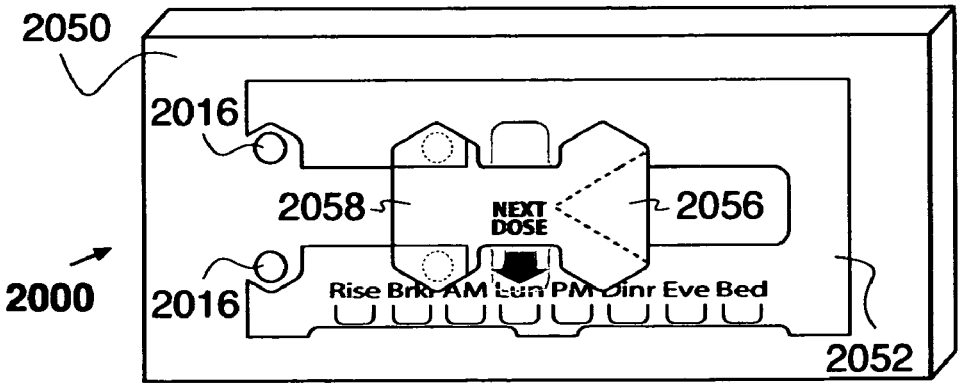
FIG. 102 is a perspective view of the laminated reminder label of FIG. 100 attached to the surface of the carton of FIG. 101. The illustration depicts completed activation.

As best seen in FIG. 102, thusly the selector flaps 2056, 2058 are located in front of the rail portion 2052 and the selector tabs 2012 are located behind the rail portion 2052 causing the selector to be retentively engaged with the rail member. The upper and lower adhesive portions of the left selector flap may be pressed against the rail member 2052 to further secure a selected position. In use, operation of the device is similar to that of the previous embodiment 1900. When medication is taken, the left flap is lifted to unadhere the flap, the selector is slid along the rails to select a time for the next dose and the left flap is pressed down to secure the selected position. It should be noted that the method steps described to produce the laminated label 2048 are exemplary of one method. Many alternate methods are known in the art and any suitable method may be used. Some steps may be eliminated or combined or performed in a different sequence so long as the described lamination or its equivalent is produced.

FIGS. 103-110 depict an additional eighteenth embodiment 2100 of the invention wherein printing of the selector in a device like that of previous embodiment 2000 is eliminated.

FIG. 103 depicts a front surface of a selector label member 2102 like that of selector label member 2002 of the previous embodiment 2000 adhered to the release coated liner 2004. As can be seen in the front surface view of FIG. 104 and the rear surface view of FIG. 105, except for the absence of indicia and a different pattern of release material on its front surface, selector 2102 is identical in all respects to selector 2002. As best seen in FIG. 104, a middle portion 2104 of the selector that separates the tabs 2012 does not include any release material 2022.

FIG. 106 depicts the front surface of a rail label member 2106 adhered to the release coated liner 2028. The rail label 2106 shown is similar to rail label 2026 in embodiment 2000, but includes the following differences. The rail label 2106 includes suitable schedule indicia 2108 located at an alternate position on the rail label. The rail label 2106 of the present embodiment 2100 further includes a first left side removable tear strip 2110 designated as such by suitable indicia 2112 and delineated by structural perforations 2114. The rail label 2106 of the present embodiment 2100 also includes a second right side removable tear strip 2116 designated as such by suitable indicia 2118 and delineated by structural perforations 2120. An adherable portion including pointer indicia 2122 separates the two tear strips 2110, 2116 and is separable from the rail label 2106 due to additional generally horizontal opposing structural perforations 2124, which are continuous between the left and right tear strips.

FIG. 107 depicts the rear surface of the rail label member 2106 and shows a predetermined pattern of adhesive material 2042, 2044, 2046 disposed thereon similar to that of rail member 2026 in the previous embodiment 2000. A notable difference is the absence of adhesive on an outer end portion of the right tear strip 2116. Additionally, the rail label member 2106 further includes adhesive material 2126 on the rear surface of the portion including the pointer indicia 2122. The rail label 2106 is removed from its liner 2028 shown in FIG. 106 and is laminated in register onto the selector label 2102 shown in FIG. 103 by any suitable means to produce the laminated label 2128 temporarily held on the liner 2004.

Figure 108:
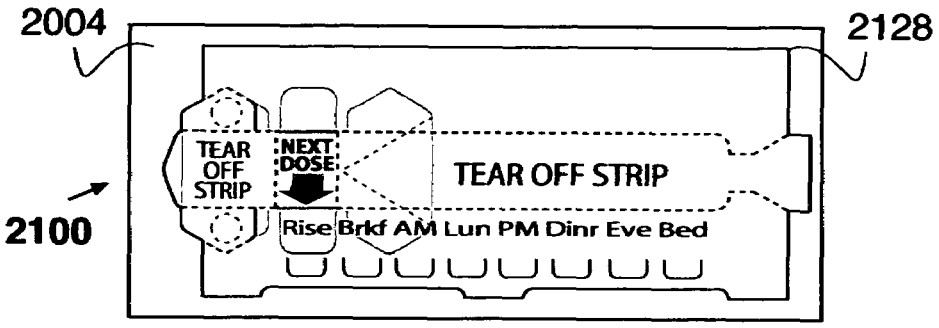
FIG. 108 is a view of the front of embodiment 2100 of the invention. In this example, the rail label of FIG. 106 has been applied in register onto the selector label adhered to the liner of FIG. 103 to produce a laminated reminder label which may be applied to an article in a single step.

FIG. 108 depicts the laminated label 2128 and shows the underlying relative position of the laminated selector label in shading. In the present embodiment 2100, in similar fashion to that of the previous embodiment 2000, the pattern adhesive areas 2042 are in contact with the release liner 2004. The 2044 adhesive areas are in contact with the release coated area of the selector. The 2046 adhesive areas also permanently laminate the two labels together, while the release material areas 2016 within the perforation borders 2018 are only temporarily adhered. In addition, however the rail label portion including the pointer indicia 2122 is also permanently laminated to the selector. The laminated label 2128 may be removed from the release liner 2004 and attached to an article in a single step.

Figure 109:
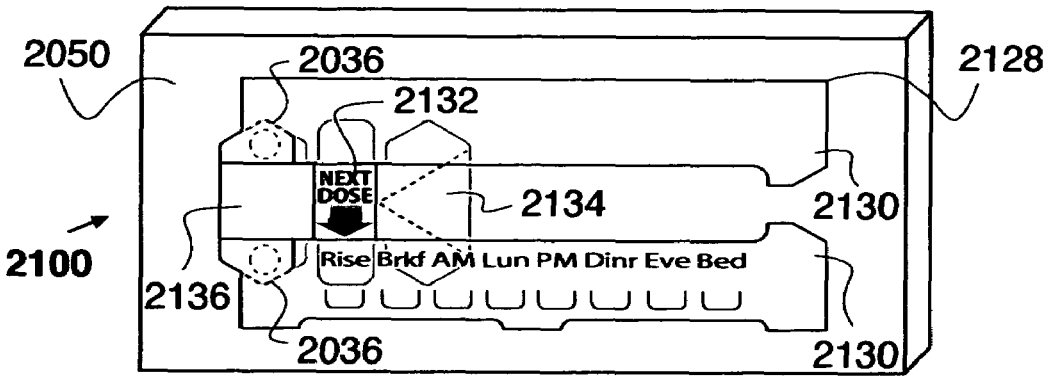
FIG. 109 is a perspective view of the laminated reminder label of FIG. 108 attached to the surface of the carton of FIG. 101. The illustration depicts commenced activation.

FIG. 109 depicts the laminated label 2128 attached to the surface of the carton 2050 by way of the 2024 and 2042 adhesive areas on the rear of the laminated label. The illustration shows commenced activation of the reminder device. To activate the device 2100, the first tear strip 2110 has been removed by tearing along the perforations 2114 and the second tear strip 2116 has been removed by tearing along the perforations 2120. Removal of the two tear strips producing a set of separated rail portions 2130 including a set of generally parallel generally horizontal rails (similar to those in the previous embodiment 2000). Removal of the tear strips has also released the portion including the pointer indicia 2122 from the remainder of rail label portions and has also exposed generally rectangular flap portions of an underlying selector 2132 (originally 2102) of the lamination 2128. In a manner similar to that of embodiment 2000, a right side flap 2134 (originally 2008) of the selector 2132 is brought in front of the rail portions 2130. In a manner similar to that of embodiment 2000, a left side flap 2136 (originally 2006) of the selector 2132 is lifted or folded forward until the releasable portions 2038 are released along the structural perforations 2036. When the left side flap 2136 is lifted, the two adherable structure portions 2016 attached to the container 2050 are left on the container, being released from the left side flap along the perforations 2018. The superimposed lamination layer bridging the areas vacated by 2016 includes adhesive 2046 which may be used in operation of the device. With the left flap lifted, the now repositionable selector is pulled rightward by the right flap such that the left flap is kept in front of the rail portions 2130.

Figure 110:
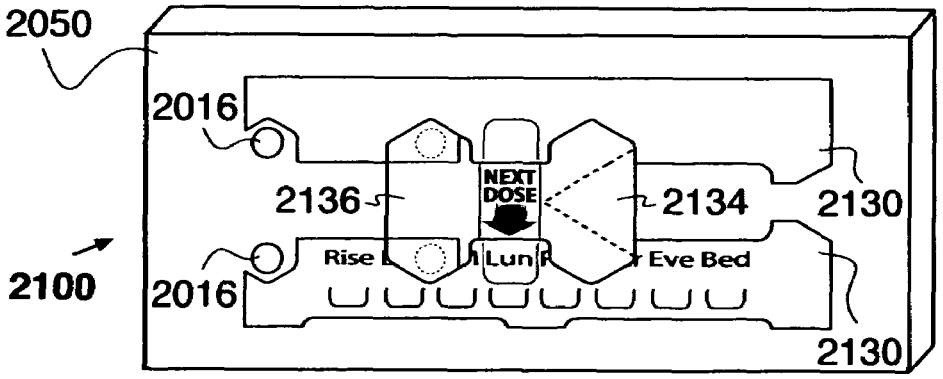
FIG. 110 is a perspective view of the laminated reminder label of FIG. 108 attached to the surface of the carton of FIG. 109. The illustration depicts completed activation.

As best seen in FIG. 110, thusly the selector flaps 2134, 2136 are located in front of the rail portions 2130 and the selector tabs 2012 are located behind the rail portions 2130 causing the selector to be retentively engaged with the rail member. The upper and lower adhesive portions of the left selector flap may be pressed against the rail members 2130 to further secure a selected position. The portion including pointer indicia 2122 is now permanently laminated to the selector and moves with the selector 2132. In use, operation of the device 2100 is similar to that of the previous embodiment 2000.

FIGS. 111-117 depict an additional nineteenth embodiment 2200 of the invention, wherein a selector or pointer member, which acts as a pivot and a pivoting selectable member are intersectably assembled to form an adherable reminder device. Preferably each of the cooperating members is laminated to a transparent plastic film to extend longevity of the device.

Figure 111:
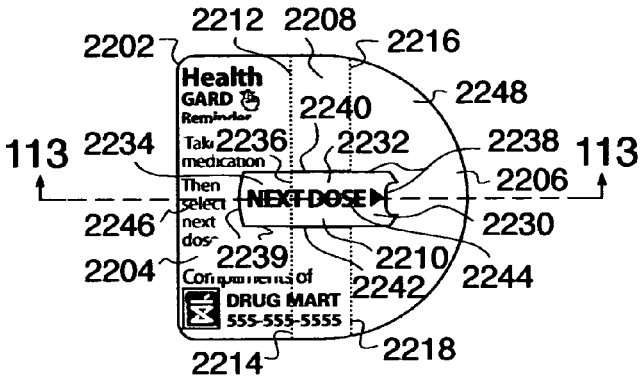
FIG. 111 is a front view of an adherable laminated selector or pointer. The selector is foldable at depicted score lines.

FIG. 111 depicts the front surface of the selector pivot member 2202. The selector is shown including a left vertical portion 2204 and a right vertical portion 2206 separated by a vertical base portion 2208. An engageable generally horizontal pointer portion 2210 further divides the vertical base portion 2208 and extends partially into the left and right vertical portions 2204, 2206. The left vertical portion 2204 is vertically foldable (i.e. hinged) along aligned vertical score lines 2212 and 2214 between the left vertical portion 2204 and vertical base portion 2208, the score lines being respectively located only above and only below the pointer portion 2210. The right vertical portion 2206 is vertically foldable (i.e. hinged) along aligned vertical score lines 2216 and 2218 between the right vertical portion 2206 and vertical base portion 2208, the score lines being respectively located only above and only below the pointer portion 2210. The pointer portion 2210 includes contiguous forward 2230, middle 2232 and tail 2234 portions. A vertical score line 2236 or equivalent hinge (aligned with score lines 2212 and 2214) divides the middle portion 2232 from the tail portion 2234. A continuous die cut 2238 defines remaining outer perimeters of the forward portion 2230. Another continuous die cut 2239 defines remaining outer perimeters of the tail portion 2234. The pointer portion is thus linked or attached to the remainder of the selector pivot member (i.e. the vertical base portion 2208) by way of the remaining horizontal portions 2240 and 2242 at the upper and lower perimeter of the middle portion 2232. The tail portion 2234 is vertically foldable (i.e. hinged) along the vertical score line 2236. The pointer portion 2210 and the horizontal portions 2240, 2242 are preferably further embossed as is known in the art, raising the entire pointer portion from the plane of the rest of the selector pivot member and facilitating assembly with the selectable member of the present embodiment. The selector pivot member 2202 further includes suitable indicia 2244 designating the pointer and providing additional suitable information 2246. The front surface of the entire selector pivot member either includes a coating of release material or is preferably laminated with a transparent layer of film material 2248, which may act as a release material or may itself then be coated with a release material. It is to be considered that similar lamination of the rear surface may be substituted or added for some applications.

Figure 112:
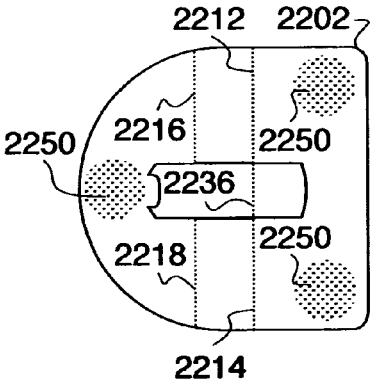
FIG. 112 is a rear view of the selector of FIG. 111 depicting an adhesive pattern on a rear surface.

FIG. 112 depicts the rear surface of the selector pivot member 2202. The rear surface includes a predetermined pattern of adhesive material 2250. Other patterns of adhesive material may work equally well.

Figure 113:
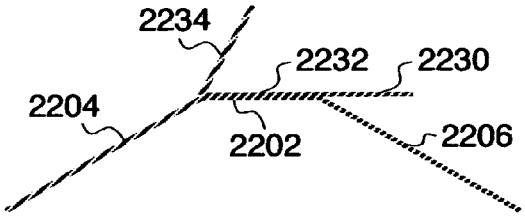
FIG. 113 is an enlarged side cross-sectional view of the selector of FIG. 111 showing folding of the selector for assembly with a selectable schedule member.

FIG. 113 depicts an enlarged side cross sectional view of the selector pivot 2202 showing how the hinged portions of the member may be folded to facilitate assembly with a selectable member 2252.

Figure 114:
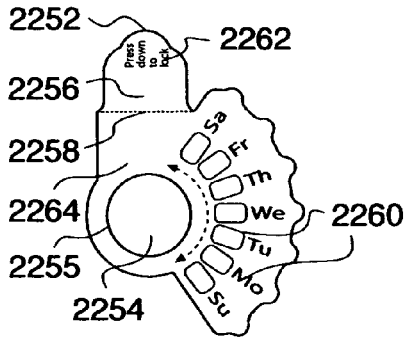
FIG. 114 is a front view of a laminated schedule member selectable by the selector of FIG. 111 when assembled therewith.

FIG. 114 depicts the front surface of the selectable pivoting or movable member 2252. The selectable member is shown including circular aperture 2254 defined by a perimeter 2255 forming an endless or continuous circular path. The aperture 2254 is of suitable size, according to U.S. patent application Ser. No. 761, the contents of which are included herein by reference, for assembly with the pivot member and more particularly, with the embossed horizontal portions 2240 and 2242 of the selector 2202. The selectable member further includes a security tab 2256 extension which is foldable (i.e. hinged) along a structural score line 2258. Suitable selectable customizable schedule indicia 2260 and additional suitable indicia 2262 are also included. Preferably the selectable member is laminated with a film covering 2264 that is treated as is known in the art to permit inscription by writing instruments or inherently permits inscription. It is to be considered that lamination of the rear surface may be substituted or added for some applications.

Figure 115:
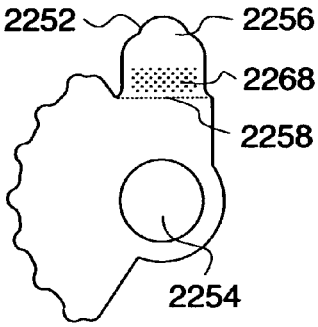
FIG. 115 is a rear view of the selectable schedule member of FIG. 114 depicting an adhesive pattern on the rear surface.

FIG. 115 depicts the rear surface of the movable selectable schedule member 2252. A portion of the rear surface of the tab extension 2256 includes a coating of adhesive material 2268. The selector 2202 and the selectable member 2252 are assembled together according to the method described for similar or comparable members in U.S. patent application Ser. No. 761, the contents of which are included herein by reference.

Figure 116A:
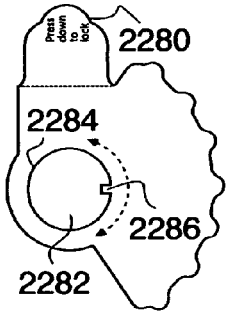
FIG. 116A is a front view of a variant of the selectable member of FIG. 114 wherein its pivoting range is limited.
Figure 116:
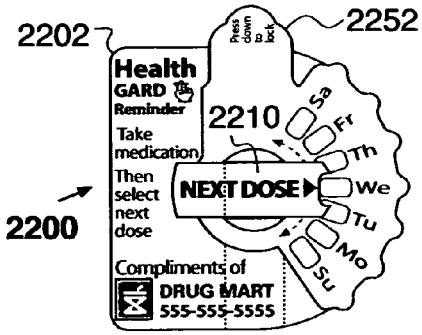
FIG. 116 is a view of the front of embodiment 2200 of the invention. The illustration depicts the selectable member of FIG. 114 assembled with the selector of FIG. 111.

As best seen in the assembled device 2200 of FIG. 116, the movable schedule member 2252 is retentively engaged at its aperture 2254. The pointer portion 2210 of the selector member is now located in front of the selectable member 2252 and the vertical portions 2204, 2206 and 2208 are located behind the selectable member 2252. The movable schedule member is secured by pressing down on the tab area 2256 backed by adhesive 2268 to adhere the tab to the selector member (or the selector member to the tab).

FIG. 116A depicts the front surface of a variation of a selectable member 2280 similar to the selectable pivoting member 2252. In the variation, the selectable member 2280 includes a substantially circular aperture 2282 defined by a perimeter 2284 in which the substantially circular path ends at an extension 2286 projecting into the aperture. The ending path or discontinuous path limits the pivoting range of the movable member 2280.

Figure 117:
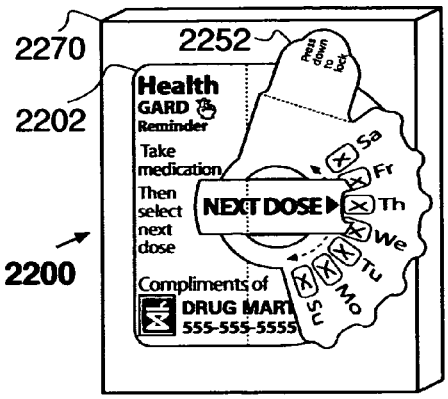
FIG. 117 is a perspective view of the device of FIG. 116 attached to a wall surface of a carton.

FIG. 117 depicts the assembled device 2200 of FIG. 116 after attachment to a carton container 2270 by way of the adhesive 2250 on the back of the selector member 2202. The schedule 2260 has been customized and a next-dose selection made in similar fashion to previous embodiments. Further operation of the device is also similar to previous embodiments. When medication is taken, time for the next dose is selected by pulling up on the hinged tab 2256 to disengage the adhered tab from the release material of the selector member 2202. The movable selectable member

2252 is pivoted to align a selection with the pointer and the tab is again pressed down to secure the selection. It should be noted that in the assembled device, the schedule or selectable member is herein described as movable, relative to the pivot member, pivoting to make a next-dose selection. The schedule member could of course be held stationary while a cooperating member (ex. the carton along with the attached pointer) is moved or pivoted, relative to the schedule member, to make a selection.

FIGS. 118-125 depict an additional twentieth embodiment 2300 of the invention wherein a tamper-evident reminder device package includes a carton container including an integral aperture pivot area. In the present embodiment 2300, a pivoting selector member for intersectable assembly with the aperture is included inside the carton, but may otherwise be included in the package. For example, the selector may be attached to the package by way of production in one of the carton panel structures or production in an extra panel. Another possibility is to temporarily adhere the selector to an outside surface of the container.

Figure 118:
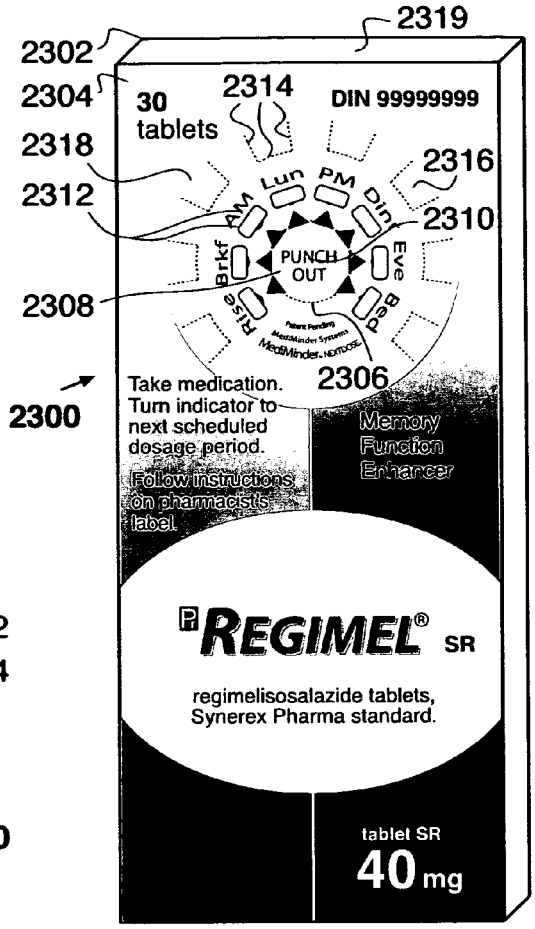
FIG. 118 is a perspective view of embodiment 2300 of the invention. The illustration depicts a reminder device package including a carton container. The front of the container provides an integral pivot area, an integral lock area and a selectable schedule. A selector for assembly with the container is included inside the container and is not visible.

FIG. 118 is a perspective view depicting the front surface of the carton 2302 in the reminder device package 2300. A front wall 2304 of the carton 2302 includes a weakened line or set of structural perforations 2306 delineating the circumference of a circular pivot area 2308 having a first radius and carrying suitable instruction indicia 2310. Suitable schedule indicia 2312 are situated at a plurality of individually selectable positions on a concentric (with 2308) arcuate path having a second larger radius. An additional concentric (with 2308) arcuate path having a third still larger radius includes sets of generally U-shaped anti-displacement or lock structural perforations 2314, each set of U-shaped structural perforations delineating a lock area or portion 2316 corresponding to a different selectable position. Preferably end flaps 2319 of the carton are sealed closed with permanent adhesive as is known in the art to disclose evidence of tampering. To activate the device 2300, the carton is first prepared for assembly with the selector. The circular pivot area 2308 is punched out by pressing down on the area 2308 with a thumb or other suitable means until the pivot area is released from the remainder of the carton 2302 along the circumferential line formed by the structural perforations 2306. Similarly pressure is exerted on the lock areas 2314 to break the links along the lines formed by the U-shaped perforations and produce hinged 2318 portions 2316. Breaking of any of the perforated 2306, 2314 links would of course also provide evidence of tampering.

Figure 119:
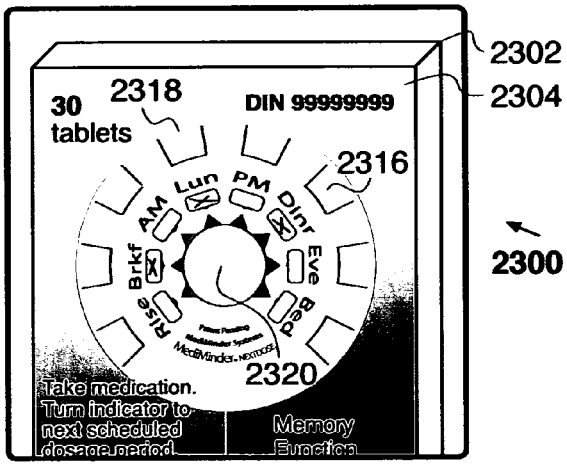
FIG. 119 is a partial perspective view of the package of FIG. 118. The pivot area of FIG. 118 has been punched out to produce an aperture.

FIG. 119 shows the punched out pivot area 2308 producing a circular aperture pivot area 2320. The perforated links in the lock areas 2316 have been broken leaving the lock areas 2316 hinged 2318 and providing some spring action when depressed and released. The spring force may further be controlled by a number of methods known in the art and may be adjusted to achieve desired characteristics in light of the carton material used. For example, spring action may be controlled by the addition of scores or perforations at the hinge or by removal of some material from the hinged portion. It is to be considered that use of a spring is not strictly necessary to produce the device 2300 and that including a suitable aperture alone in place of the hinged portion 2316 may produce a suitable lock.

Figure 120:
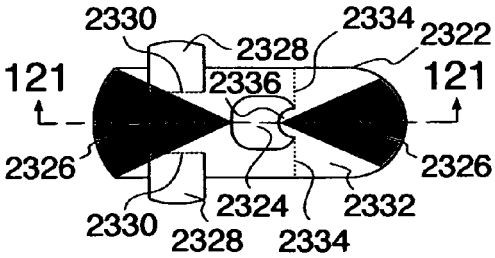

FIG. 120 depicts a front surface of a selector member 2322 included in the reminder device package 2300. The selector includes an aperture 2324 for highlighting or pointing to a next-dose selection and indicia 2326 so indicating. Two opposing die cut side flaps 2328 joined to the remainder of the selector by hinges 2330 produced by scores or their equivalent in the structure are sized relative to the aperture 2320 in the carton wall such that they may be retentively engaged in the aperture of the cooperating carton and permit the selector to pivot Similar construction for a pivoting device and method of assembly is disclosed in U.S. patent application Ser. No. 761, the contents of which are included herein by reference. A forward portion 2332 of the selector is hinged by score lines 2334 at the perimeter of the aperture 2324. A lock tab extension 2336 which is continuous with the forward portion 2332 and is located on the opposite side of the hinges 2334 is caused to move when the forward portion 2332 is folded or deformed along the hinges 2334.

Figure 121:
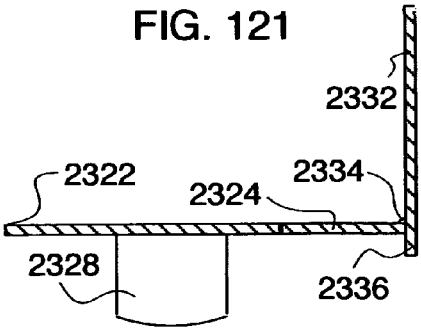

FIG. 121 depicts an enlarged side cross-sectional view of the selector. One of the side flaps 2328 is shown folded down for assembly with the pivot aperture 2320. The forward portion 2332 is shown folded up causing the tab lock extension 2336 to point downward for engagement with the lock portion 2316 of the carton.

Figure 122:
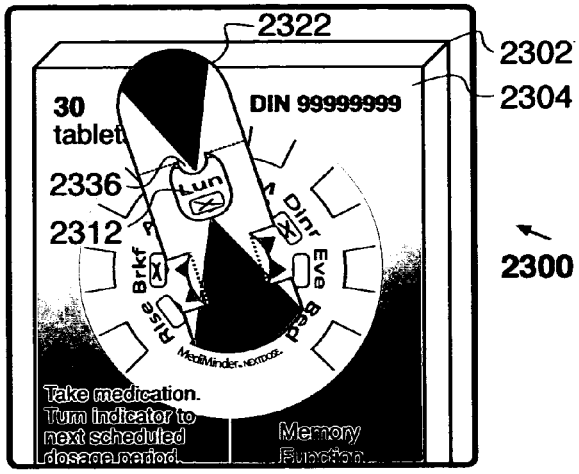

FIG. 122 is a partial perspective view showing the selector 2322 assembled with the pivot aperture in the carton according to the method described in U.S. patent application Ser. No. 761, the contents of which are included herein by reference. The side flaps 2328 are substantially hidden from view because they are positioned behind the carton wall 2304. The lock tab 2336 is visible because the selected schedule 2312 position has not yet been secured or locked in.

Figure 123:
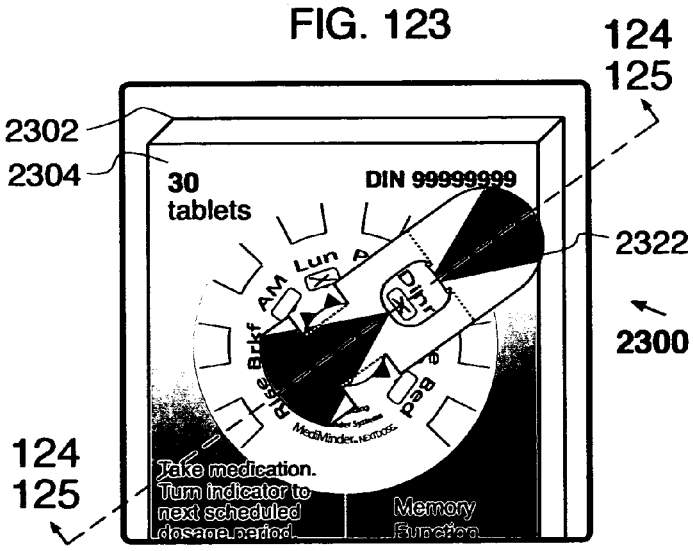

FIG. 123 is a partial perspective view of the device 2300 showing the selector 2322 locked or anti-displaceably held at a selected schedule position. The lock tab 2336 is substantially hidden from view because it is positioned behind the carton wall 2304.

Figure 124:
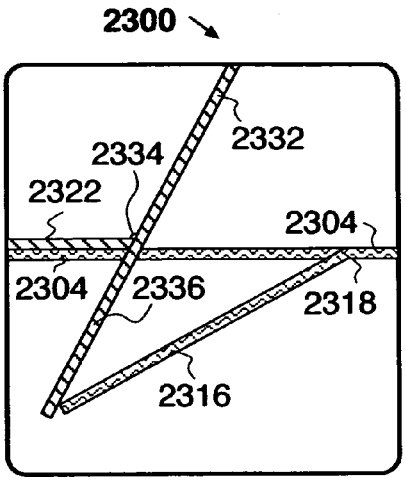
Figure 125:
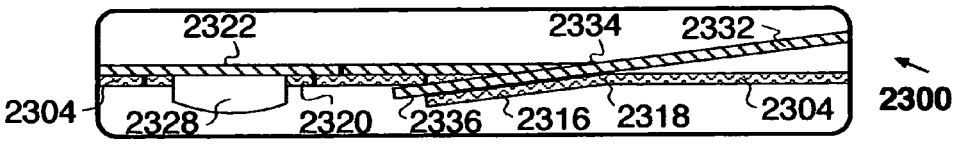

FIG. 124 is an enlarged side cross-sectional partial view showing the lock tab being engaged with one of the lock areas of the carton to secure the selected position. To engage the tab 2336, the forward portion 2332 of the selector 2322 is folded upward to the approximately upright position shown in FIG. 121. The upright forward portion 2332 and the associated lock tab extension 2336 are pressed down onto the lock portion 2316 of the carton 2302 causing the lock portion 2316 to temporarily deform downward at the hinge 2318. As best seen in the enlarged side cross-sectional partial view of FIG. 125 The forward portion 2332 is then folded back down to approximately its original (unfolded) position locking the tab 2336 behind the carton wall 2304. Some selector materials may provide enough memory to obviate the need to actively fold the forward portion back down. Simply letting go of the suitably engaged selector may be sufficient Spring action in the lock portion 2316 further secures the tab 2336 in the lock position. In use, when medication is taken, the forward portion of the selector is folded upward. The spring action of the lock portion is allowed to fully disengage the tab or alternatively the forward portion is lifted slightly from the carton wall surface to disengage the tab. The selector is pivoted to select a time for the next dose and the selector is again locked at the selected position as described above.

FIGS. 126-132 depict an additional twenty-first preferred embodiment 2400 of the invention wherein a tamper-evident reminder device package includes a carton container including an integral aperture pivot area. A removable safety or tamper-evident member, preferably a transparent or translucent label, covers the pivot aperture. A pivoting transparent or translucent selector member for intersectable assembly with the aperture is included inside the carton, but may otherwise be included.

FIG. 126 is a perspective view depicting the front surface of a carton 2402 in the reminder device package 2400. The carton 2402 is similar to the carton 2302 of the previous embodiment 2300. A front wall 2404 of the carton 2402 includes a die cut circular aperture 2406 (FIG. 127) for retentive pivotable engagement of a selector 2416 (FIG. 130). The aperture 2406 is similar to the aperture 2320 in the previous embodiment 2300 of the invention, having the same first radius. Schedule indicia 2408 are the same as the schedule indicia 2312 in the previous embodiment 2300 and are likewise positioned on a concentric (with the aperture 2406) arcuate path having a second larger radius. A concentric (with the aperture 2406) area at a third still farther radial distance from the aperture 2406 includes a release material 2410. Preferably end flaps 2412 of the carton are sealed closed with permanent adhesive as is known in the art to disclose evidence of tampering. A tamper-evident adhesive transparent label 2414 as is known in the art is adhered to the carton surface and covers the aperture 2406. One method for automated application of such a label is by way of tipping equipment in common use. It is to be considered that any article (ex. the selector) which can cover the aperture and provide evidence of tampering once removed may be attached in place of the label 2414. To activate the device the indicia 2408 are customized as previously described, the safety seal or label 2414 covering the aperture 2406 is peeled off, and the selector 2416 is assembled with the aperture 2406.

FIG. 127 is a partial perspective view depicting the reminder device package with the tamper label 2414 removed. The appearance of the front wall 2404 of the carton 2402 is similar prior to application and after removal of the label 2414.

FIG. 128 depicts the front surface of the label 2414. Indicia 2418 indicate the tamper evidence function of the label.

FIG. 129 depicts the rear surface of the tamper-evident label 2414 showing a pattern of adhesive material 2420. Preferably, the adhesive is formulated (as is known in the art) to destruct or become non-functional upon label removal after adhesion. Another suitable tamper-evidence method known in the art is to construct the label material so as to destruct upon removal after adhesion.

FIG. 130 depicts a front surface of the pivotable selector member 2416 in the device 2400. The selector 2416 is similar to the selector 2322 in the previous embodiment 2300 with the following differences. In addition to being transparent or translucent, the selector in the present embodiment does not include a lock tab or aperture to highlight a selection. A score line 2422 at a different location (from score lines 2334 in 2300) produces a hinge for a forward portion 2424. Translucent indicia 2426 serve an equivalent function to indicia 2326 in 2300. Hinged 2428 side flaps 2430 also serve equivalent functions to hinged 2330 side flaps 2328 in 2300.

FIG. 131 depicts a rear surface of the selector 2416. The illustration displays a predetermined pattern of adhesive material 2432.

FIG. 132 is a partial perspective view of the reminder device package 2400 showing the selector 2416 assembled with the pivot aperture 2406 in the carton 2402 according to the method described in U.S. patent application Ser. No. 761, the contents of which are included herein by reference. The side flaps 2430 are substantially hidden from view because they are positioned behind the carton wall 2404. An adhesive 2432 on the rear surface of the selector 2416 is positioned over the release material 2410 on the front of the carton 2402. Pressing down on the front of the adhesive-backed portion of the selector adherably secures a selected position and prevents inadvertent dislocation of the selector by reversibly adhering the selector to the container (or the container to the selector). In use, when medication is taken the forward portion 2424 of the selector 2416 is grasped and the selector is lifted sufficiently to disengage the adhesive 2432 from the release material 2410. The selector is then pivoted to select a time for the next dose and the selector is again pressed down to secure the selection. It is to be considered that the mechanism for securing the selection in the present embodiment 2400 may be combined with the mechanism for securing the selection in the previous embodiment 2300 to provide a greater level of selection security.

FIGS. 133-140 depict an additional twenty-second preferred embodiment 2500 of the invention wherein an adherable rail member comparable to that of embodiment 1300 cooperates with a movable continuous loop member that is constructed differently than the movable member of embodiment 1300. The device members are preferably translucent. They are preferably produced from a common top sheet and carried on a common release liner sheet as are elsewhere described and are not shown.

FIG. 133 depicts the front of a selectable support rail member 2502, having an overall vertical height of L5. The selectable member 2502 includes opposing left and right end portions 2504 and 2506 separated by a vertically narrower middle portion 2508 having a vertical length equal to L6. Suitably produced schedule indicia 2510 are visible from the front of the selectable member. At least a portion 2512 (shaded area above schedule) of a front surface 2514 of the selectable member includes release material.

FIG. 134 depicts the rear of the selectable support member 2502. A rear surface 2516 of the selectable member carries a predetermined pattern of adhesive material 2518 restricted to the opposing left and right ends 2504 and 2506, the adhesive serving as a means for attaching the device to an article.

FIG. 135 depicts the front of a movable selector member 2520. The vertical length of the movable member is divided into three distinct portions. A first end portion 2522 has a vertical length of L7. An opposing second end portion 2524 has a vertical length of L8. And a middle portion 2526 has a vertical length of L9. First and second horizontal graphic demarcation lines 2528 and 2530 which may preferably include structural sets of perforations, respectively separate the first end portion from the middle portion and the middle portion from the second end portion. A vertical structural die cut line 2532 centrally crosses demarcation line 2528. length L9 is slightly longer than length L6 of the selectable member but slightly shorter than length L5. length L8 is slightly shorter than length L9, and length L7 is longer than length L9. The first end portion 2522 further includes a security tab or extension 2534 and further includes a horizontal perforation 2536 or set of perforations to facilitate deformation of the tab. Pointer indicia 2523, visible from the front of the movable member, are preferably produced on the front surface 2525. The second end portion 2524 further includes an aperture 2538 of sufficient dimensions to correctly accommodate the tab extension 2534 when the movable member is folded in assembly (later described).

FIGS. 136 and 137 depict the rear of the movable member 2520 and the front of the selectable member 2502. A rear surface 2540 of the movable member includes a predetermined pattern of adhesive 2542 and 2544. Preferably the two members are assembled together on the liner sheet (not shown). One of the end portions 2504 or 2506 of the selectable rail member 2502 may be temporarily lifted from the liner to place the movable member 2520 behind the selectable member. Alternatively, the deformable rail may be temporarily bowed upward (portion between ends lifted) from the liner to slide the movable member behind the rail member as shown in FIG. 136 and then move the movable member to the position shown in FIG. 137.

FIG. 138 depicts continued assembly of the two members.

As can be seen in the front (FIG. 139) and the enlarged side cross-sectional (FIG. 140) views of the assembled device, from the position shown in FIG.137, the movable member 2520 is formed into a continuous loop around the selectable rail member 2502 by first folding the second end portion 2524 forward and then down to rest on the front surface 2514 of the rail member (FIG. 138). The first end portion 2522 is then folded forward and down onto the second end portion 2524. The pattern adhesive areas 2542 on the rear surface 2540 contact front surface 2525 portions of the movable member and permanently bond the two surfaces together. A portion of the tab 2534 including adhesive portion 2544 fits into the aperture 2538. When the tab is pressed down, it is repositionably attached to the selectable rail front surface 2514. The assembled device may now be attached to an article or left on the liner sheet for use. Customization of the schedule, if necessary, may be performed at any convenient time before or after assembly and before or after attachment. Operation of the device is comparable to that of embodiment 1300. When medication is taken, the security tab is lifted to disengage it from the selectable member, the selector is moved by sliding (pushing sideways on the requisite edge) along the rail to align the pointer with the next appropriate time period, and the security tab is pressed down to adherably secure the selected position.

FIGS. 141-144 depict an additional twenty-third embodiment 2600 of the invention wherein a movable selector member similar to that of embodiment 2500 is formed into a continuous loop around the selectable rail of embodiment 2500.

FIG. 141 depicts the rear of the movable selector member 2602 of the present embodiment 2600. Movable member 2602 is identical in most respects to movable member 2520 of previous embodiment 2500 with the following exception. Movable member 2602 includes a different adhesive pattern on a rear surface 2604. In the present case, an adhesive pattern 2606, equivalent to the adhesive pattern 2544 of embodiment 2500, is included on a portion of a tab 2608 included in a first end portion 2610 of the movable member 2602. An adhesive pattern 2612 is also included on a portion of a second end portion 2614. The second end portion also includes an aperture 2616 which is equivalent to aperture 2538 of embodiment 2500.

FIG. 142 depicts the movable member 2602 positioned for assembly with the selectable rail 2502. The movable member is located behind the selectable rail member by first temporarily lifting one of the adherable rail ends 2504 or 2506 from the liner sheet (not shown), positioning the movable member behind the rail as shown, and lowering the lifted end back to the liner.

As best seen in FIG. 143, the first end portion 2610 is folded onto the front surface 2514 of the rail member, repositionably adhering the tab 2608 to the rail front surface 2514.

As best seen in FIG. 144, the second end portion 2614 is then folded onto and permanently adhered to the front surface of the first end portion. Such folding positions the tab 2608 in the aperture 2616. Operation of the device 2600 is the same as for the previous device 2500.

FIGS. 145-152 depict an additional twenty-fourth embodiment 2700 of the invention wherein a plurality of tactile or raised portions on the front of an adherable rail member selectively engage an aperture in a movable selector. The members are preferably carried on a common liner sheet (not shown).

FIG. 145 depicts the front of a selectable support rail member 2702, similar to support rail 2502 of embodiment 2500. The support rail of the present embodiment 2700 has an overall vertical length of L5. The rail member 2702 includes opposing left and right end portions 2704 and 2706 separated by a vertically narrower middle portion 2708 having a vertical length equal to L6. Suitably produced schedule indicia 2710 are visible from the front of the selectable member. A plurality (row) of suitable tactile (raised) members or bars 2712 produced by any suitable means (ex. screen printing of heavy varnish) are located across the upper portion of a front surface 2714 of the rail member, each tactile member corresponding exclusively to a single selectable schedule position. The bars are shown opaque for clarity in the illustrations, but may be produced as translucent or transparent or near transparent. It should be noted that shapes, sizes and heights of raised or projecting elements, other than those depicted, may work in some applications. The horizontal length between any three consecutive bars is slightly greater than W2.

FIG. 146 depicts the rear of the selectable rail member 2702. A rear surface 2716 of the selectable member carries a predetermined pattern of adhesive material 2718 restricted to the opposing left and right ends 2704 and 2706, the adhesive serving as a means for attaching the device to an article.

FIG. 147 is a cross sectional view of the rail member of FIG. 145 showing the raised bars 2712 on the surface 2714 of the rail 2702.

FIG. 148 depicts the front of a movable selector member 2720. The vertical length of the movable member is divided into three distinct portions. A first end portion 2722 has a vertical length of L10. An opposing second end portion 2724 has a vertical length of L11. And a middle portion 2726 has a vertical length of L12. First and second horizontal graphic demarcation lines 2728 and 2730 which may preferably include structural sets of perforations, respectively separate the first end portion from the middle portion and the middle portion from the second end portion. Aperture 2732 centrally crosses demarcation line 2728 and aperture 2734 centrally crosses demarcation line 2730. Length L12 is slightly longer than length L6 of the selectable member but slightly shorter than length L5. Length L10 is slightly shorter than length L12 and length L11 is slightly shorter than length L12. The second end portion 2724 further includes pointer indicia 2736. The movable member 2720 has an outside horizontal length equal to W3 which is slightly shorter than W2.

FIGS. 149 and 150 depict the rear of the movable member 2720 and the front of the rail member 2702 in assembly of one with the other. A rear surface 2738 of the movable member includes a predetermined pattern of adhesive 2740. The adhesive pattern is shown as opaque for clarity in some of the illustrations, but the adhesive is preferably produced as transparent or near transparent Preferably the two members are assembled together on the liner sheet (not shown). The movable selector is moved to or placed in the position shown in FIG. 150 for folding.

As can be seen in the front (FIG. 151) and the enlarged side cross-sectional (FIG. 152) views of the assembled device, from the position shown in FIG. 150, the movable member 2720 is formed into a continuous loop around the selectable rail member 2702 by first folding the first end portion 2722 forward and then down to rest on the front surface 2714 of the rail member. The second end portion 2724 is then folded forward and down onto the first end portion 2722, forming a permanent loop. The raised bar 2712 is thusly located in the aperture 2732, hindering inadvertent displacement of the movable member. The movable member may be forcefully pushed sideways to deform the movable member over and past the engaged bar (détente). When medication is taken, the selector is moved by sliding (forcefully pushing sideways on the requisite edge) along the rail to align the pointer with the next appropriate time period and similarly secure the selected position.

FIGS. 153-158 depict an additional twenty-fifth embodiment 2800 of the invention wherein the rail member 2702 of embodiment 2700 is assembled with a movable member including a tactile or raised member (détente) similar to that used in the rail 2702.

FIG. 153 depicts the front of a translucent movable member 2802. The movable member includes apertures 2804 and 2806 as well as folding demarcation lines 2808 and 2810. A first end portion 2812 of a front surface 2814 includes printed mirror-image pointer or indicia 2816. A pair of raised bars or détentes 2818 adapted to capture one of the rail member bars 2712 are also produced on a second end portion 2820 of the front surface 2812. The bars are shown opaque for clarity in some of the illustrations, but are preferably produced as near transparent as possible. Bars 2818 of lesser translucency will also work in many applications. The raised bars may be produced by any suitable means, but printing with a varnish type of material is preferred.

FIG. 154 depicts the rear of the movable member 2802. Shown are the indicia 2816 and a portion of the bars 2818 on the front surface, but visible through the translucent member. The second end portion 2820 of a rear surface 2822 of the movable member carries a patterned layer of adhesive 2824. Other patterns of adhesive will work in many applications. The adhesive is shown as opaque for clarity in many of the illustrations, but preferably the adhesive is as near transparent as possible. Adhesives of lesser translucency will also work in many applications. It is also to be considered that printing on the rear surface may work in some applications FIG. 155 depicts the fronts or bar bearing surfaces of the rail member 2702 and movable member 2802 positioned for assembly. As best seen in FIG. 156, from the position shown in FIG. 155, the second end portion 2820 of the movable member 2802 is folded forward and onto the front surface 2714 of the rail. The movable member adhesive 2824 is only shown in outline for clarity.

FIG. 157 shows an enlarged partial cross-section of the members as arranged in FIG. 156. The raised détente 2712 of the rail 2702 is shown captured between the raised détentes 2818 of the movable member 2802.

FIG. 158 depicts the device members assembled for operation. The engaged détentes (2712 and 2818) are not shown for clarity. From the position shown in FIG. 156, the first end portion 2812 is folded forward and onto the adhesive of the second end portion 2820, forming a continuous loop. Forcefully pushing the movable member sideways along the rail deformably moves the member over and past the captured rail détente. A new schedule position may be similarly selected.

FIG. 159-160 depict an additional twenty-sixth embodiment 2900 of the invention wherein an adherable rail including a plurality of planar extensions cooperates with a continuous loop movable selector. The rail includes a pattern of adhesive on its back surface similar to that of rail 2702 in embodiment 2700. The extensions act as anti-displacement détentes. Forceful sideways movement of the selector across an extension causes either one or both of the members to resiliently deform.

FIG. 159 depicts the front of the assembled device 2900. The adherable rail 2902 is shown having a plurality of protrusions 2904 extending from upper 2906 and lower 2908 perimeters of the rail and located between selectable schedule positions 2910. The adherable ends 2912 and 2914 extend further than the détentes 2904. The selector 2916 may be forcefully pulled sideways along the rail to select a new position.

FIG. 160 depicts an enlarged side cross-section of the device in FIG. 159. Loop sizing of the movable selector relative to rail vertical length prevents inadvertent dislocation of the movable member while allowing intentional forceful movement to a new selection.

FIGS. 161 and 162 depict a variation of the rail 2902 in the previous embodiment 2900 of the invention. The new rail 2920 includes vertical structural perforation lines 2922 or equivalent at the ends 2924 for folding the rail member. Adhesive material 2926 as can be seen in a view of the rear (FIG. 161) surface 2928 of the rail is restricted to end portions between the perforations and the outer edges of the rail. This arrangement allows for convenient attachment of the rail to an article (ex. container cap 2930, FIG. 162) by a single end of the rail. The unattached end of the rail is folded along the perforation to adhere the adhesive portion on the back to the back of a remaining end portion.

FIGS. 163-166 depict an additional twenty-seventh embodiment 3000 of the invention wherein a rail member includes a plurality of apertures for capturing a tab produced in a movable selector member.

FIG. 163 depicts a front surface 3002 of the movable member 3003 of the device. Hinged 3004 left and right side flaps 3006 include die cut tab projections 3008 adapted to engage apertures in the rail. Bending the side flaps upward at the hinges caused the tabs to project downward.

FIG. 164 depicts a rear surface 3010 of the movable selector and shows a pattern of adhesive material 3012 located between the tabs.

FIG. 165 depicts the front of the rail member 3014 and shows a row of apertures 3016 in the structure as well as schedule indicia 3018 printed on a front surface 3020. The rail may optionally include standoffs suitably produced. The rear of the rail (not shown) includes a suitable pattern of adhesive on the rear surface.

FIG. 166 depicts the assembled device 3000 of the present invention. The tabs are substantially covered by rail material because they are inserted into the rail apertures, the aperture walls anti-displaceably engaging the tabs. Procedure for engaging and disengaging the tabs is similar to that described for lock tab 2336 in embodiment 2300.

FIGS. 167-174 depict an additional twenty-eighth embodiment 3100 of the invention wherein the device is operationally comparable to that of embodiment 2100. A releasable portion of a first member and a releasable portion of a superimposed second member are joined together to produce a movable selector. A repositionable adhesive for securing a selected position is retained on the rear surface of the releasable superimposed member. The device members are preferably produced from translucent stock material.

FIG. 167 depicts a front surface 3102 of the first member 3104 adhered to a release liner 3106. The member is shown including a releasable substantially rectangular portion 3108 including structural perforations 3110 to facilitate handling and operation. Other shapes are of course possible and other patterns of perforations may work well in some applications. The releasable portion is joined to a removable left tear strip 3112 by a weakened line of structural perforations 3114. When the tear strip is removed, the releasable portion 3108 is released. The tear strip is further joined to upper and lower adherable portions 3116 by weakened lines of structural perforations 3118 to permit removal of the tear strip and release of the releasable portion 3108. Other patterns of attachment between the related portions may work in some applications.

FIG. 168 is an additional view of the front surface 3102 of the first member 3104. The realeasable portion 3108 is shown including a layer or coating of release material 3120 across upper and lower portions. Other patterns of release material may work well in some applications.

FIG. 169 depicts a rear surface 3122 of the first member 3104. The adherable portions 3116 are shown carrying a layer of adhesive material 3124 (preferably permanent).

FIG. 170 depicts a front surface 3126 of a second member 3128 adhered to a release liner 3130. The member is shown including a releasable substantially cruciform portion 3132, including upper and lower security tab portions 3133, and including structural perforations 3134 to facilitate handling and operation. Other shapes are of course possible and other patterns of perforations may work well in some applications. A left tear strip 3136 is delineated by weakened lines of structural perforation 3140. A right tear strip 3138 is delineated by weakened lines of structural perforations 3142. The releasable cruciform portion is joined to the left and right tear strips. When both tear strips are removed, the releasable portion 3132 is released. Other patterns of attachment between the releasable portion and the tear strips, between the releasable portion and the remainder of the member, and between the tear strips and the remainder of the member may work in some applications. Suitable pointer indicia 3144 are produced on the releasable portion along with suitable instructional indicia 3146 on the tear strips. A row of suitable schedule indicia 3448 is also produced below the right tear strip 3138. A patterned coating of release material 3150 is shown applied to the front surface. Other patterns of release coating may work well in some applications.

FIG. 171 depicts a rear surface 3152 of the second member 3128. Shown is a pattern coating of adhesive material 3154. The second member 3128 is removed from the liner 3130 shown in FIG. 170 and is superimposed in register onto the first member shown in FIG. 167 to produce a combined member 3156 temporarily held on the liner 3106. The process is preferably accomplished by automated equipment adapted for the task. Such equipment is known in the label converting and manufacturing art.

FIG. 172 depicts the combined member 3156 and shows the underlying relative position of the first member in shading. The left tear strips of both members are thusly adhered together and the releasable portions of both members are thusly adhered together producing a combined releasable member 3158 (best seen in FIG. 173). Adhesive portions (i.e. security tabs 3133) of the superimposed member that land on release coated portions of the first member may be repeatedly lifted from and repeatedly readhered to the release-coated surface. The combined member 3156 may be removed from the release liner 3106 and attached to an article in a single step.

FIG. 173 depicts the combined member 3156 attached to the surface of a carton 3160 by way of the remaining available adhesive 3124 and 3154 on the rear of the combined member. To activate the device, both left tear strips (removed as a unit) and the right tear strip are removed (all shown removed in FIG. 173), releasing the combined releasable member 3158. Tear strip removal produces upper 3162 and lower 3164 substantially parallel substantially horizontal guide rail portions and a travel channel 3166 between the rail portions.

As best seen in FIG. 174, the combined released member or selector 3158 is moved to a desired selection by lifting the security tabs 3133 forward and horizontally sliding the selector (initially rightward) to a new position. The security tabs are thusly located in front of the rail portions 3162 and 3164 and portions of the rail portions are trapped between the layers of material in the combined selector. Pressing down on the security tabs repositionably adheres them to the release coated 3150 surface of the rail portions. In use, operation of the device 3100 is similar to that of the previous embodiment 2100.

FIGS. 175-185 depict an additional twenty-ninth embodiment 3200 of the invention wherein assembly of a device equivalent to that of embodiment 2500 may be automated. Assembly of part of the device may be automated as shown in the illustrations or assembly of the entire device may be automated using known equipment adapted for the assembly. A label sheet in the device is preferably translucent.

FIG. 175 depicts a movable selector member 3202 (similar to 2520 of embodiment 2500) formed as part of the label sheet 3204, with die-cut lines or equivalent being provided to define the peripheries of the member and permit its separation from a release liner of the label sheet. It is to be appreciated that breakable attachments at points (not shown) as are known in the art may further be included at the peripheries of the device and the surrounding sheet as may be necessary to achieve desirable handling performance of the label sheet and the movable member. A first foldable end portion 3206 separates a pair of removable side tear strips 3208. A base portion 3210 is attached to the first end portion 3206. A second foldable portion 3212 separates a securable end portion 3214 from the base portion 3210. A front surface 3216 of the sheet 3204 shown in FIG. 175 further includes release material portions 3218

FIG. 176 depicts a rear surface 3220 of label sheet 3204. The shaded areas show an exemplary adhesive 3222 pattern.

FIG. 177 depicts the selectable support rail 2502 of embodiment 2500 positioned (in register) in assembly on the surface of the sheet 3204 of FIG. 175. Imposition may be automatically performed using tipping equipment or other methods known in the art. When the rail 2502 is positioned on the base portion 3210 of the movable member 3202, the adhesive portions on the back of the rail are caused to removably rest on the release material portions 3218.

As best seen in the perspective view of FIG. 182 (some copy not shown for clarity) the movable selector 3202 is folded around the rail 2502 to form a continuous loop.

Turning to FIG. 178, the first end portion 3206 including the attached tear strips 3208 is folded up and onto the front surface of the rail 2502. Digital contact with the adhesive 3222 on the first end portion 3206 may be avoided by using the tear strips to manipulate the end portion. Lifting the first end portion 3206 exposes a portion of the liner 3224 holding the label sheet As seen in FIG. 179, the securable end portion 3214 is grasped and lifted to fold the second foldable portion 3212 onto the adhesive 3222 of the first end portion 3206.

As seen in FIG. 180, the securable end portion 3214 is then folded onto and adhered to the second foldable portion 3212, causing a portion of adhesive 3222 on the securable portion 3214 to repositionably contact the release material on the rail 2502 as in embodiment 2500.

As seen in FIG. 181, once the selector 3202 and the rail 2502 are fully assembled, the side tear strips 3208 may be removed. The fully assembled device 3200 may be removed from the label sheet 3204 in a single step and applied to a container in a single step.

FIG. 183 depicts the device 3200 attached to the side of container 3226.

FIG. 184 depicts the device 3200 of FIG. 183 after the selector 3202 has been moved and secured at a next-dose selection on the rail 2502. Operation of the device 3200 is the same as for similar embodiments previously described.

FIG. 185 depicts the label sheet of FIG. 175 after the assembled selector 3202 has been removed.

FIGS. 186-187 depict an additional thirtieth embodiment 3300 of the invention wherein the folding procedure used in device assembly of embodiment 3200 is incorporated in a reminder kit for manual assembly.

FIG. 186 depicts a movable selector member 3302 (similar to 3202 of embodiment 3200) and selectable support rail members 3304 and 3306 (similar to 2502 of embodiment 2500) formed as part of a label sheet 3308, with die-cut lines or equivalent being provided to define the peripheries of the members and permit their separation from a release liner 3312 (FIG. 187) of the label sheet The front surface of the label sheet includes a pattern of release material 3310.

FIG. 187 shows one of the schedules 3306 (rail member) manually removed from its die cut position in the sheet and superimposed onto the selector 3302 (in register) for assembly with the selector. Further assembly of the selector and the superimposed rail are the same as in previous embodiment 3200. Removal of the assembled device 3300, attachment to an article, and operation, is also the same as in embodiment 3200.

It is evident from the descriptions above that the disclosed securable medication reminder device has a number of advantages. Still other advantages will become apparent upon further consideration. In rotatable band embodiments, the rotatable band may now be repeatedly and easily assembled and disassembled on a container to achieve optimum fit for individual needs. The band may be fitted relatively loosely to accommodate individuals with dexterity issues and still be secured at any given selection. Tapered wall containers may now be used with the same reliability as straight wall containers and thin low cost label materials no longer present a problem. Many smaller size short containers may now be used with the device because the mounted band may be constructed to rotate without any longitudinal displacement on the container. Application of the device may be automated. In embodiments where a sliding selector moves on an adherable rail member, the device is suitable for application to curved wall or flat wall articles. The device is substantially container independent, allowing a single standardized device size to be used on virtually all containers. Manual device assembly and application tolerances are extremely wide and procedures are very simple and easy. Device assembly may be automated using known equipment and application of the device may be automated using current labeling equipment. In pivoting embodiments, lock construction and securing a selection has been greatly simplified. The device may be adapted for inclusion in a package wherein activation of the device discloses evidence of tampering. Thus the reader will see that the invention provides significant and material improvements over prior designs.

While the above descriptions contain many speceficities, these should not be construed as limitations on the scope of the invention, but rather as exemplifications of the embodiments thereof. Various alterations or changes can be made without departing from the spirit and broader aspects of the invention as defined in the appended claims. Many other variations are possible. For example, it is anticipated that single-step application of members may be accomplished by adherably superimposing one member on another without laminating. Elements from one embodiment may be incorporated in another. Tabs and apertures may vary in shape, quantity and location from those shown. It is also anticipated that device members could include additional scores, perforations, and other structural elements to impart desirable operational characteristics to the member. It is further anticipated that the device may find use as a reminder in all sorts of additional applications such as food, vitamins, tasks, events etc.

Any reference to claim elements in the singular, for example using the articles "a", "and" or "said" is not to be construed as limiting the element to only one element unless so specifically stated. The claims are to be interpreted in accordance with the principles and patent law including the doctrine of equivalence.

What I claim as my invention is:

1. In a reminder device, the device comprising:

a) a movable member defining an area for engagement, said member engageably movable to each of a plurality of adherably selectable positions;

b) said member including a selective tab re-adhering a plurality of times;

c) said device including a co-operating member co-operating with said movable member;

d) the tab moved relative to a constant point in the movable member from a first position relative to said constant point to a second position relative to said constant point, to adhere said tab to said co-operating member;

e) said movable member including a first portion and a second portion for linking to said first portion to form a loop; and f) said movable member including an opening, within which a portion of said tab is disposed to adhere said tab to said co-operating member.

2. The device of claim 1 and further including co-operating indicia.

3. The device of claim 2 wherein said indicia is adapted for production by a labeling means which is one chosen from a list which includes; a sheet fed printer, a roll fed printer, a screen printer, a flexographic printer, a computer printer, computer software, a pharmacy printer, a label sheet, a label roll, a pen, a marker.

4. The device of claim 1 wherein said co-operating member includes a rail which said movable member slidingly engages to each of said selectable positions.

5. The device of claim 1 and further including a rail around which said movable member forms said loop.

6. The device of claim 1 and further including a coupling element defining an area of said tab for directly adhering said area to a surface.

7. The device of claim 6 wherein said area directly re-adheres to a surface more than twice by way of said coupling element.

8. The device of claim 6 wherein said coupling element is one chosen from a list which includes; an adhesive, a static charge, suction.

9. The device of claim 1 and further including and displacement means for disallowing movement of said movable member from one of said selected positions to a second one of said selectable positions.

10. The device of claim 9 wherein said anti-displacement means is one chosen from a list which includes; an adhesive, a permanent adhesive, a pressure sensitive adhesive, a repositionable adhesive, an adhesive material, a coating, suction, a static charge.

11. The device of claim 1 wherein said co-operating member is one chosen from a list which includes; an adhesive member, a cap, a closure, a container, a deformable member, an intersecting member, a label, a rail member, a sheet member, a spacer member, a support member, a selected member, a slidingly engaged member.

12. The device of claim 1 wherein said co-operating member attaches to an article such that a surface of the co-operating member substantially directly opposes a surface of the article, and wherein said device includes a plurality of standoff means along said co-operating member to keep an area of said co-operating member between a first and second of said standoff means substantially away from said opposing surface of the article to facilitate disposal of said movable member to said co-operating member area.

13. The device of claim 12 wherein said article is one chosen from a list which comprises; a container, a sheet, a pharmacy container, a bottle, a vial, a label.

14. The device of claim 12 wherein one of said standoff means is one chosen from a list which includes; a bump, a raised line, a crease, a score, a coating, a heavy surface coating, a raised surface coating, a screened coating, a varnish, an ink, a tactile material, a thermographic coating, a raised area, a raised surface area.

15. The device of claim 1 and further including a second release means for releasing a first part of said device from a second part of said device.

16. The device of claim 15 wherein said second release means is one chosen from a list which includes; a perforation, a weakened structural line, a tab, a tear tab, a tear strip, an adhesive, a lamination, a release coating, a release material.

17. The device of claim 1 wherein said device includes an element which is one chosen from a list which includes; said device exhibiting a color change associated with a position selected by said movable member, an expandable material attached to said co-operating member to allow said co-operating member to be secured around a container, a flexible container for attachment to one of said members, a stretchable material attached to said co-operating member to allow said co-operating member to be secured around an article said co-operating member linked to the movable member for processing, said co-operating member linked to the movable member for co-attachment to an article.

18. The device of claim 1 wherein said device includes an adaptation which is one chosen from a list which includes; adapted for linking a member of said device for processing, adapted for automated assembly, adapted for automated attachment to an article.

19. A method comprising:

a) providing a movable member defining an area for engagement, the member engageably movable to each of a plurality of adherably selectable positions;

b) said member including a selective tab re-adhering a plurality of times;

c) providing a co-operating member for co-operating with the movable member;

d) the tab movable relative to a constant point in the movable member from a first position relative to said constant point to a second position relative to said constant point, to adhere the tab to the co-operating member;

e) the movable member including a first portion and a second portion for linking to said first portion to form a loop; and f) the movable member including an opening, within which a portion of the tab is disposable to adhere the tab to the co-operating member.

20. The method of claim 19 and further providing an element, said element being one chosen from a list which includes; indicia for co-operating with one of said members, a container for attachment to one of said members, a pharmacy container for attachment to one of said members, a label for carrying indicia for co-operating with one of said members, a pharmacy label for carrying indicia for co-operating with one of said members, an adhesive for adhering said tab to said co-operating member, a coating for coating onto a surface of one of said members, a tactile material for attachment to one of said members for a standoff.

21. In a reminder device, the device comprising:

a) a deformable sheet rail member including a back surface and a front surface opposing said back surface, said front surface substantially parallel to said back surface, and a part of said member forming a rail on which a co-operating member can slide to each of a plurality of adherably selectable positions at which the co-operating member can cooperate with co-operating indicia, said rail member defining an area for adherence and release;

b) a deformable sheet movable member co-operating with said rail member, said movable member engaging said rail such that a portion of said movable member is locatable on said back surface and a portion of said movable member is locatable on said front surface;

c) said movable member including a selective tab re-adhering a plurality of times, the tab moved relative to a constant point in the movable member from a first position relative to said constant point to a second position relative to said constant point, to adhere said tab to said rail member;

d) said device including a coupling element occupying an area of said tab, said tab area defined by said coupling element for said tab area to adhere thereto and release there from said area of said rail member, wherein said coupling element is one chosen from a list comprising; an adhesive, a static charge, a suction; and e) said tab area re-adhered to said area of said rail member more than twice by way of said coupling element.

22. The device of claim 21 wherein said rail member includes a first part forming said rail and a second part attached to said first part for processing.

23. The device of claim 22 wherein said attachment is by way of a component which is one chosen from a list which comprises; a lamination, an adhesive, a perforation, a tear strip, a weakened line.

24. The device of claim 21 and further including co-operating indicia.

25. The device of claim 24 wherein said indicia is adapted for production by a labeling means which is one chosen from a list which includes; a sheet fed printer, a roll fed printer, a screen printer, a flexographic printer, a computer printer, computer software, a pharmacy printer, a label sheet, a label roll, a pen, a marker.

26. The device of claim 21 wherein said coupling element is further comprised of one chosen from a list which includes, a permanent adhesive, a pressure sensitive adhesive, a repositionable adhesive, an adhesive material.

27. The device of claim 21 wherein said rail member is one chosen from a list which includes; an adhesive member, a rail member where said rail is attached to a cap, a rail member where said rail is attached to a closure, a rail member where said rail is attached to a container, a deformable member, an intersecting member, a label, a sheet member, a spacer member, a support member, a selected member, a slidingly engaged member.

28. The device of claim 21 wherein said rail member attaches to an article such that a surface of the rail member substantially directly opposes a surface of the article, and wherein said device includes a plurality of standoff means along said rail member to keep an area of the rail member between a first and second of said standoff means substantially away from said opposing surface of the article to facilitate disposal of said movable member to said rail member area.

29. The device of claim 28 wherein said article is one chosen from a list which comprises; a container, a sheet, a pharmacy container, a bottle, a vial, a label.

30. The device of claim 28 wherein one of said standoff means is one chosen from a list which includes; a bump, a raised line, a crease, a score, a coating, a heavy surface coating, a raised surface coating, a screened coating, a varnish, an ink, a tactile material, a thermographic coating, a raised area, a raised surface area.

31. The device of claim 21 and further including a second release means for releasing a first part of said device from a second part of said device.

32. The device of claim 31 wherein said second release means is one chosen from a list which includes; a perforation, a weakened structural line, a tab, a tear tab, a tear strip, an adhesive, a lamination, a release coating, a release material.

33. The device of claim 21 wherein a first part of said movable member includes an opening for disposing a second part of said movable member within said opening.

34. The device of claim 21 wherein said movable member includes a first portion and a second portion linking to said first portion to form a loop around said rail.

35. The device of claim 21 wherein said device includes an adaptation which is one chosen from a list which includes; adapted for linking a member of said device for processing, adapted for automated assembly, adapted for automated attachment to an article.

36. The device of claim 21 wherein said movable member is laminated to an adhesive label.

37. The device of claim 21 wherein said device includes an element which is one chosen from a list which includes; said device exhibiting a color change associated with a position selected by said movable member, an expandable material attached to said rail member to allow said rail member to be secured around a container, a flexible container for attachment to one of said members, a stretchable material attached to said rail member to allow said rail member to be secured around an article, said rail member linked to the movable member for processing, said rail member linked to the movable member for co-attachment to an article.

38. In a reminder device, the device comprising:

a) a movable member defining an area for engagement, said member engageably movable to each of a plurality of adherably selectable positions at which said movable member can cooperate with co-operating indicia;

b) said member including a selective tab re-adhering a plurality of times;

c) said device including a co-operating member co-operating with said movable member, said co-operating member defining a coupling area for adherence and release;

d) the tab moved relative to a constant point in the movable member from a first position relative to said constant point to a second position relative to said constant point, to adhere said tab to said co-operating member;

e) said movable member including a first portion and a second portion for linking to said first portion to form a loop around a rail on which said movable member can slide to each of said selectable positions;

f) said device including a coupling element occupying an area of said tab, said tab area defined by said coupling element for said tab area to directly adhere thereto and release there from said area of said co-operating member, wherein said coupling element is one chosen from a list comprising; an adhesive, a static charge, a suction; and g) said tab area directly re-adhered to said coupling area of said co-operating member more than twice by way of said coupling element, such that said tab area directly re-adhered to said co-operating member at a selected position on said co-operating member is directly re-adhered to said co-operating member at a second selected position on said co-operating member.

39. The device of claim 38 wherein said co-operating member attaches to a support surface such that a surface of the co-operating member substantially directly opposes said support surface, and wherein said device includes a plurality of standoff means along said co-operating member to keep an area of said co-operating member between a first and second of said standoff means substantially away from said opposing support surface to facilitate disposal of said movable member to said co-operating member area.

40. The device of claim 39 wherein one of said standoff means is one chosen from a list which includes; a bump, a raised line, a crease, a score, a coating, a heavy surface coating, a raised surface coating, a screened coating, a varnish, an ink, a tactile material, a thermographic coating, a raised area, a raised surface area.

41. The device of claim 38 wherein said coupling element is an adhesive carried by said tab from a first selected position to a second selected position.

42. The device of claim 38 and further including an element which is one chosen from a list which comprises; said co-operating indicia disposed on a surface of said co-operating member, a pressure sensitive adhesive, a coating coated onto one of said members, a label carrying said co-operating indicia, a container attaching to one of said members, a sheet attached to one of said members, a perforation for a second release means for releasing a first part of said device from a second part of said device, a weakened structural line for a second release means for releasing a first part of said device from a second part of said device, a tear tab for a second release means for releasing a first part of said device from a second part of said device, a tear strip for a second release means for releasing a first part of said device from a second part of said device, a lamination for a second release means for releasing a first part of said device from a second part of said device, a release coating on said co-operating member to facilitate said release of said tab from said area of said co-operating member, a release material at said co-operating member to facilitate said release of said tab from said area of said co-operating member, an opening in a first part of said movable member for disposing a second part of said movable member within said opening, said device exhibiting a color change associated with a position selected by said movable member, a second co-operating member linked to the movable member for processing, said co-operating member linked to the movable member for co-attachment to an article.

* * * * *